US009629481B2

(12) United States Patent
Karan

(10) Patent No.: US 9,629,481 B2
(45) Date of Patent: Apr. 25, 2017

(54) DISPLAY ASSEMBLY SUPPORT WITH LOW VOLTAGE BUS

(71) Applicant: POP Displays USA LLC, Yonkers, NY (US)

(72) Inventor: Joel Karan, Millburn, NJ (US)

(73) Assignee: POP DISPLAYS USA, LLC, Yonkers, NY (US)

( * ) Notice: Subject to any disclaimer, the term of this patent is extended or adjusted under 35 U.S.C. 154(b) by 231 days.

(21) Appl. No.: 14/139,435

(22) Filed: Dec. 23, 2013

(65) Prior Publication Data

US 2014/0218896 A1 Aug. 7, 2014

Related U.S. Application Data

(62) Division of application No. 12/766,815, filed on Apr. 23, 2010, now Pat. No. 8,646,935.

(60) Provisional application No. 61/172,100, filed on Apr. 23, 2009.

(51) Int. Cl.

| | |
|---|---|
| ***H01R 25/14*** | (2006.01) |
| ***A47F 3/00*** | (2006.01) |
| ***A47F 1/12*** | (2006.01) |
| ***A47F 5/00*** | (2006.01) |
| ***A47F 11/10*** | (2006.01) |

(52) U.S. Cl.

CPC ..... *A47F 3/001* (2013.01); *A47F 1/12* (2013.01); *A47F 1/126* (2013.01); *A47F 5/005* (2013.01); *A47F 11/10* (2013.01); *Y10T 29/49826* (2015.01)

(58) Field of Classification Search

CPC ..... H01R 25/147; H01R 25/14; F21V 21/34; F21V 21/35; A47F 5/10

See application file for complete search history.

(56) References Cited

U.S. PATENT DOCUMENTS

| | | | | |
|---|---|---|---|---|
| 1,974,050 A | | 9/1934 | Keil | |
| 2,251,050 A | | 7/1941 | Hagerty et al. | |
| 4,540,235 A | | 9/1985 | Lolic | |
| 4,689,726 A | * | 8/1987 | Kretzschmar | F21V 19/0085 362/127 |
| 4,747,025 A | * | 5/1988 | Barton | A47F 5/0846 211/94.01 |

(Continued)

FOREIGN PATENT DOCUMENTS

| | | | | |
|---|---|---|---|---|
| DE | EP 1688070 A1 | * | 8/2006 | A47F 11/10 |
| EP | 1 688 070 A1 | | 1/2006 | |

(Continued)

OTHER PUBLICATIONS

UL 153 ISBN 1-55989-842-9 Portable Electric Lamps, UL Standard (Feb. 14, 1997), p. 22, sec. 14.1.1.

(Continued)

*Primary Examiner* — Ismael Negron

(74) *Attorney, Agent, or Firm* — Nolte, Nolte & Hunter; Christopher B. Garvey

(57) ABSTRACT

At least one pair of conductive standards have a plurality of slots for receiving and supporting the conductive support brackets of a display module, with a low voltage power source electrically connected to the pair of conductive standards for supplying power to the display module through the conductive standards and support brackets.

3 Claims, 52 Drawing Sheets

(56) References Cited

U.S. PATENT DOCUMENTS

| | | | | | |
|---|---|---|---|---|---|
| 4,973,796 | A * | 11/1990 | Dougherty | H01R 25/14 | 174/494 |
| 5,072,343 | A * | 12/1991 | Buers | A47F 3/001 | 312/223.5 |
| 5,287,252 | A | 2/1994 | Caruso | | |
| 5,348,485 | A * | 9/1994 | Briechle | H01R 25/14 | 439/110 |
| 5,647,485 | A | 7/1997 | Verrangia | | |
| 5,690,415 | A * | 11/1997 | Krehl | A47F 5/101 | 108/23 |
| 5,695,261 | A * | 12/1997 | Slesinger | A47F 11/10 | 312/223.6 |
| 6,042,244 | A * | 3/2000 | Witkoski | A47F 5/0043 | 362/125 |
| 6,199,705 | B1 | 3/2001 | Portner | | |
| 6,231,205 | B1 * | 5/2001 | Slesinger | A47B 96/02 | 439/110 |
| 6,527,565 | B1 * | 3/2003 | Johns | H01R 25/142 | 439/112 |
| 7,121,675 | B2 * | 10/2006 | Ter-Hovhannisian | A47F 3/001 | 62/264 |
| 7,163,305 | B2 | 1/2007 | Bienick | | |
| D550,290 | S | 9/2007 | Bowring et al. | | |
| D553,878 | S | 10/2007 | Edison et al. | | |
| 7,338,180 | B2 | 3/2008 | Wing | | |
| 7,628,525 | B2 | 12/2009 | Lee et al. | | |
| 7,766,502 | B2 * | 8/2010 | Tress | A47B 97/00 | 362/125 |
| 7,798,338 | B2 | 9/2010 | Maheu et al. | | |
| 2002/0085373 | A1 | 7/2002 | Slesinger et al. | | |
| 2006/0209537 | A1 | 9/2006 | Stelmasik et al. | | |
| 2007/0195517 | A1 | 8/2007 | Oketani et al. | | |
| 2008/0094824 | A1 | 4/2008 | Stack et al. | | |
| 2008/0121146 | A1 | 5/2008 | Burns et al. | | |
| 2011/0273867 | A1 * | 11/2011 | Horst | A47B 96/021 | 362/133 |

FOREIGN PATENT DOCUMENTS

| | | | | |
|---|---|---|---|---|
| EP | 1688070 | A1 | 8/2006 | |
| FR | 2 731 885 | A1 | 3/1995 | |
| FR | 2731885 | A1 * | 9/1996 | A47F 11/10 |
| JP | 11-206530 | A | 8/1999 | |
| JP | 2006-318789 | A | 11/2006 | |
| JP | 2006-320605 | A | 11/2006 | |
| JP | 2009-240382 | A | 10/2009 | |

OTHER PUBLICATIONS

UL 2108 ISBN 0-7629-0953 Low Voltage Lighting Systems, UL Standard, (Feb. 27, 2004) p. 14, Sec. 10.1.

International Search Report PCT/IB2011/052097 dated Jan. 11, 2012.

Author: POP Displays Title: Illuminated Wall System Q9389202 Loreal; book—installation manual Dated: Oct. 18, 2005 pp. 1A to 35 Published by: POP Displays USA, LLC, Yonkers, NY, USA.

Author: POP Displays, USA, LLC, Yonkers, NY, USA; four photographs of the display unit described in Non-Patent reference 1—Illuminated Wall System; the apparatus was in public use in late 2005; These photos may have been published thereafter.

Author: C. Garvey Title: 14 photos of POP Display's Illuminated Wall System described in Non-Patent Literature Document Cite No. 1, photographed in a Stop & Shop store in Amityville, NY Dated: Photographs taken in 2010 of an example of the system, first used in 2005. 14 photos; Not published.

Petition for Inter Partes Review in IPR2015-00266, filed on Nov. 13, 2014 (Paper No. 1).

Power of Attorney in IPR2015-00266, filed on Nov. 13, 2014 (Paper No. 2).

Related Matters in IPR2015-00266, filed on Dec. 2, 2014 (Paper No. 3).

Power of Attorney in IPR2015-00266, filed on Dec. 2, 2014 (Paper No. 4).

Notice of Filing Date Accorded to Petition in IPR2015-00266, filed on Dec. 8, 2014 (Paper No. 5).

Patent-Owner-Prelim-Response in IPR2015-00266, filed on Mar. 9, 2015 (Paper No. 6).

Decision Institution of Inter Partes Review in IPR2015-00266, filed on Apr. 28, 2015 (Paper No. 7).

Scheduling Order in IPR2015-00266, filed on Apr. 28, 2015 (Paper No. 8).

Order Conduct of Proceeding in IPR2015-00266, filed on Jun. 9, 2015 (Paper No. 9).

Order Conduct of Proceeding in IPR2015-00266, filed on Jul. 7, 2015 (Paper No. 10).

Motion to Seal in IPR2015-00266, filed on Jul. 8, 2015 (Paper No. 11).

Patent Owner Response in IPR2015-00266, filed on Jul. 8, 2015 (Paper No. 12).

Motion to Amend in IPR2015-00266, filed on Jul. 9, 2015 (Paper No. 13).

Proposed Substitute Claims in IPR2015-00266, filed on Jul. 9, 2015 (Paper No. 15).

Order Conduct of the Proceeding in IPR2015-00266, filed on Jul. 14, 2015 (Paper No. 16).

Reformatted Patent Owner Response in IPR2015-00266, filed on Jul. 14, 2015 (Paper No. 17).

Petitioners Objections to Evidence in IPR2015-00266, filed on Jul. 14, 2015 (Paper No. 18).

Motion to Excuse Late Filing in IPR2015-00266, filed on Jul. 16, 2015 (Paper No. 19).

Patent Owner Exhibit List in IPR2015-00266, filed on Jul. 16, 2015 (Paper No. 20).

Decision Motion to Seal in IPR2015-00266, filed on Jul. 17, 2015 (Paper No. 21).

Patent Owners Revised Motion to Seal in IPR2015-00266, filed on Jul. 20, 2015 (Paper No. 22).

Patent Owners Exhibit List in IPR2015-00266, filed on Jul. 20, 2015 (Paper No. 23).

Petitioner Opposition to Motion to Excuse Late Filing in IPR2015-00266, filed on Jul. 22, 2015 (Paper No. 24).

Order Conduct of the Proceeding in IPR2015-00266, filed on Jul. 23, 2015 (Paper No. 25).

Exhibit List—Patent Owner—Jul. 27, 2015 in IPR2015-00266, filed on Jul. 27, 2015 (Paper No. 27.

Motion to Expunge or in the Alternative to Seal in IPR2015-00266, filed on Jul. 28, 2015 (Paper No. 28).

Decision—Granting Motion to Excuse Late Filing in IPR2015-00266, filed on Jul. 29, 2015 (Paper No. 29).

Order—re Expunging Premature Supplemental Evidence in IPR2015-00266, filed on Jul. 30, 2015 (Paper No. 30).

Patent Owners Opposition to Petitioners Motion to Replace and Ex in IPR2015-00266, filed on Jul. 31, 2015 (Paper No. 31).

Exhibit List—Patent Owner's in IPR2015-00266, filed on Jul. 31, 2015 (Paper No. 32).

Decision—37 C.F.R. 42.14, 42.54 in IPR2015-00266, filed on Aug. 10, 2015 (Paper No. 33).

Petitioner Reply in IPR2015-00266, filed on Sep. 16, 2015 (Paper No. 34).

Petitioner Opposition to Motion to Amend in IPR2015-00266, filed on Sep. 16, 2015 (Paper No. 35).

Patent Owner Reply to Opposition to Motion to Amend in IPR2015-00266, filed on Oct. 9, 2015 (Paper No. 36).

Request for Oral Argument in IPR2015-00266, filed on Nov. 4, 2015 (Paper No. 37).

Patent Owners Request for Oral Argument in IPR2015-00266, filed on Nov. 4, 2015 (Paper No. 38).

Order Request for Oral Argument in IPR2015-00266, filed on Nov. 6, 2015 (Paper No. 39).

Patent Owner Exhibit List Dec. 08, 2015 in IPR2015-00266, filed on Dec. 8, 2015 (Paper No. 40).

Order—re Demonstratives in IPR2015-00266, filed on Dec. 10, 2015 (Paper No. 41).

(56) References Cited

OTHER PUBLICATIONS

Record of Oral Hearing in IPR2015-00266, filed on Mar. 9, 2016 (Paper No. 42).
Final Written Decision in IPR2015-00266, filed on Apr. 13, 2016 (Paper No. 43).
Declaration of Bernabe Gomez Jr. In IPR2015-00266, filed on Nov. 13, 2014 (Paper No. 52).
UL 48, Fourteenth Edition dated Feb. 29, 1996 (Paper No. 53).
Excerpts from Ford Deposition in IPR2015-00266, filed on Jul. 28, 2015 (Paper No. 58).
Excerpts from Kildow Deposition in IPR2015-00266, filed on Jul. 28, 2015 (Paper No. 59).
Target Beauty Universal Fixture redesign document in IPR2015-00266, filed on Sep. 16, 2015 (Paper No. 50).
Patent Owner email—Oct. 12, 2011 in IPR2015-00266, filed on Sep. 16, 2015 (Paper No. 61).
Patent Owner email—Oct. 14, 2011 in IPR2015-00266, filed on Sep. 16, 2015 (Paper No. 62).
Supplier Qualification Agreement in IPR2015-00266, filed on Sep. 16, 2015 (Paper No. 63).
Patent Owner email—Oct. 25, 2011 in IPR2015-00266, filed on Sep. 16, 2015 (Paper No. 64).
Patent Owner Presentation in IPR2015-00266, filed on Sep. 16, 2015 (Paper No. 65).
Complaint in IPR2015-00266, filed on Mar. 9, 2015 (Paper No. 66).
Declaration of Scott Katcher in IPR2015-00266, filed on Jul. 8, 2015 (Paper No. 70).
Awards to Eclipse in IPR2015-00266, filed on Jul. 8, 2015 (Paper No. 71).
Declaration of Alletto in IPR2015-00266, filed on Jul. 8, 2015 (Paper No. 72).
Bid in IPR2015-00266, filed on Jul. 8, 2015 (Paper No. 73).
Photo Target Display in IPR2015-00266, filed on Jul. 8, 2015 (Paper No. 74).
Photo Target Display in IPR2015-00266, filed on Jul. 8, 2015 (Paper No. 75).
Stipulated Protective Order in IPR2015-00266, filed on Jul. 8, 2015 (Paper No. 76).
Declaration Jerry Chang in IPR2015-00266, filed on Jul. 8, 2015 (Paper No. 77).
Deposition Verrangia in IPR2015-00266, filed on Jul. 8, 2015 (Paper No. 78).
Exhibit List in IPR2015-00266, filed on Jul. 8, 2015 (Paper No. 79).
Declaration of Christopher B. Garvey in IPR2015-00266, filed on Jul. 16, 2015 (Paper No. 80).
PRPS System Notification as to filing in IPR 2015-00266, filed on Jul. 16, 2015 (Paper No. 81).
PRPS System Notification as to filing in IPR 2015-00266, filed on Jul. 16, 2015 (Paper No. 82).
PRPS System Notification as to filing in IPR 2015-00266, filed on Jul. 16, 2015 (Paper No. 83).
PRPS System Notification as to filing in IPR 2015-00266, filed on Jul. 16, 2015 (Paper No. 84).
PRPS System Notification as to filing in IPR 2015-00266, filed on Jul. 16, 2015 (Paper No. 85).
PRPS System Notification as to filing in IPR 2015-00266, filed on Jul. 16, 2015 (Paper No. 86).
PRPS System Notification as to filing in IPR 2015-00266, filed on Jul. 16, 2015 (Paper No. 87).
Patent Owner's Jul. 29, 2015 Letter to Court Requesting Pre-Motion Conference in IPR2015-00266, filed on Jul. 31, 2015 (Paper No. 95).
Petitioner's Jul. 30, 2015 Letter Opposition to Request for Pre-Motion Conference in IPR2015-00266, filed on Jul. 31, 2015 (Paper No. 96).
Informal Figure 6 initially filed on Apr. 23, 2010 with U.S. Appl. No. 12/766,815 for Patent 8646935, Dec. 8, 2015 (Paper No. 97).
Exhibit 3001 in IPR2015-00266, filed on Apr. 28, 2015 (Paper No. 98).
Non-Final Office Action mailed on Dec. 10, 2012 for U.S. Appl. No. 12/766,815.
Response Filed on Jan. 10, 2013 to the Non-Final Office Action mailed on Dec. 10, 2012 for U.S. Appl. No. 12/766,815.
Non-Final Office Action mailed on Feb. 22, 2013 for U.S. Appl. No. 12/766,815.
Response Filed on May 22, 2013 to the Non-Final Office Action mailed on Feb. 22, 2013 for U.S. Appl. No. 12/766,815.
Final Office Action mailed on Jul. 2, 2013 for U.S. Appl. No. 12/766,815.
Response Filed on Sep. 23, 2013 to the Final Office Action mailed on Jul. 2, 2013 for U.S. Appl. No. 12/766,815.
Notice of Allowance mailed on Oct. 1, 2013 for U.S. Appl. No. 12/766,815.
Civil Action Case No. 14 CV 3639, Complaint against Product Miniature, Inc. and Moraine Plastics LLC, filed on May 21, 2014.
Civil Action Case No. 14 CV 3639, Answer to Complaint, Counterclaim against POP Displays USA LLC, filed on Jun. 19, 2014.
Civil Action Case No. 14 CV 3639, Answer to Counterclaim, filed on Jul. 11, 2014.
Civil Action Case No. 14 CV 3639, Amended Answer to Complaint with Jury Demand, Counterclaim against Pop Displays USA, LLC, filed on Oct. 6, 2014.
Civil Action Case No. 14 CV 3639, Letter Addressed to Judge Edgardo Ramos from Mark Grossman dated Feb. 13, 2015 re: Parties' Agreement to Stay Proceedings Pending Conclusion of Patent Office Proceedings, filed on Feb. 17, 2015.
Civil Action Case No. 14 CV 3639, Memo Endorsement on re: Parties' Agreement to Stay Proceedings Pending conclusion of Patent Office Proceedings filed by Pop Displays USA, LLC., filed on Feb. 17, 2015.
Civil Action Case No. 14 CV 3639, First Motion for Conference to Lift Stay for Limited Purpose of Resolving Dispute re Highly Confidential Designation of Transcripts and Documents (Attachments: #1, #2, #3, and #4), filed on Jul. 29, 2015.
Civil Action Case No. 14 CV 3639, Letter Addressed to Judge Edgardo Ramos from Michael Griggs dated Jul. 30, 2015, re: Plaintiffs Jul. 29, 2015 letter, filed on Jul. 30, 2015.
Civil Action Case No. 14 CV 3639, Order Granting Motion for Conference, filed on Jul. 30, 2015.
Civil Action Case No. 14 CV 3639, Transcript of Proceedings re:conference held on Aug. 26, 2015 before Judge Edgardo Ramos, filed on Sep. 15, 2015.
Civil Action Case No. 14 CV 3639, Notice of Filing of Official Transcript, filed on Sep. 15, 2015.
Civil Action Case No. 14 CV 3639, Notice of Stipulated Dismissal of All Claims and Counterclaims, filed on Jul. 1, 2016.
Civil Action Case No. 14 CV 3639, Notice of Stipulated Dismissal, filed on Jul. 5, 2016.
Civil Action Case No. 14 CV 3639, AO 120 Form Patent—Case Terminated—Submitted, filed on Jul. 5, 2016.
Civil Action Case No. 14 CV 3639, Civil Docket Sheet, dated Sep. 2, 2016.

* cited by examiner

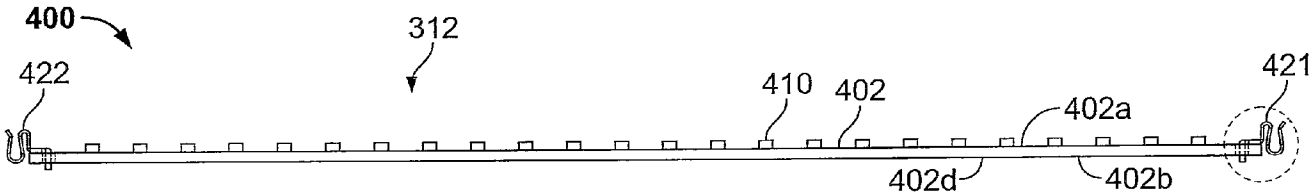
FIG. 41
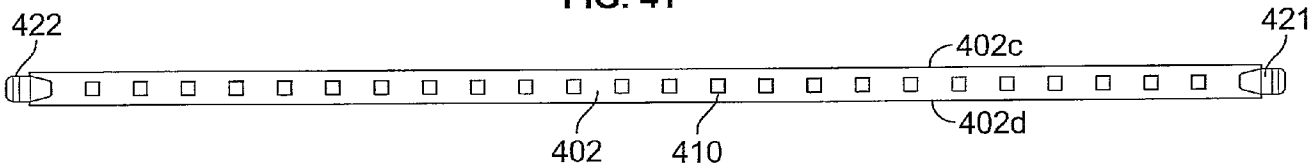
FIG. 42
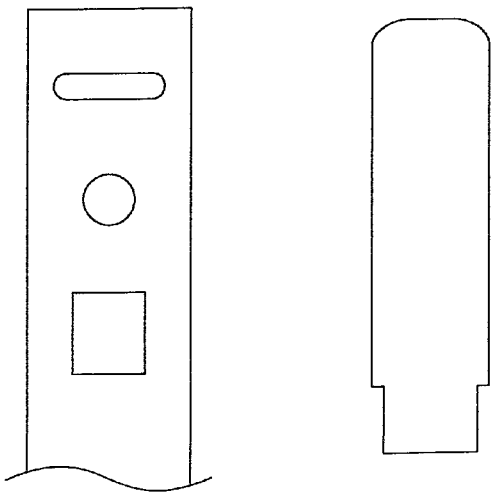
FIG. 44
FIG. 45
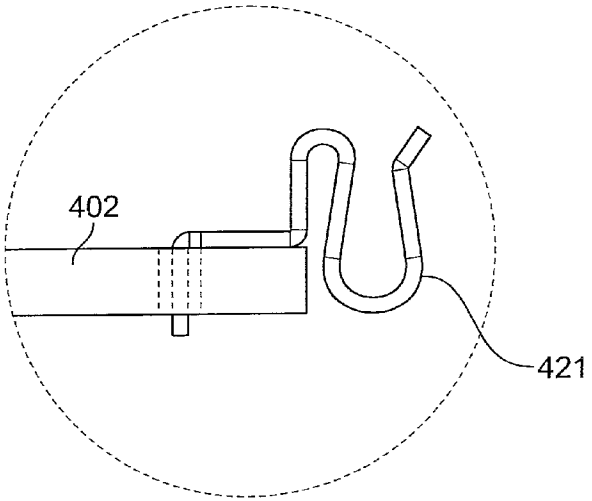
FIG. 43

DISPLAY ASSEMBLY SUPPORT WITH LOW VOLTAGE BUS

CROSS REFERENCE TO RELATED APPLICATIONS

This is a Divisional application of U.S. patent application Ser. No. 12/766,815, filed Apr. 23, 2010, pending and allowed, and takes priority from that application for all subject matter disclosed therein.

Ser. No. 12/766,815 is a Utility patent application, filed as a non-provisional of:

Provisional Application 61/172,100, filed Apr. 23, 2009, and

Ser. No. 12/766,815 took priority from that application;

and this application takes priority from 61/172,100 and Ser. No. 12/766,815;

for all subject matter disclosed therein.

We hereby incorporate by reference, all the disclosures of those applications, and of the informal CAD generated production drawings, used to originally file the:

61/172,100 Provisional; and

Ser. No. 12/766,815 Utility;

parent patent applications.

BACKGROUND OF INVENTION

Field of the Invention

The present invention relates to a retail store display assembly, for displaying, stocking, and dispensing merchandise.

BRIEF SUMMARY OF THE INVENTION

A retail display shelf system has a gondola. Several gondolas form vertical sections of a display assembly wall.

There are a pair of conductive standards which are cooperatively configured for supporting conductive shelf support brackets.

A circuit board has an array of light emitting diodes. The circuit board has, at each end, a connector. Each connector is adapted to connect electrically to its respective shelf support bracket, so that current travels from the 12 V DC power supply through the somewhat vertical standards through the shelf support brackets, through the circuit board, to power each of the LEDs, to illuminate local parts of the retail display shelf system.

Various display elements reflect or transmit the light.

An LED assembly emits light towards a mirrored reflector of an LED-holder-reflector 24. The selective shape of the mirrored reflector is carefully designed to reflect the light, to evenly back-light a bullnose.

BRIEF DESCRIPTION OF DRAWINGS

FIG. 10 is a front elevation thereof, showing plane A, through which

FIG. 12 is a similar side elevation in section through plane A, of FIG. 10.

FIG. 41 is a front elevation of an LED assembly.

FIG. 42 is a plan view thereof.

FIG. 43 is a detail of the area circle FIG. 41.

FIG. 44 shows spring negative clip flat piece of metal bent into its spring clip shape.

FIG. 45 spring positive clip similarly shaped.

DETAILED DESCRIPTION OF DRAWINGS

Figure 1:
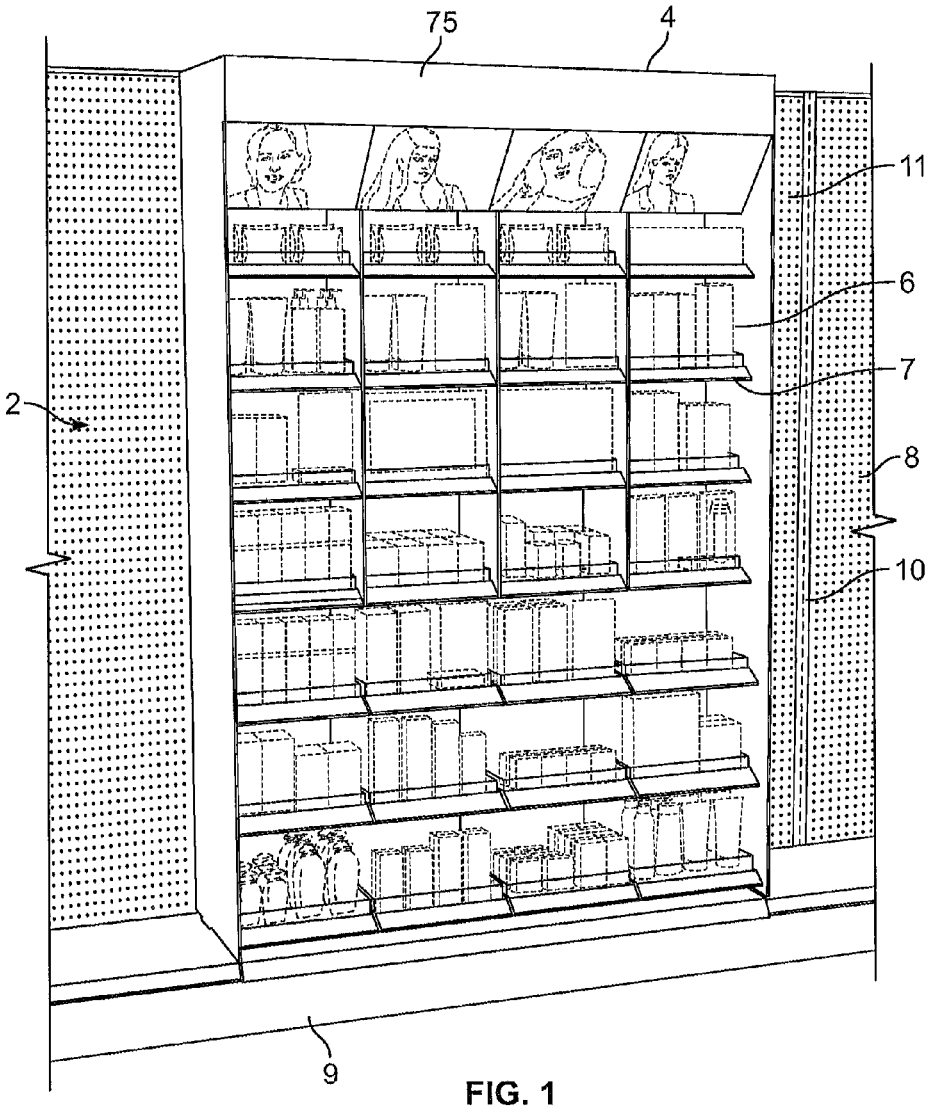
FIG. 1 is a front oblique perspective view of a display assembly wall up the present invention.

FIG. 1 shows a display assembly wall 2 of the present invention. Wall 2 comprises a plurality of vertical sections 4. Vertical sections 4 may be subdivided into a plurality of horizontal compartments 6, by shelf assembles 7.

Figure 1A:
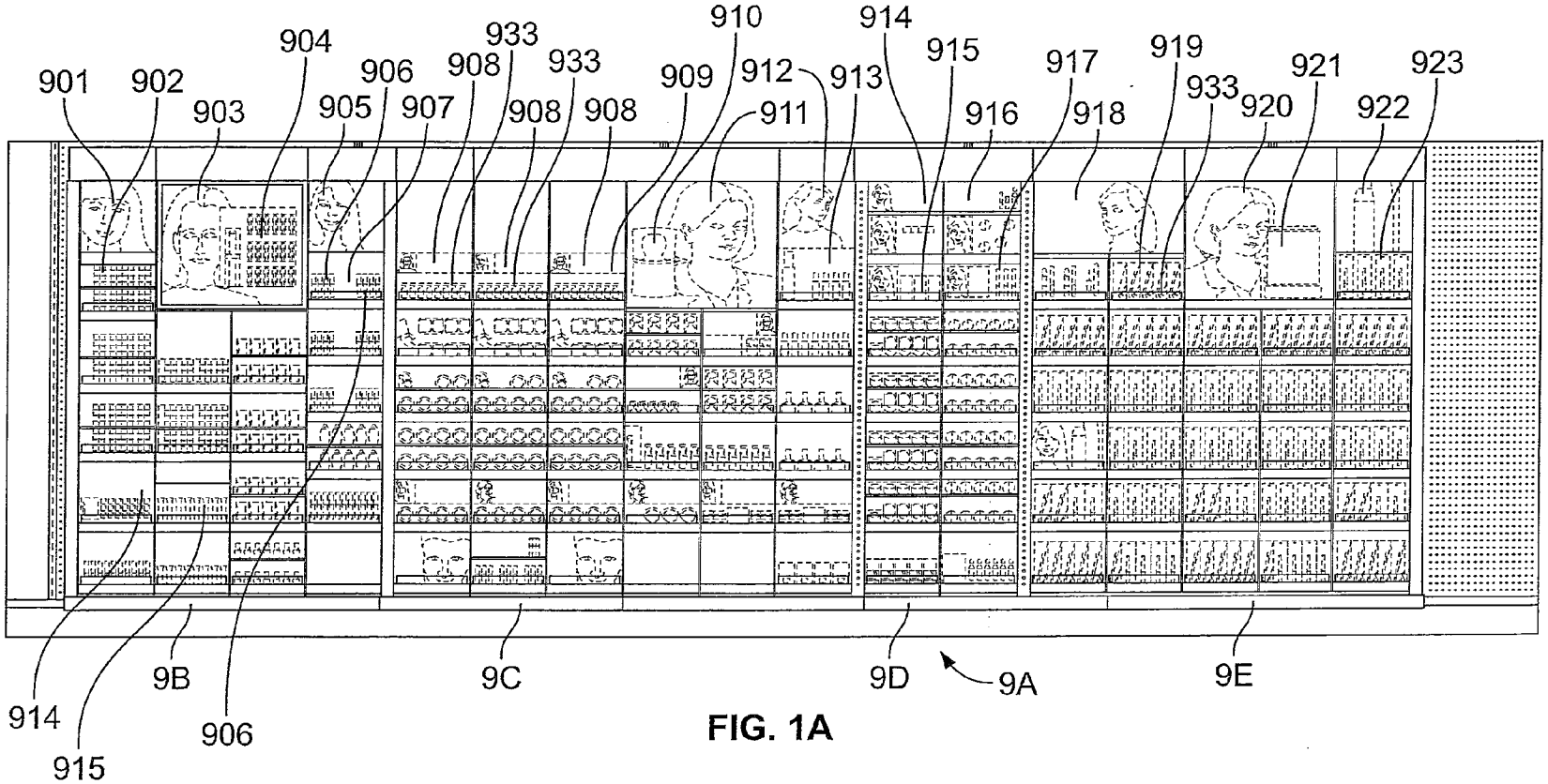
FIG. 1A is a front elevation of a plurality of segments similar to the display assembly wall of FIG. 1.

FIG. 1A is a front perspective view of an assembly 9A of four sections 9B-9E, as an embodiment appeared in October 2009. This view illustrates some of the lighting effects achieved by this system.

Also shown are openings in the graphics. Products associated with the graphics are appropriately and attractively displayed within or with the graphic. For example:

Graphic 901 is associated with color chart 902.

Graphic 903 frames a product display of lipstick on three shelves, offset in the viewer's right of graphic 903.

Portrait graphic 904 provides the upper part of the frame for nail polish display 906, which is divided in half by center graphic 907.

Three portrait graphics 908 provides the upper part of the frames three shelves of product displays 909.

Product model 910 protrudes toward the viewer from graphic 911.

P-shaped graphic 912 frames product shelf 913 on top and left sides.

So do P-shaped graphics 914 and 916 frame product shelves 915 & 917 on top and left sides.

Graphic 922 provides an upper frame for carded product 923 on display hooks.

Many of the products have shade strips 933 that identify a color associated with each package.

As in FIG. 1, vertical sections 4 are constructed and then hooked on to the gondola wall 8 of a gondola 9, not on the shelf rails 10 of gondola wall 8, but attached to the peg holes 11 of the wall 8 surface itself.

Figure 2:
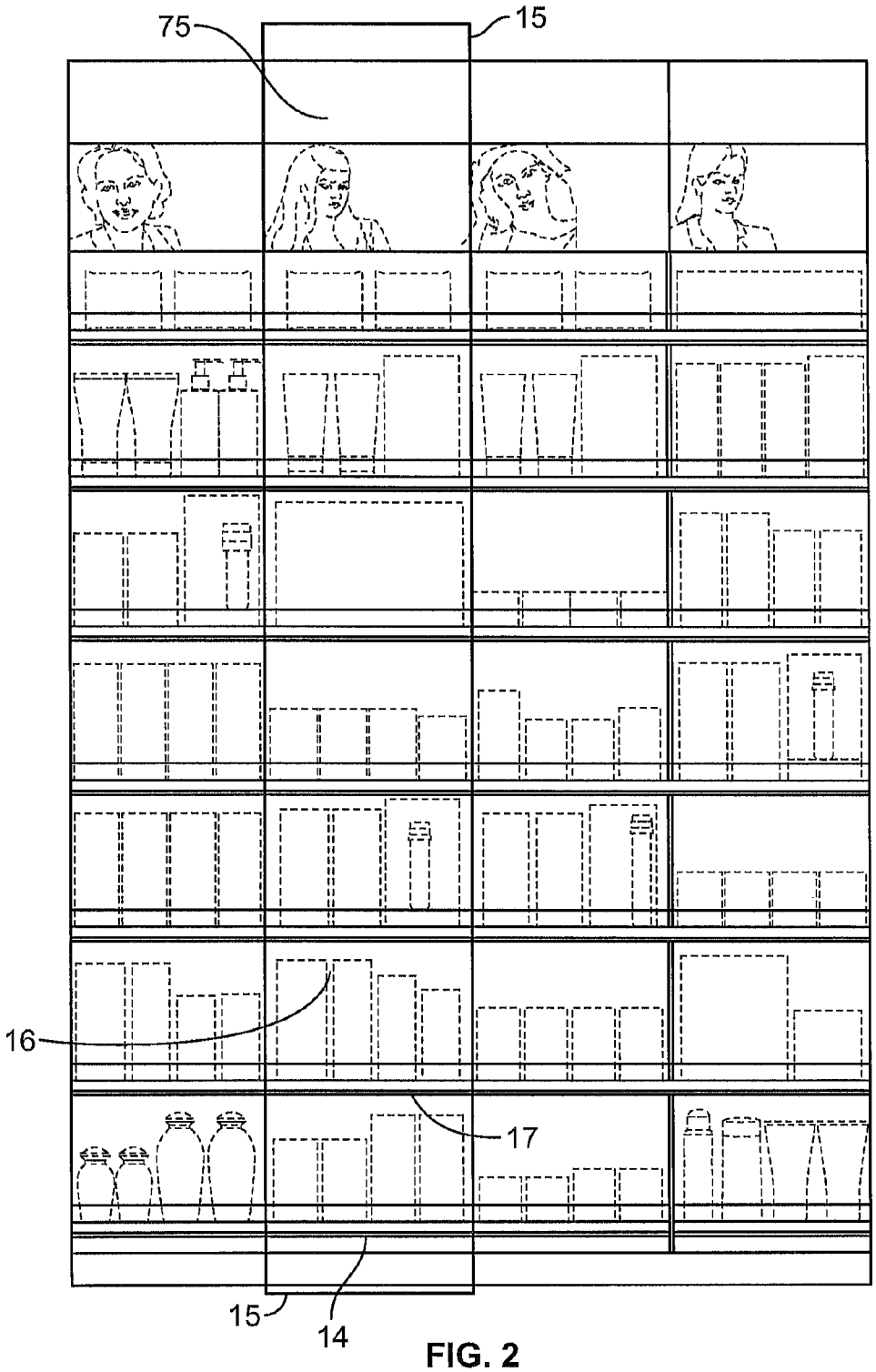
FIG. 2 is a front elevation of FIG. 1.

FIG. 2 is a front elevation of display assembly wall 2. A vertical section 14 is marked by outline 15.

Figure 3:
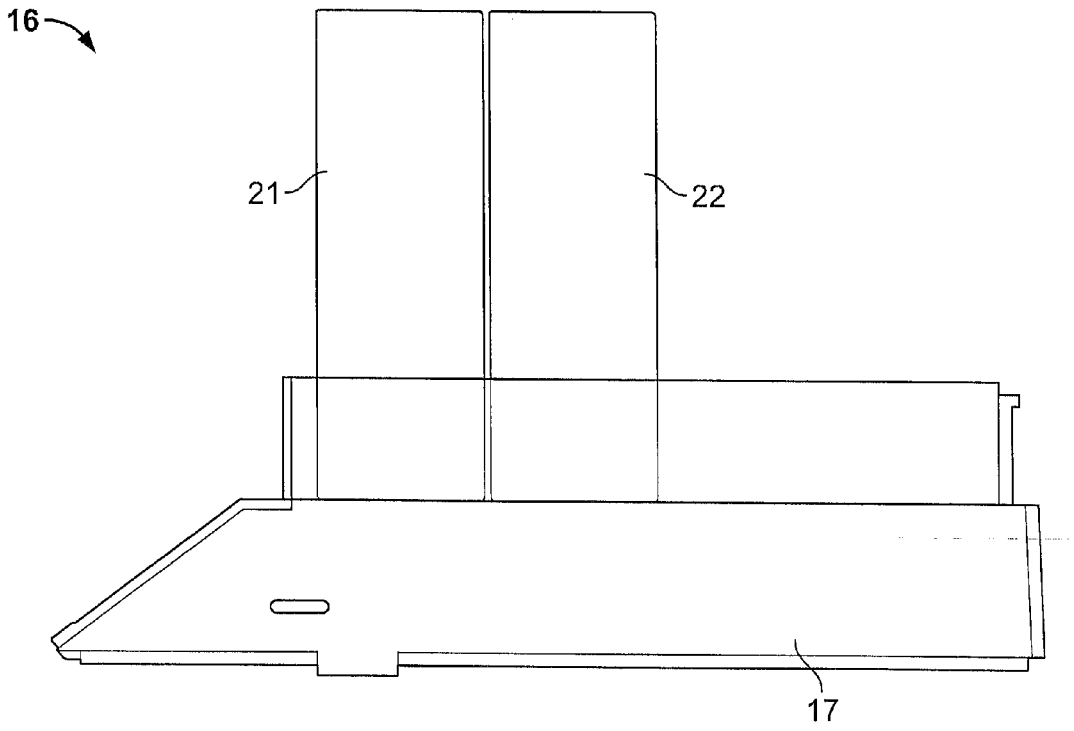
FIG. 3 is a side elevation of a shelf assembly for use in the display wall.
Figure 4:
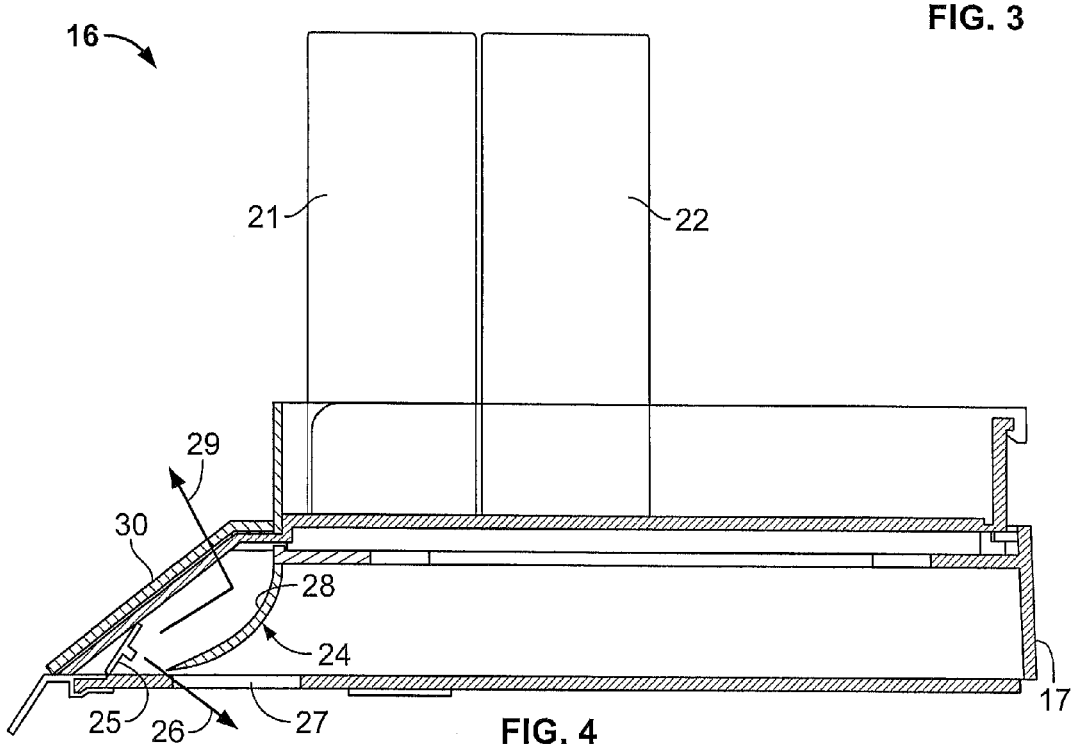
FIG. 4 is a similar side elevation in section.

Compartment 16 is defined by shelf assembly 17 shown in side elevation in FIG. 3 and in side elevation in section in FIG. 4. Product boxes 21-22 are shown atop shelf assembly 17.

FIG. 4 reveals shelf assembly 17 including a LED-holder-reflector 24, which holds LED assembly 25, which emits light, some of which is represented by ray 26. Ray 26 shines through opening 27, which may be an opening or a transparent or translucent panel. Ray 26 illuminates the contents of the shelf below shelf 17, or a graphic panel that occupies that compartment. Some of the LED light and some reflected light shines through clear bullnose 30 to illuminate the area above bullnose 30.

LED assembly 25 emits light, some of which is represented by ray 29, towards mirrored reflector 28 of LED-holder-reflector 24. The selective shape of the mirrored reflector 28 is represented in this FIG. 4, and is more closely shown in FIGS. 13-14, and is carefully designed and selectively shaped as shown, to reflect the light represented by ray 29 FIG. 4, so as to evenly back-light bullnose 30. Graphic 30B slides between bullnose 30 and inner wall 30A.

Figure 5:
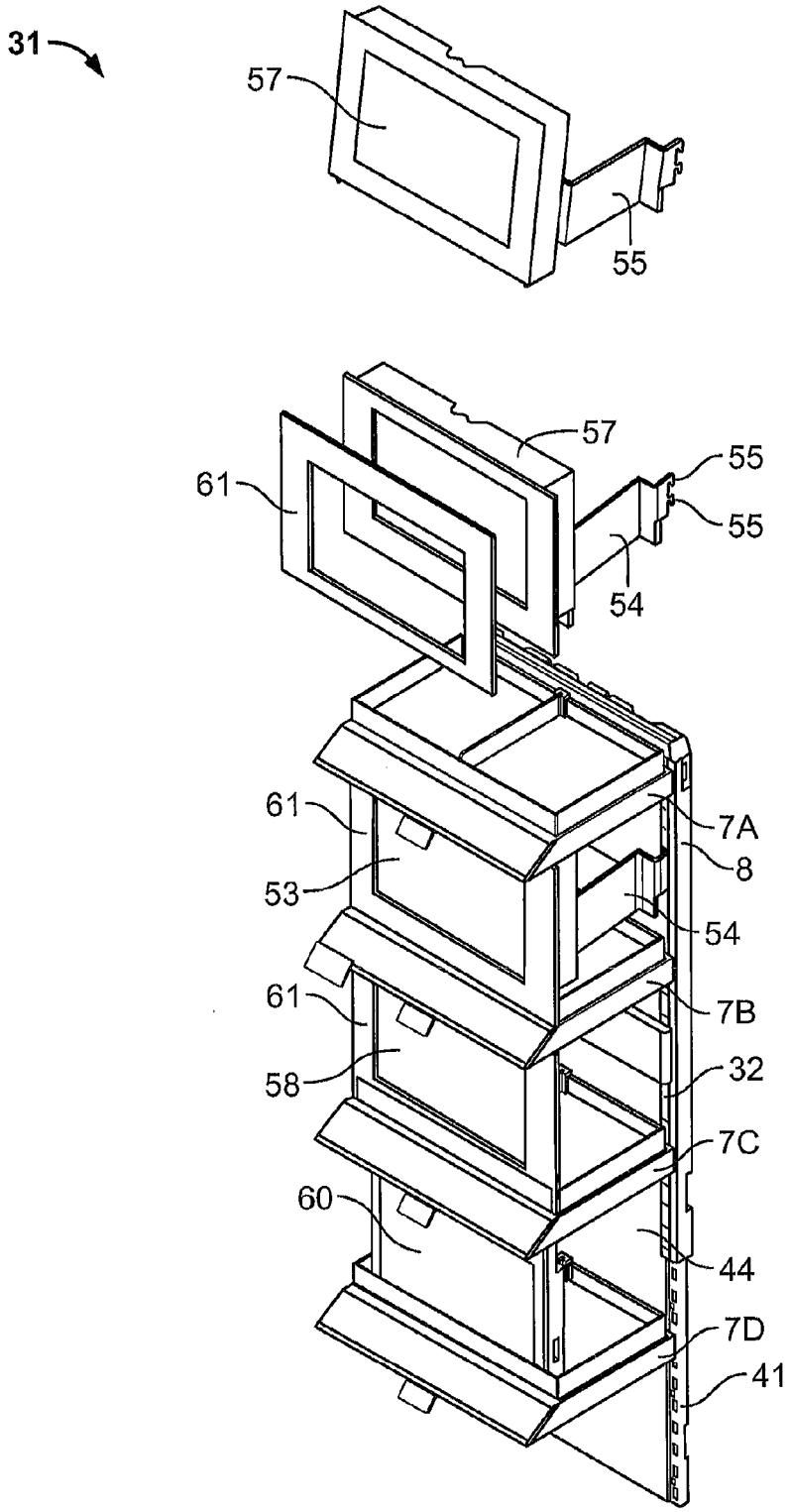
FIG. 5 is an oblique view of a plurality of shelf assemblies.

FIG. 5 shows a plurality of shelf assemblies 7A-7D. Each shelf assembly 7 hangs to a grid assembly 31 by hooks onto slots such as 32 in shelf standards 41, 45.

Figure 6:
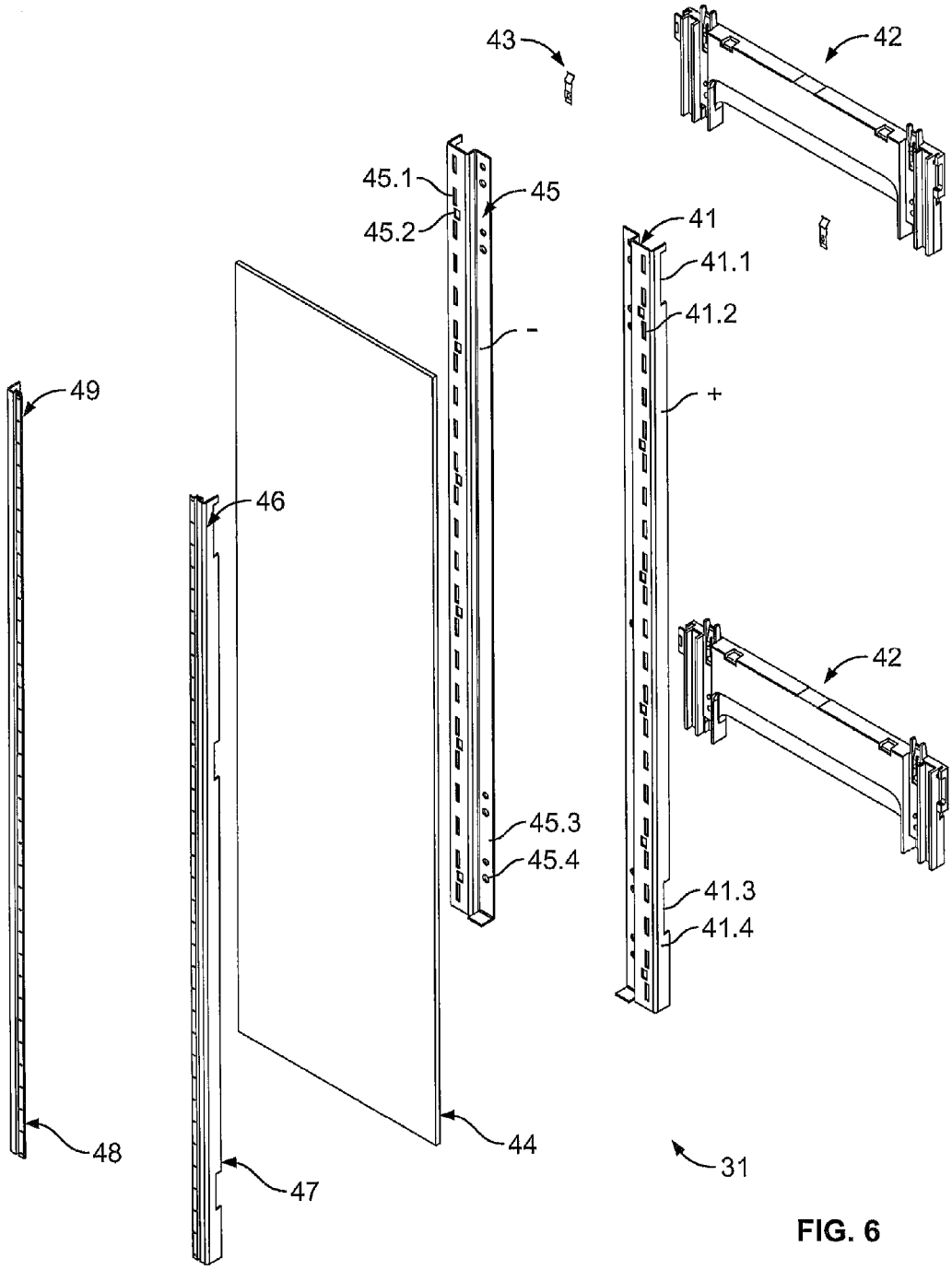
FIG. 6 is loaded view of a grid assembly providing vertical elements for mounting shelves

FIG. 6 is an exploded view of grid assembly 31. A pair of horizontals 42, insulated by being made of ABS plastic, clip together shelf standards 41, 45, and each horizontal 42 is pop-riveted by two pop-rivets to an end of standards 41 & 45 through two corresponding rivet holes 41.1-41.4 & 45.1-45.4 at the top 41.1-2 45.1-2 and bottom 41.3-4 & 45.3-4 of standards 41 & 45. Back panel 44 is removably sandwiched in two slots formed between shelf standards 41, 45 and rail covers 46-49.

Standards 41 and 45 are preferably a conductive material such as galvanized 18 ga crs (cold rolled steel). Horizontal spacers 42 and are cooperatively shaped to the standards to fit, and to join and space standards 41 and 45, and to back support back panel 44.

Contact clips 43 are wired to a power supply above or below the display, depending on the store's outlet location. These clips are clipped to standards 41 and 45 to energize them with low voltage power, preferably 12 VDC power. Right standard 41 is the positive voltage and left standard 45 is the negative voltage.

Standard covers 47 and 48 capture and retain back panel 44 when standard covers 47 and 48 have been snapped onto standards 41 & 45 and further secured by spacers 42. Knife brackets are attached to the standards.

Products may be displayed on the shelves 7, but FIG. 5 shows various forms of graphic panels that may occupy spaces not used for product. Below shelf 7A is a liquid crystal display, or alternatively a light emitting diode graphic display assembly 53. These can optionally be touch screens for interaction with the customers. Graphic display assembly 53 is supported by its own brackets 54, which hang on hooks 55 in the slots 32 of standards 41, 45.

Panel 58 is a passive graphics panel, a non-electronic flat picture, that sits on shelf 7*c*.

Panel 60 is another interactive graphics panel.

Frames 61 cooperate to help mount displays between shelves such as 7A-7B and 7B-7C.

Figure 5A:
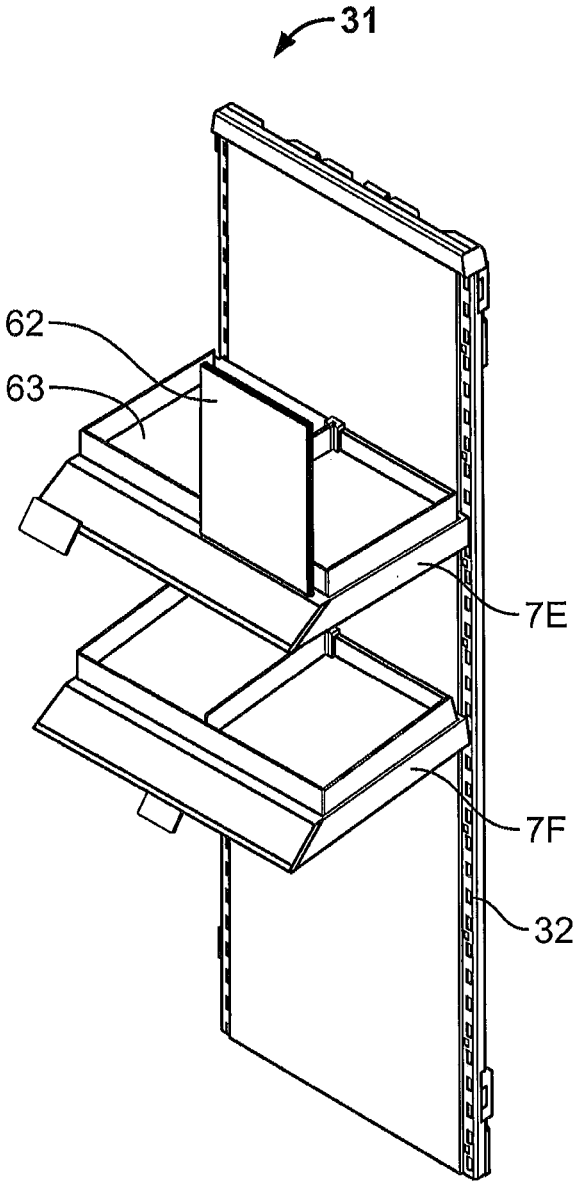
FIG. 5A is a similar oblique view of alternative embodiments of shelf assemblies

FIG. 5A is a grid 31 that shows shelf assemblies 7E-7F. 7F is set-up to hold product. 7E mounts a picture panel 62 for a fixed image, next to an area 63 that has been set-up to contain some products.

Figure 7:
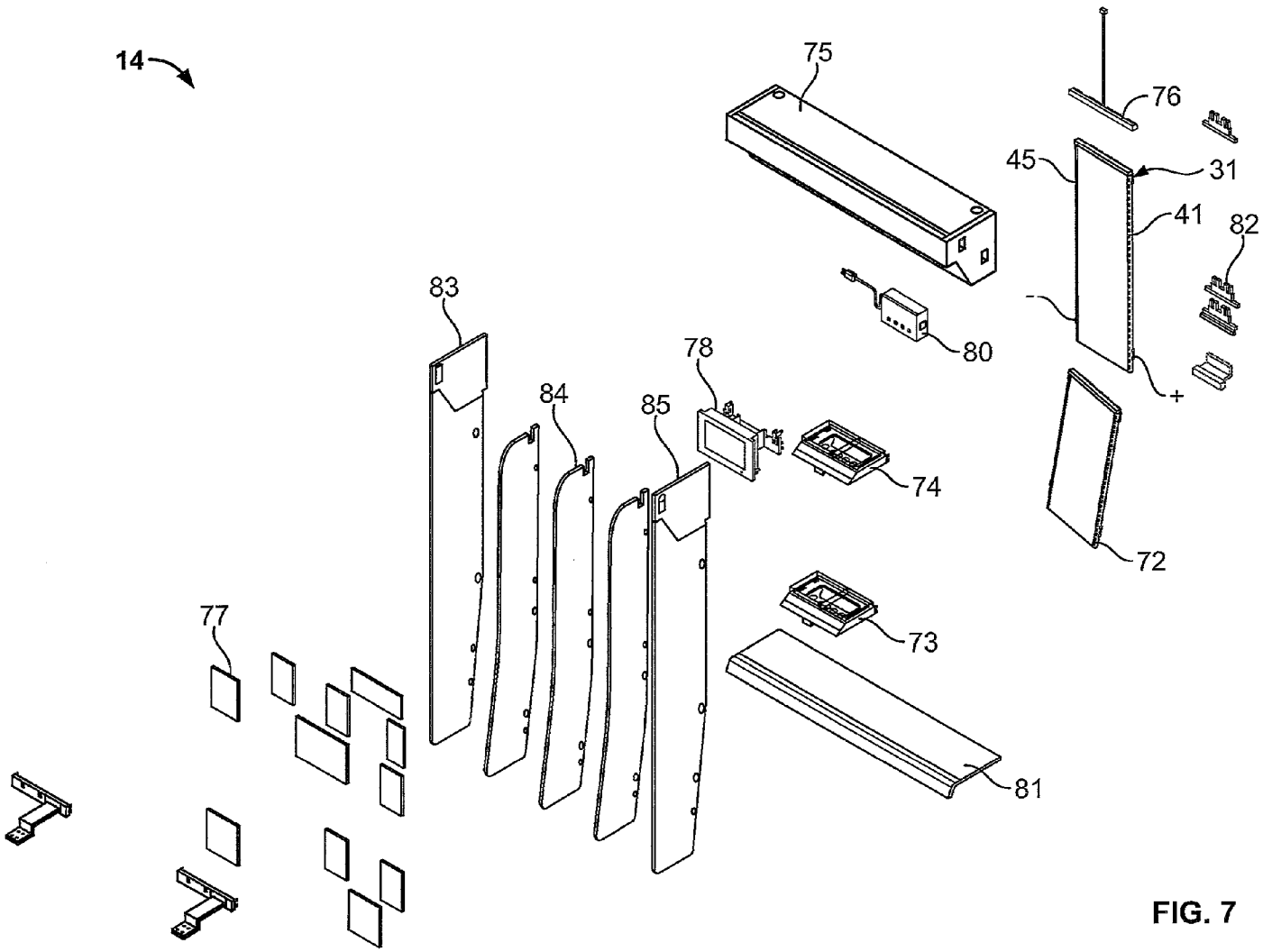
FIG. 7 is an exploded oblique view of a vertical part of the display wall.

FIG. 7 is an exploded view of a vertical section 14 is marked by outline 15 of FIG. 2. 3 ft. grid assembly 31 is positioned above similar 2 ft. grid assembly 72, which may be angled as in this case. Tray assembly angled 17A (FIG. 14) would mount to angled grid 72 of FIG. 7. Tray assembly straight 17S (FIG. 13) would mount to vertical 3 ft. grid assembly 31 of FIG. 7. FIGS. 7 & 16-20 & 26 show header assembly 75, which mounts by hooks 133 (FIGS. 18-20 & 26) to the holes such as 11 (FIG. 1) of gondola's 9 peg board 8 above FIG. 7's grid 31. Header assembly 75 is in FIGS. 1-2, 7 16-26. FIG. 7 shows feeder assembly 76, which feeds 12 VDC power from the power supply assembly 80 to shelf standards 41, 45. Graphic panels 77 may be placed anywhere on the assembly 2. Power supply assembly 80 is mounted within the header, and powers the header's lights, and powers feeder assembly 76.

Kicker assembly 81 is a vinyl magnet that is easily magnetically attached over the aging steel bottom shelf of an old gondola, to give a fresh clean appearance to the bottom of the display.

Hang bracket 82 holds horizontal 42 (FIG. 6) of grid assemblies 31 & 72 to hang them from the peg holes 11 of gondola wall 8 (FIG. 1).

FIG. 7 shows end fin assembly 83, dividers 84, and mirror end fin assembly 85.

FIGS. 8-14 are closer details of an embodiment of carrier tray assembly 17. Tray assembly 17 may be configured in various ways to accommodate different products and graphics.

Figure 8:
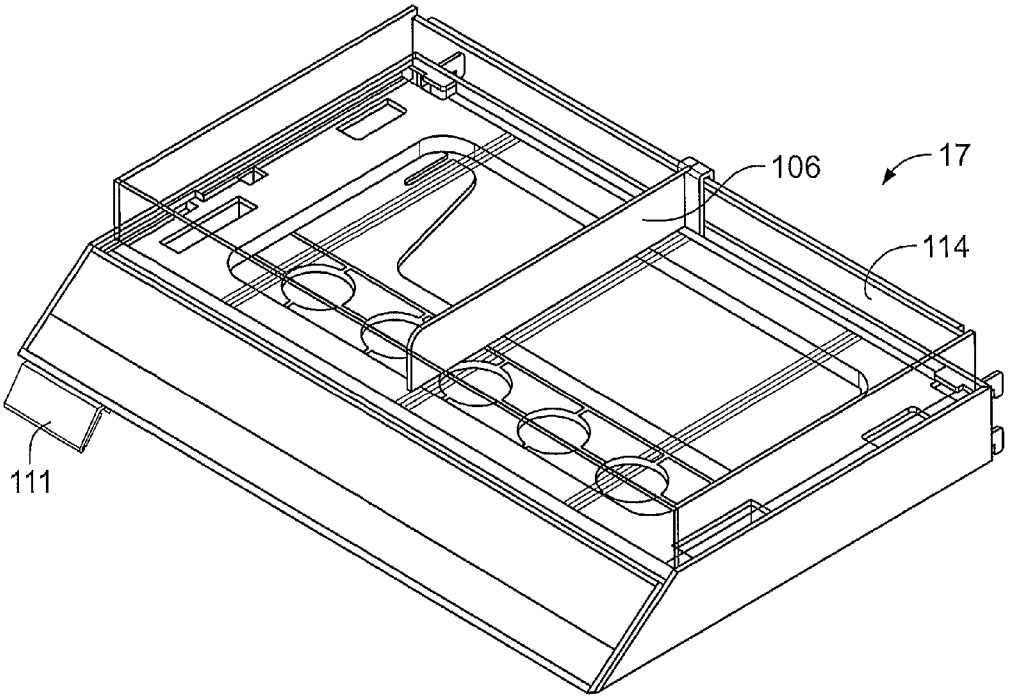
FIG. 8 is an oblique view of alternative embodiment of the tray assembly.

FIG. 8 is an oblique view showing carrier tray assembly 17, center divider 106, and back fence 114.

Figure 9:
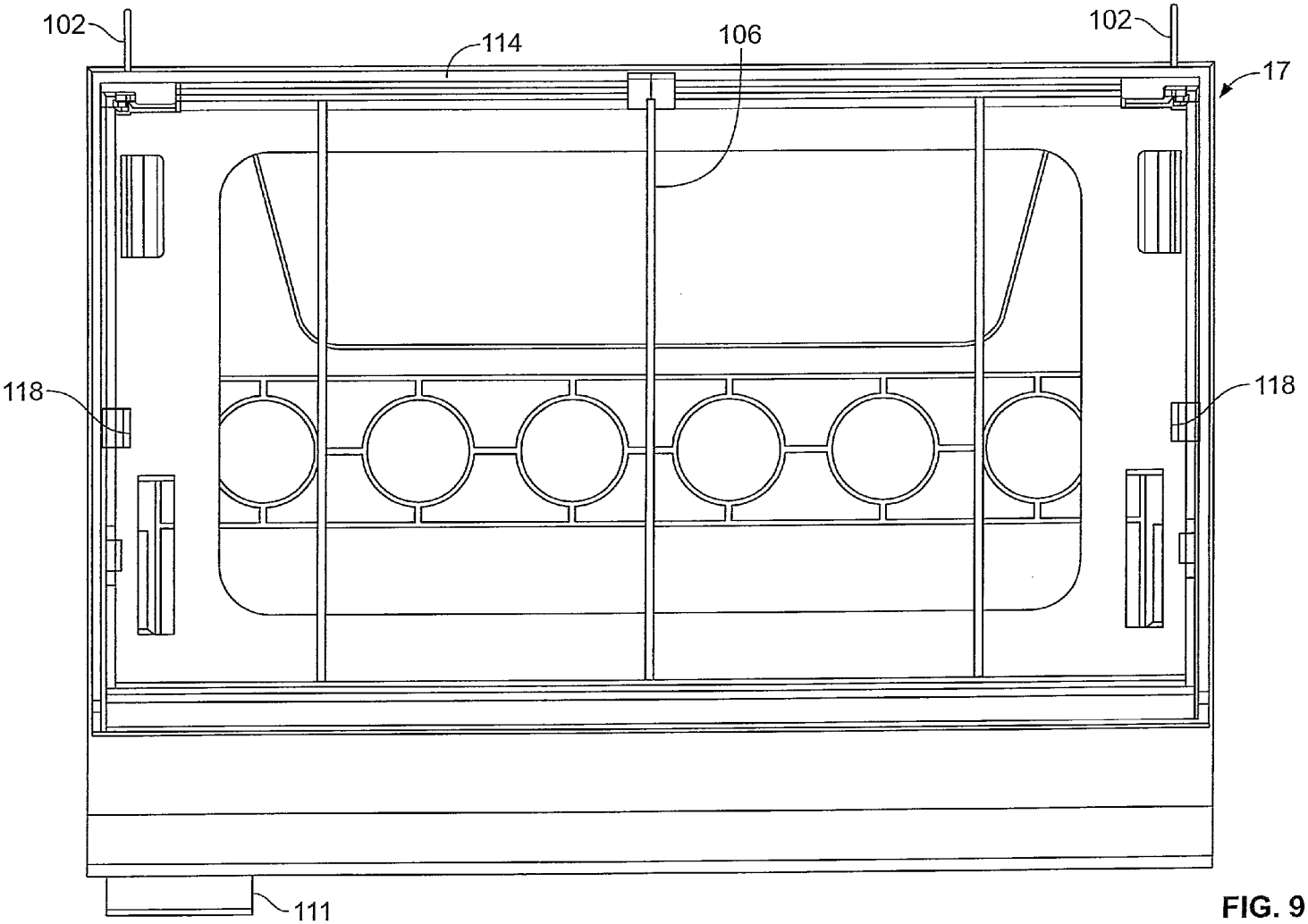
FIG. 9 is a plan view thereof.

FIG. 9 is a top plan view showing carrier tray assembly 17. Center divider 106 and back fence 106 are shown. Tabs 118 are shown for retaining knife brackets 102 by snapping into a slot on a bottom surface of the knife bracket.

Figure 10:
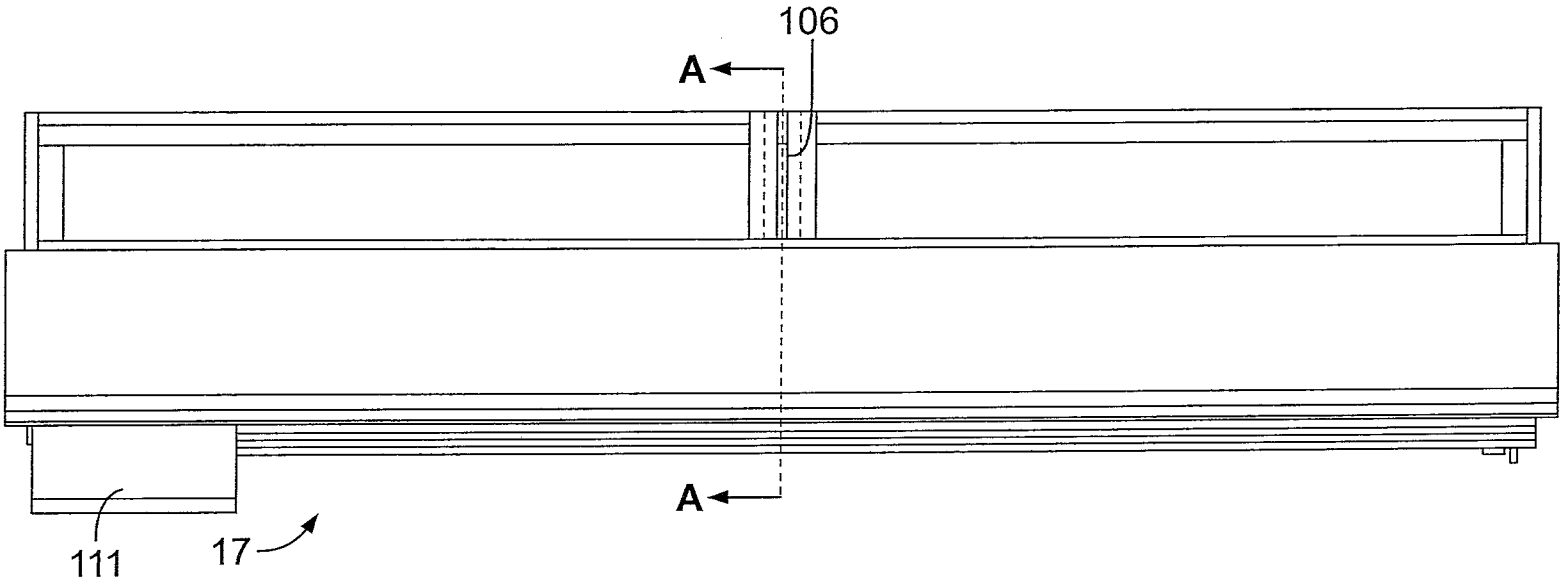
Figure 12:
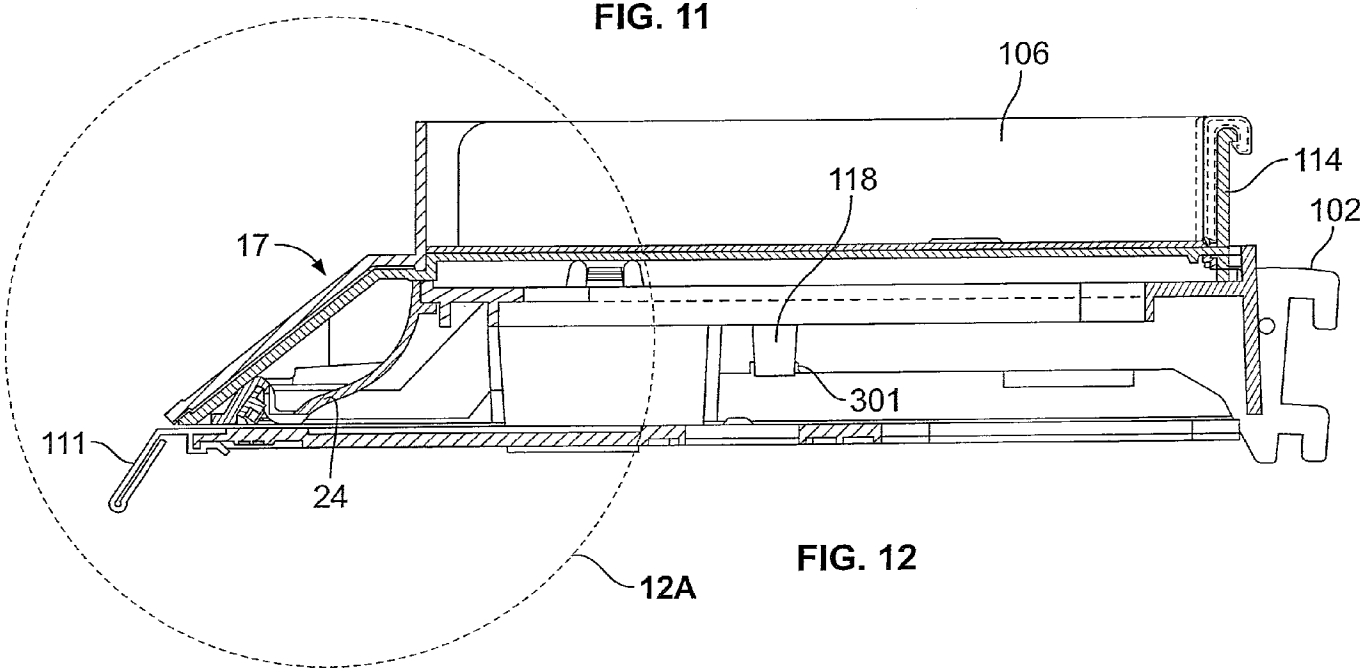
FIG. 12 is sectioned.

FIG. 10 is a front elevation of carrier tray assembly 17, showing plane A, through which FIG. 12 is sectioned.

Figure 11:
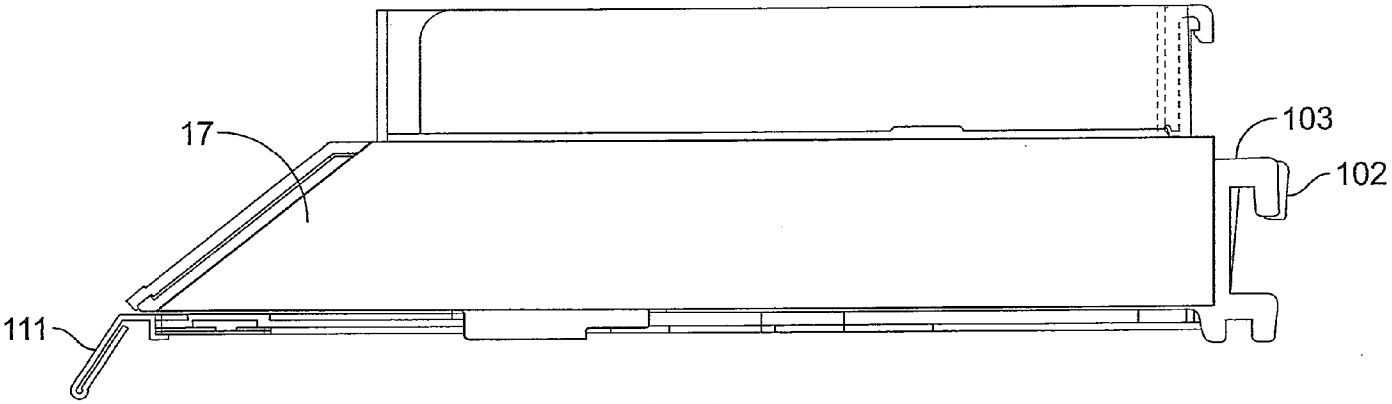
FIG. 11 is a side elevation thereof.

FIG. 11 is a side elevation of a carrier tray assembly 17, showing alternative knife brackets: angled 102 and straight 103.

FIG. 12 is an elevation sectioned through section A of FIG. 10, and shows LED-holder-reflector 24, and angled knife bracket 102. Tab 118 is shown snapped into detent 301 on knife bracket 102, to hold the bracket 102 to the carrier tray 101.

Figure 12A:
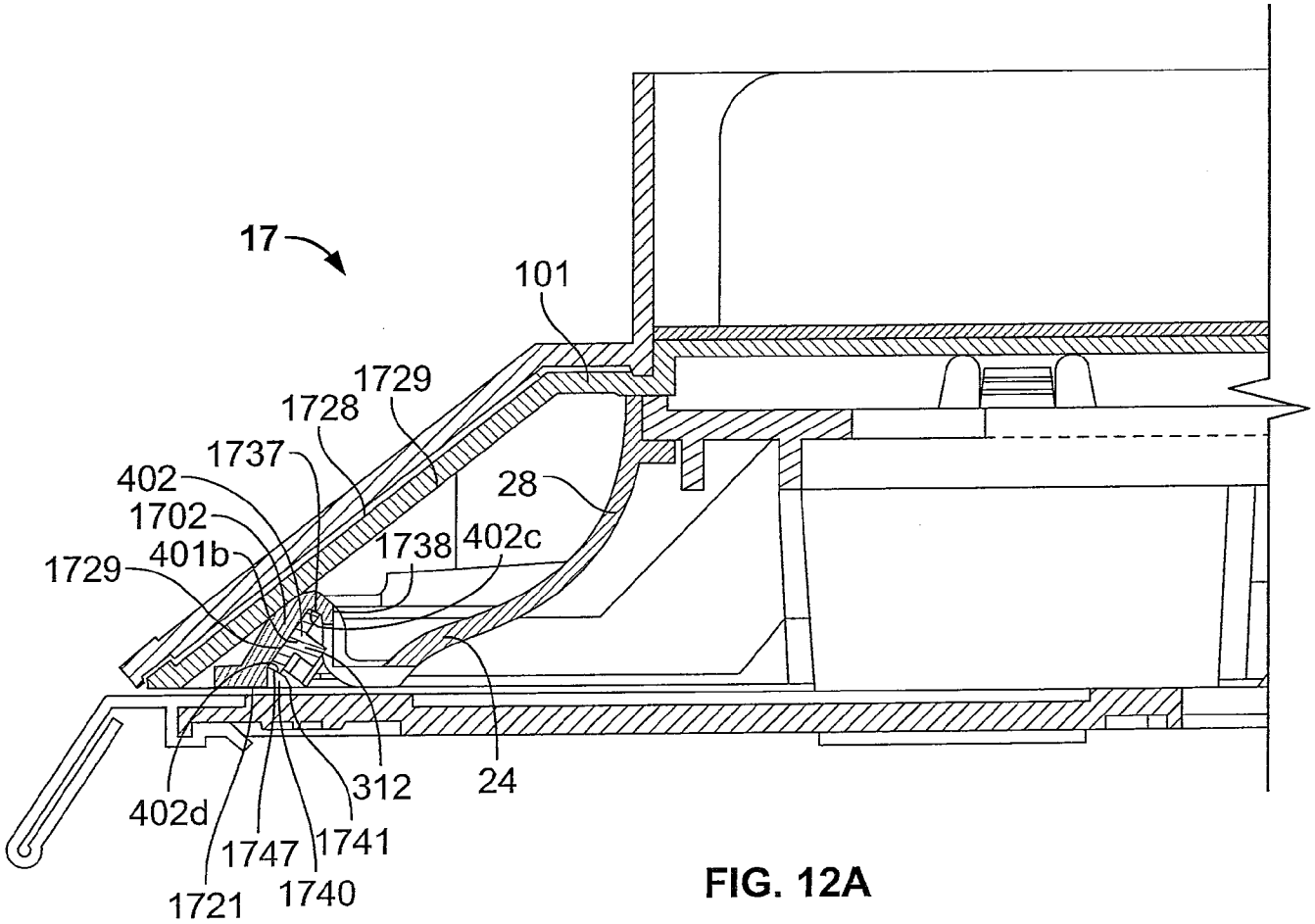
FIG. 12A is a detail of area A in FIG. 12.

FIG. 12A is a detail of area A in FIG. 12.

Carrier tray 101 is a molded plastic tray, to which other parts are attached. A bottom surface 1721 circuit board holder 1702 is shown in section abutting inclined wall 1727 also shown in section, and having a front surface 1728 and a back surface 1729.

Circuit board holder 1702 has an inner flat surface 1729, a top notch 1737, and a lip 1737. Extending from bottom surface 1721 are a plurality of tabs 1740 having a ramped surface 1741 curving to a flat surface 1747.

To install LED strip 402 (shown in detail in FIGS. 41-45), an edge such as 402*c* (FIG. 41) is placed against vertical wall notch 1737 (FIG. 12A), and the opposite edge, such as 402*d*, is rotated clockwise down towards retaining tabs 1740. A plurality of these tabs 1740 are provided across circuit board holder 1702.

As edge 402*d* contacts inclined surface 1741, edge 402*d* wedges tab 1740 down, allowing edge 402*d* to press fit against flat surface 1747, whereupon tab 1740 returns up and captures board 402 with edge 402*d* held by flat surface 1747. Board 402's flat surface 402*b* then abuts Circuit board holder 1702's inner surface 1729.

Circuit board holder 1702 retains circuit board edge 402*c* in top notch 1737, retained by lip 1737.

Figure 13:
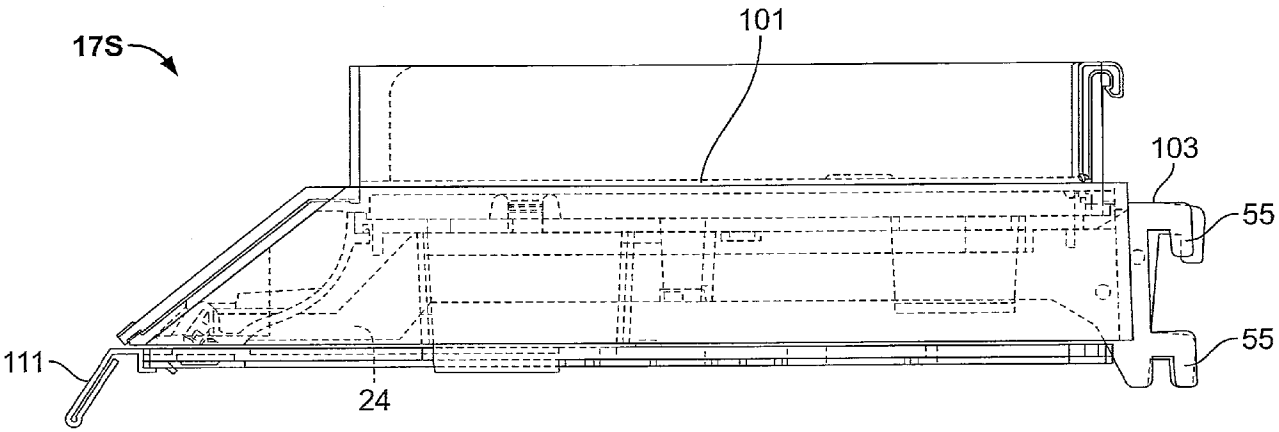
FIG. 13 is a side elevation showing hidden details in dotted lines.

FIG. 13 shows a carrier tray 101, straight knife bracket 103, which supports the carrier tray 101, and bracket hooks 55. Internal details are shown hidden in dotted lines.

Figure 14:
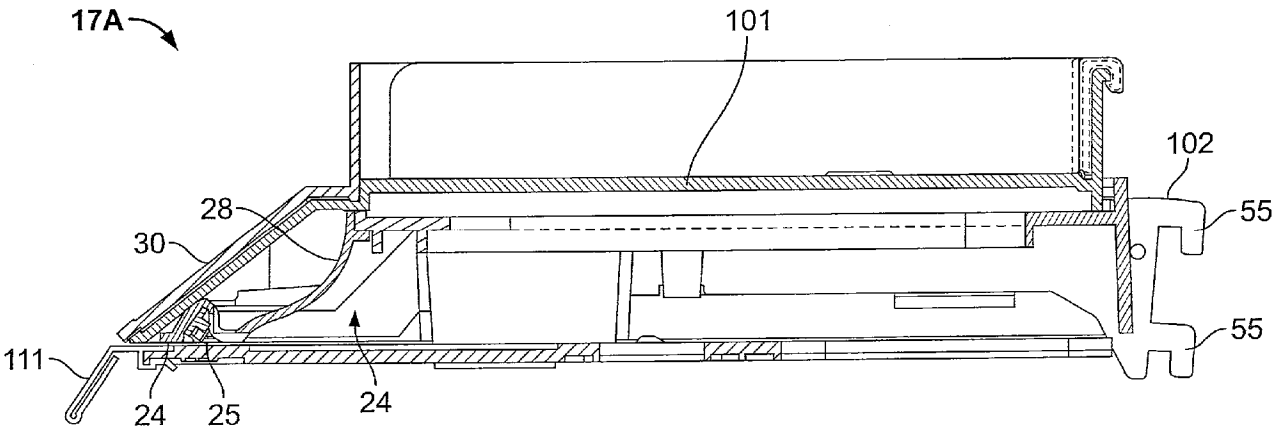
FIG. 14 is a similar side elevation section.

FIG. 14 similarly shows a carrier tray 101 in section, angled knife bracket 103, which supports the carrier tray 101, and bracket hooks 55. Tab 118 cooperates with notch 301 in knife bracket 102 to retain the knife bracket 102 in carrier tray 101.

Figure 15:
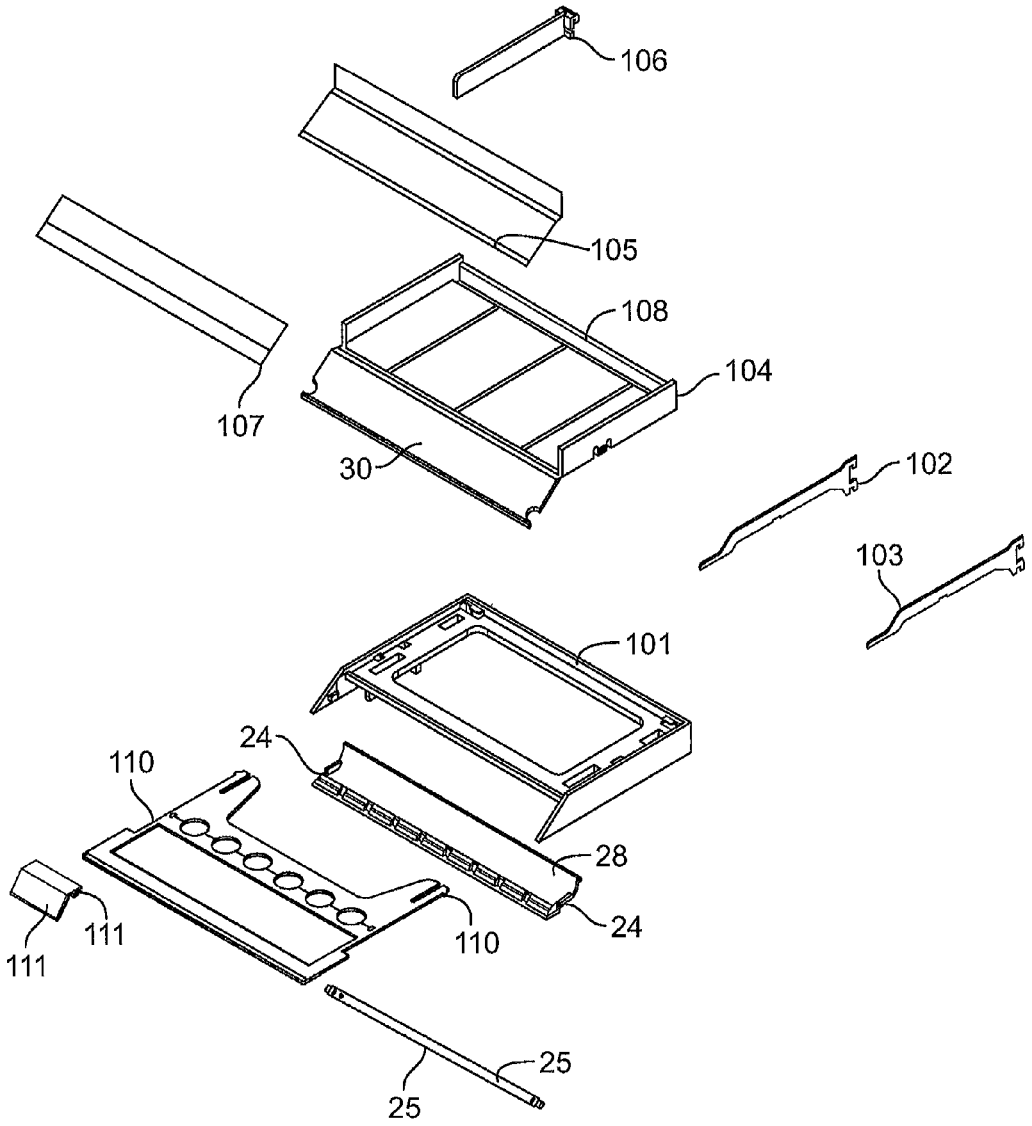
FIG. 15 is an exploded view thereof.

FIG. 15 shows the tray assembly 17 exploded into its individual parts.

These include reflector/LED holder 24, reflector 28, carrier tray 101, knife brackets 102-103, insert tray 104, tray front graphic holder 105, divider 106, graphic 107, upc slide 110, pricer extrusion 111.

Carrier tray 101 is mounted on two of either:

angled knife bracket 102, of 18 gauge zinc-plated cold-rolled steel, as in FIG. 14, for mounting on an angled grid; or straight knife bracket 103, of similar steel, as in FIG. 13 for mounting on a vertical grid.

We presently prefer zinc plated steel, for which we use below the abbreviation "crs" for cold rolled steel.

Where 12 VDC will be conducted through the parts, the zinc plating should be left unpainted, to assure electrical contact across and between the parts. But we also contemplate using nickel, chrome, gold, or any other conductive plating. Thus on standards 41 & 45, and knife brackets 102-103, the zinc plating should be left unpainted.

Where conductivity is not required, any anti-rust or decorative plating, anodizing, and or paint may be used, although it is not in the presently preferred embodiment.

FIG. 15 shows insert tray 104, which snaps on to carrier tray 101. Tray front graphic holder 105 is sonically welded to insert tray 104 to form a graphic slot, into which graphic 107 may be inserted to label the tray for the customer. Divider 106 snaps onto the back-wall 114 of carrier tray 104.

LED assembly 25 snaps into LED-holder-reflector 24 (FIGS. 15, 14, 13, 4). The selective shape of the reflector 28 and its spacing to LED assembly 25 is clearly shown in FIGS. 14 & 13 and the novel shape and spacing are carefully designed so as to evenly back-light bullnose 30.

UPC slide 110 (UPC is Universal Product Code) provides a place to label where each stock item is to be placed on the various shelves. A stockman can pull out UPC slide 110, observe the labels stuck to slide 110, place the appropriate products there-behind and there-above on the shelf assembly 17, and then slide UPC slide 110 back in, hidden under carrier tray 101. Pricer extrusion 111 provides a handle to open UPC slide 110.

As in FIG. 7, power is distributed throughout each vertical 14 in a novel fashion. Power supply 80 converts 100 Volts AC to low voltage suitable to power LEDs, preferably 12 volts DC. Feeder assembly 76 plugs into power assembly 80 to distribute the low voltage to standards 41 (negative) & 45 (positive) of FIG. 6, which standards 41 & 45 are electrically isolated from each other, to conduct the two polarities of low voltage DC. Each knife bracket 102-103 conducts the polarity of its side, from standard 41+ or 45−, to LED assembly 25. So long as polarity consistency is established, the LED assembly 25 will always function on any vertical. Our standard polarity is positive on the right, when viewed from the front, and negative on the left.

Figure 16:
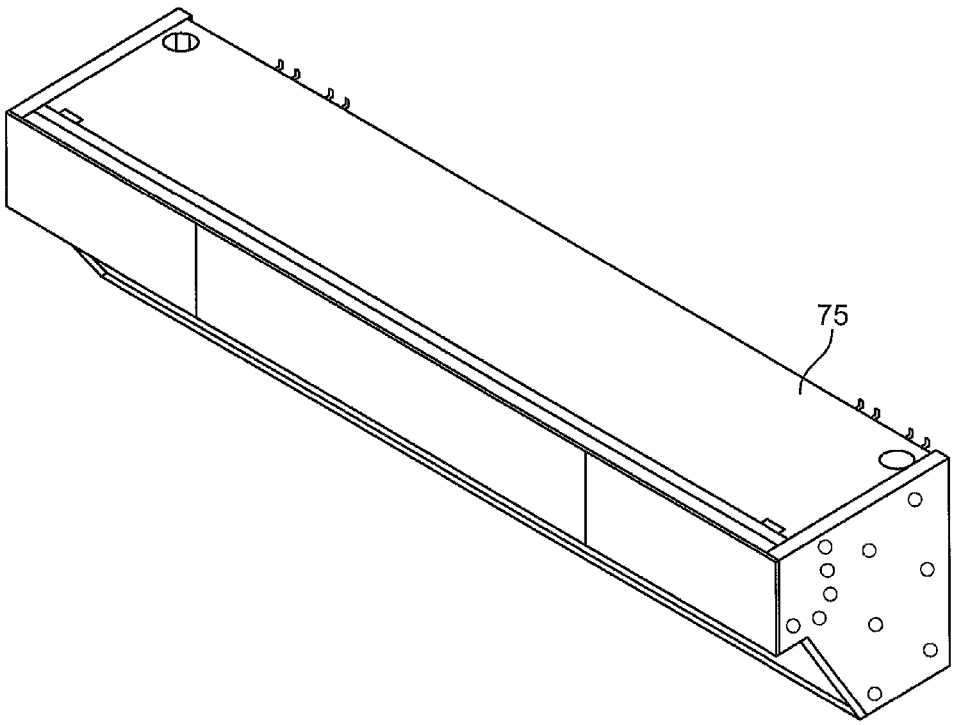
FIG. 16 is an oblique view of a header assembly.

FIG. 16 is a perspective view of header assembly 75.

Figure 17:
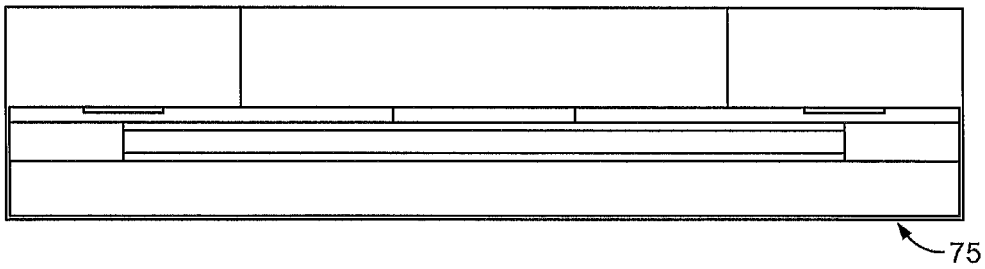
FIG. 17 is a front elevation thereof.
Figure 18:
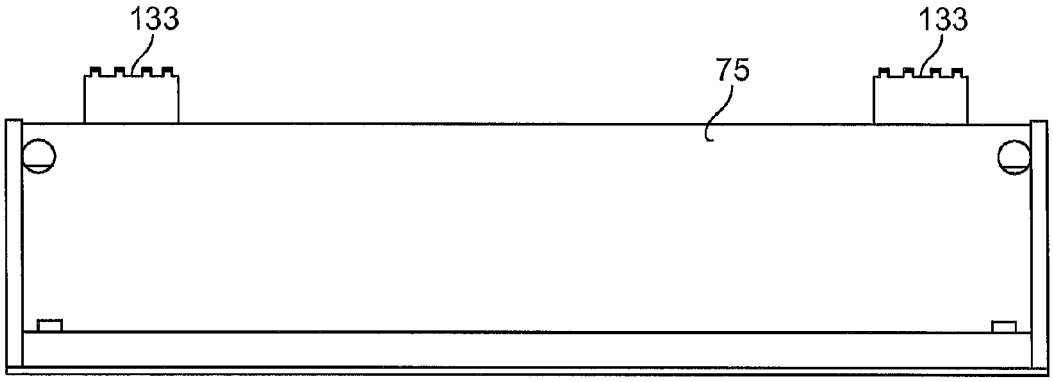
FIG. 18 is a plan view thereof.
Figure 19:
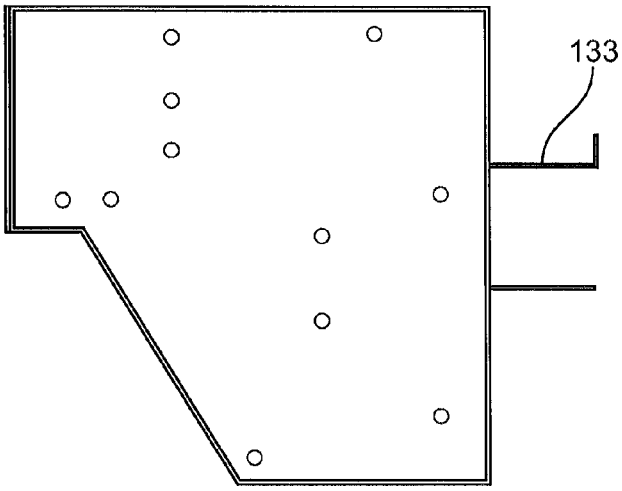
FIG. 19 is a side elevation thereof.

FIG. 17 is a front elevation thereof and FIG. 18 is a top plan view.

Figure 20:
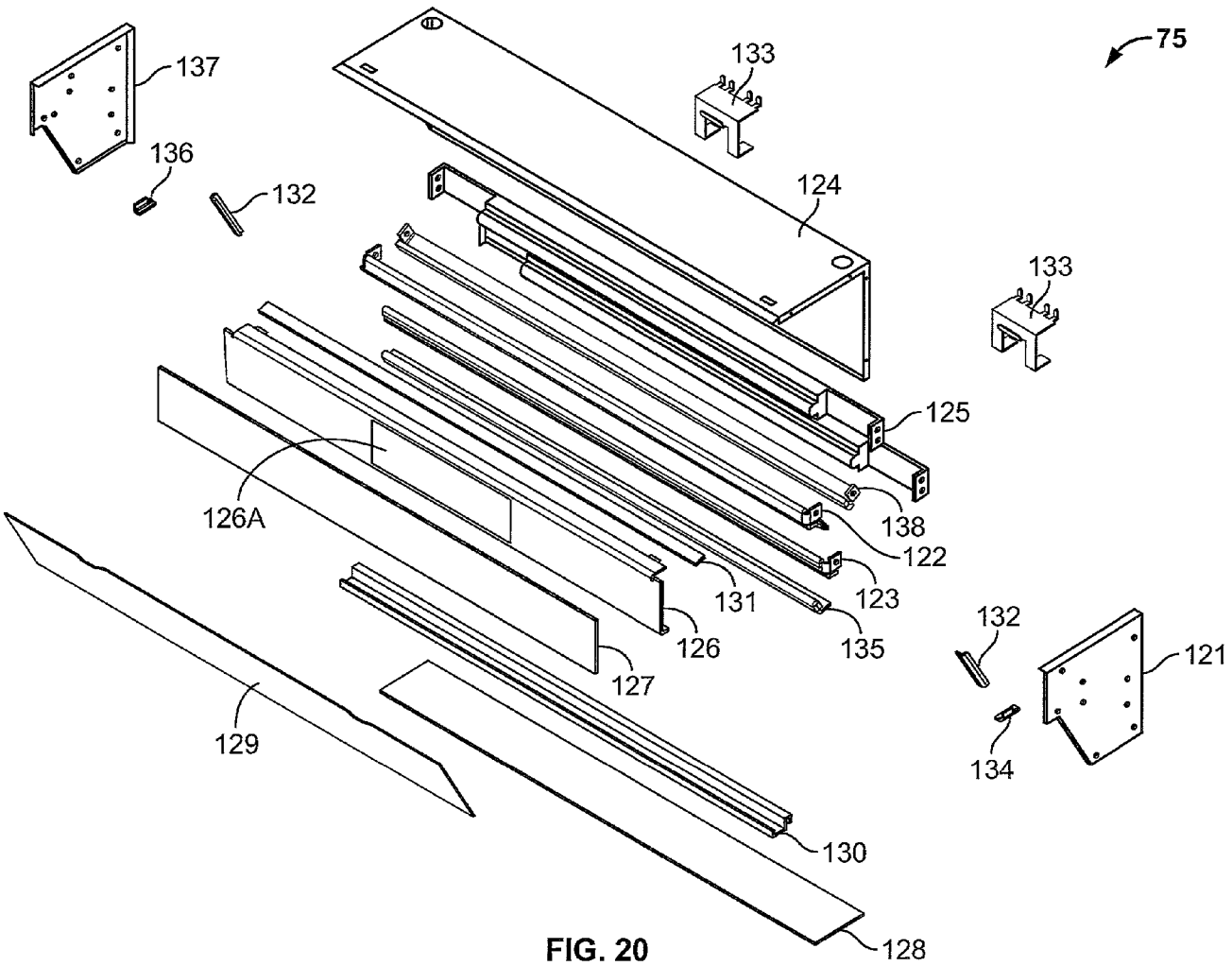
FIG. 20 is an exploded view thereof.

FIG. 20 is an exploded view of header 75, showing right and left housing ends 121, 137 of 18 ga. crs (cold rolled steel). Rail 122 and rail 123 tie these ends 121 together, as does housing 124.

LED light fixtures 125 are enclosed therein. Steel front panel 126, of 18 ga crs, includes an opening that defines what part of translucent acrylic graphic panel 127 will be illuminated, in this case the brand graphic.

Lower panel 128 of ⅛" p95 styrene encloses the bottom and allows light to pass down and illuminate the space or the graphics therebelow. Graphic 129, of 0.03 petg, is angled from graphic panel 127 to lower panel 128, and comprises a backlit image, lit by extension down-light 130.

Reflector 131 reflects light from fixtures 125 to the panels 126-127.

18 ga crs rail 132 helps locate these components on ends 137 and 121.

18 ga crs hang bracket 133 hangs the header assembly 74 from the gondola wall pegboard.

18 ga crs filler 134 stops light leakage at the corners of the header.

18 ga crs rail 135 helps tie ends 121, 137 together.

Mirrors 121 and 137 reflect light towards the places where it is intended.

18 ga crs rail 138 helps tie ends 121, 137 together.

Figure 21:
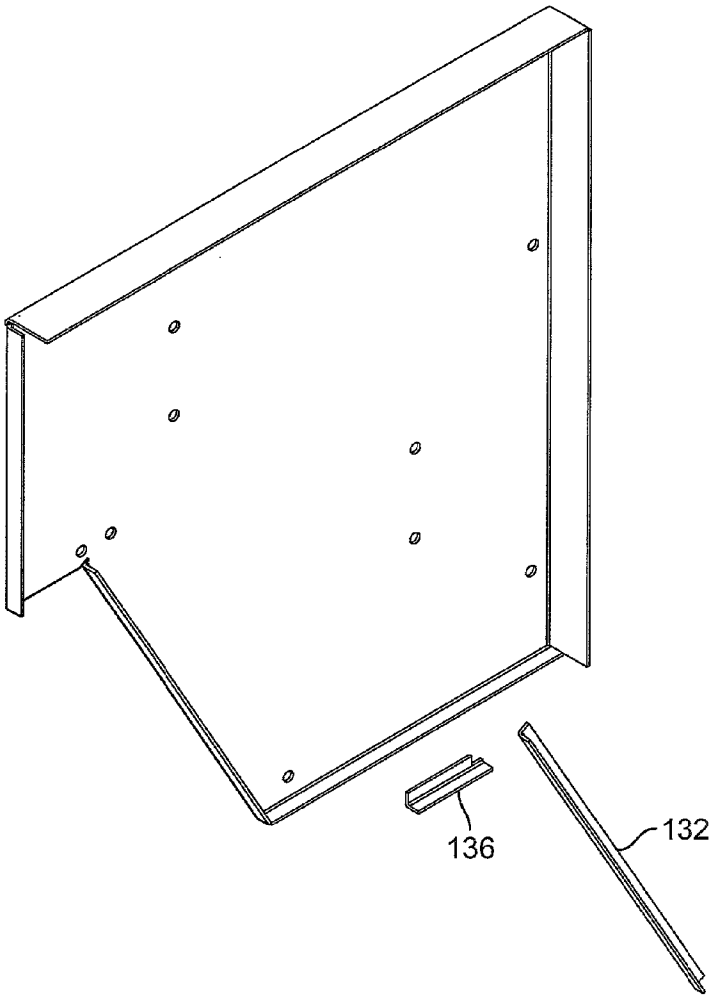
FIG. 21 is an exploded view of a side panel of the header assembly.

FIG. 21 is an exploded view of left housing end 137 if 18 ga. crs (cold rolled steel). Right housing end 121 of FIG. 20 is a mirror image of left housing end 137.

FIG. 21 is an exploded view of left housing end 137. 18 ga crs rail 132 helps locate components on ends 137 and 121. Filler 136 stops light leakage at the corners of the header.

Figure 22:
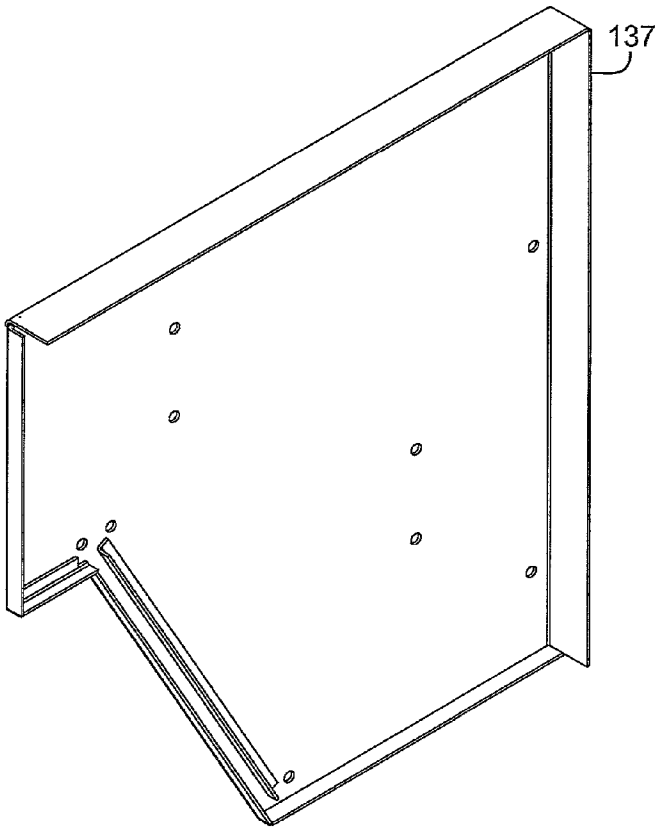
FIG. 22 is a similar view but with parts assembled.

FIG. 22 is a perspective view of left housing end 137.

Figure 23:
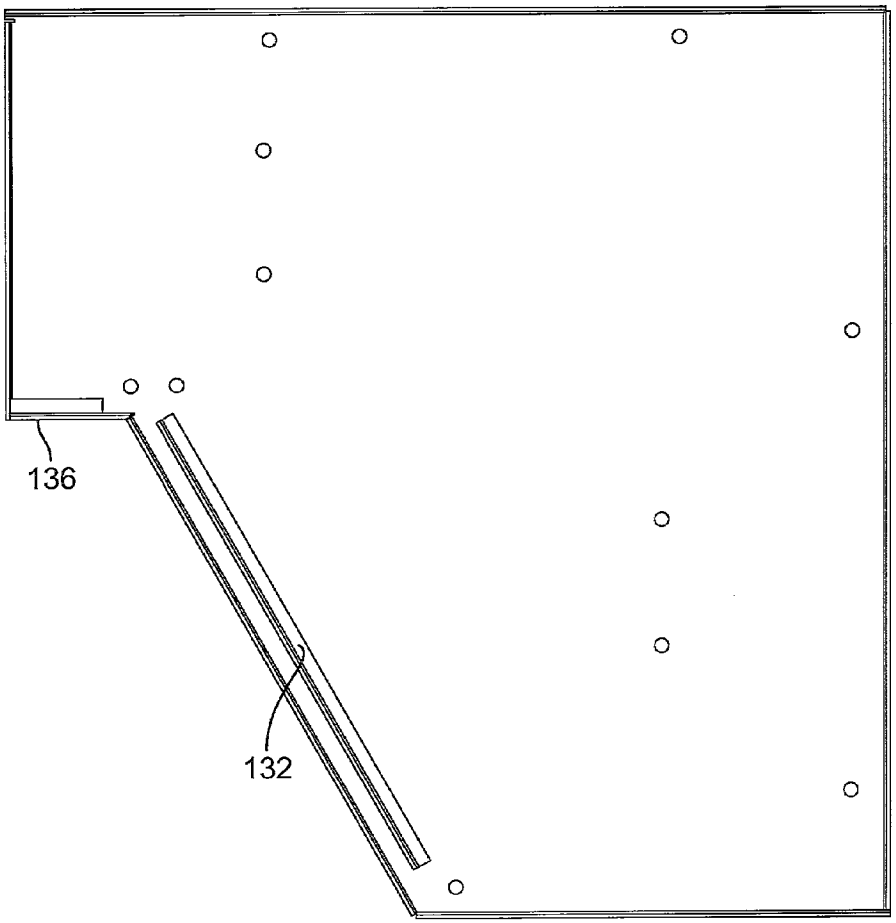
FIG. 23 is a side elevation of left housing end.

FIG. 23 is a side elevation of left housing end 137.

Figure 24:
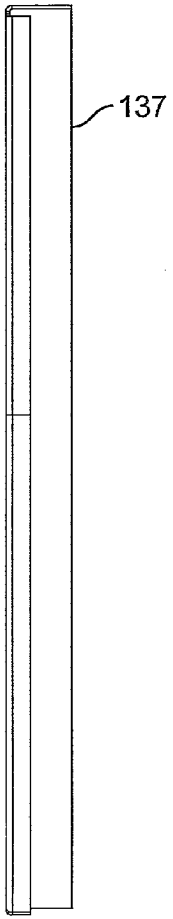
FIG. 24 is a front view of left housing end.

FIG. 24 is a front view of left housing end 137.

Figure 25:
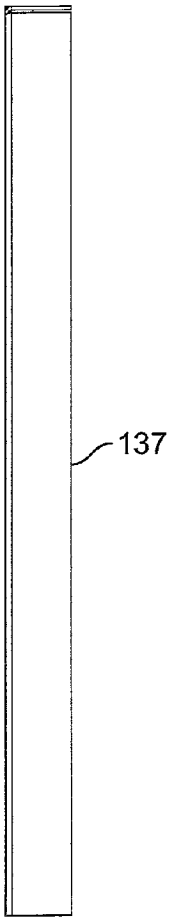
FIG. 25 is a plan view housing end.

FIG. 25 is a plan view of left housing end 137.

Figure 26:
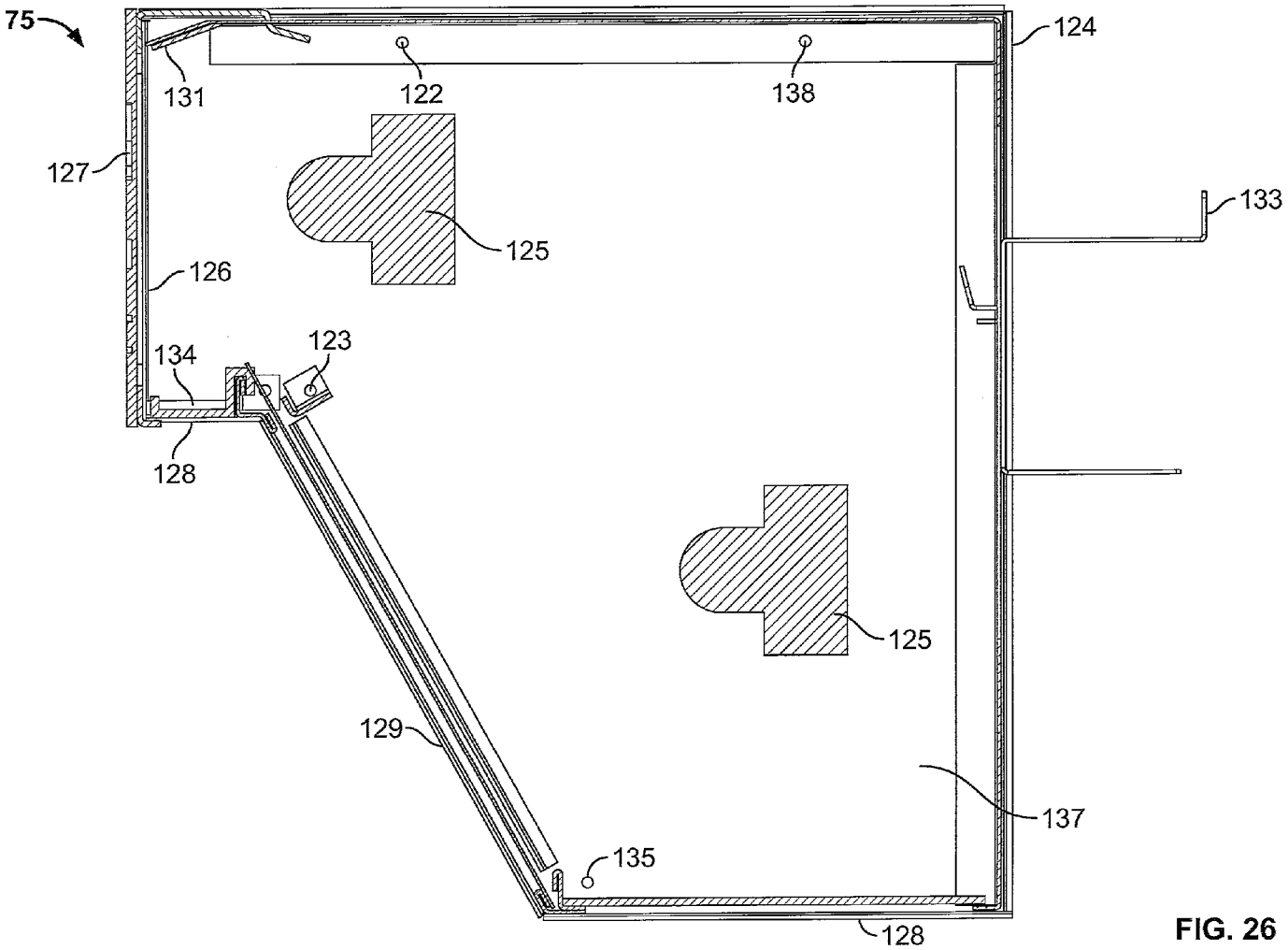
FIG. 26 is a side elevation in section of the header assembly.

FIG. 26 is a side elevation in section of header 75, showing the assembled position of the parts named in FIG. 20. Header 75 shows left housing end 137 of 18 ga. crs (cold rolled steel). Rails 122-123, 135 & 138 tie the ends together, as does housing 124.

LED light fixtures 125 are enclosed therein. Steel front panel 126, of 18 ga crs, includes an opening that defines what part of translucent acrylic graphic panel 127 will be illuminated, in this case the brand graphic.

Lower panel 128 of ⅛", made of p95 styrene, encloses the bottom and allows light to pass down and illuminate the space or the graphics therebelow. Graphic 129, of 0.03 petg, is angled from graphic panel 127 to lower panel 128, and comprises a backlit image, lit by extension down-light from LEDs 125.

Reflector 131 reflects light from fixtures 125 to the panels 126-127.

18 ga crs hang bracket 133 hangs the header assembly 74 from the gondola wall pegboard, above the grids.

18 ga crs filler 134 stops light leakage at the corners of the header 75.

Mirrored end 137 reflects light towards the places where it is intended.

Figure 27:
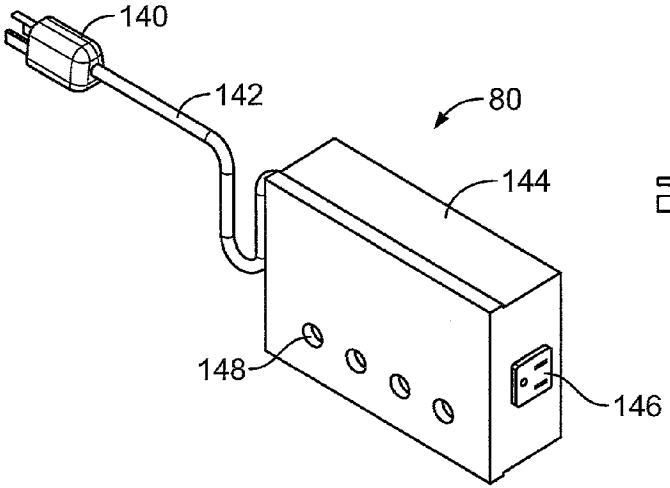
FIG. 27 is an oblique view of power supply.

FIG. 27 is a perspective view of power supply assembly 80.

110 VAC power supply plug 140 supplies 110 VAC through cord 142 to housing 144. 110 VAC socket 146 allows the next power supply 80 to be plugged in for the adjacent vertical assembly. A converter comprising a transformer and rectifier within housing 144 converts 110 VAC to 12 VDC, which may be output to snap-in connectors 148 for wiring harness 76 (FIGS. 7 & 31) to plug into by plug 150.

Figure 28:
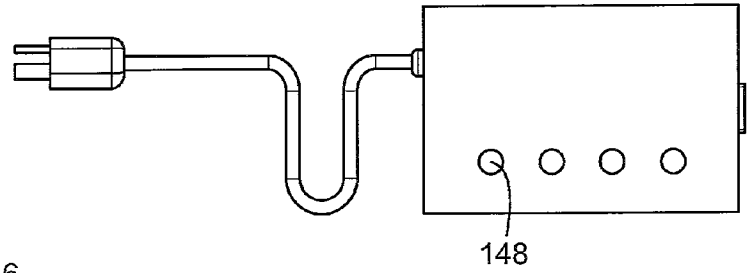
FIG. 28 is a side elevation thereof.

FIG. 28 is a front elevation of power supply assembly 80, showing 12 VDC connectors 148.

Figure 29:
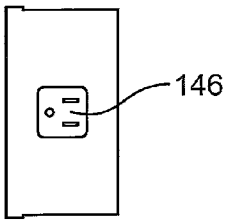
FIG. 29 is a front elevation thereof.

FIG. 29 is a side elevation of power supply assembly 80, showing 110 VAC socket 146.

Figure 30:
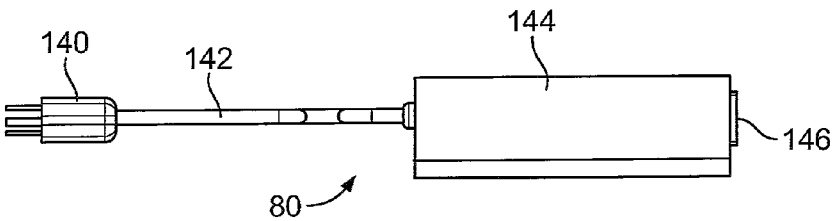
FIG. 30 is a plan view thereof.

FIG. 30 is a plan view of power supply assembly 80.

Figure 31:
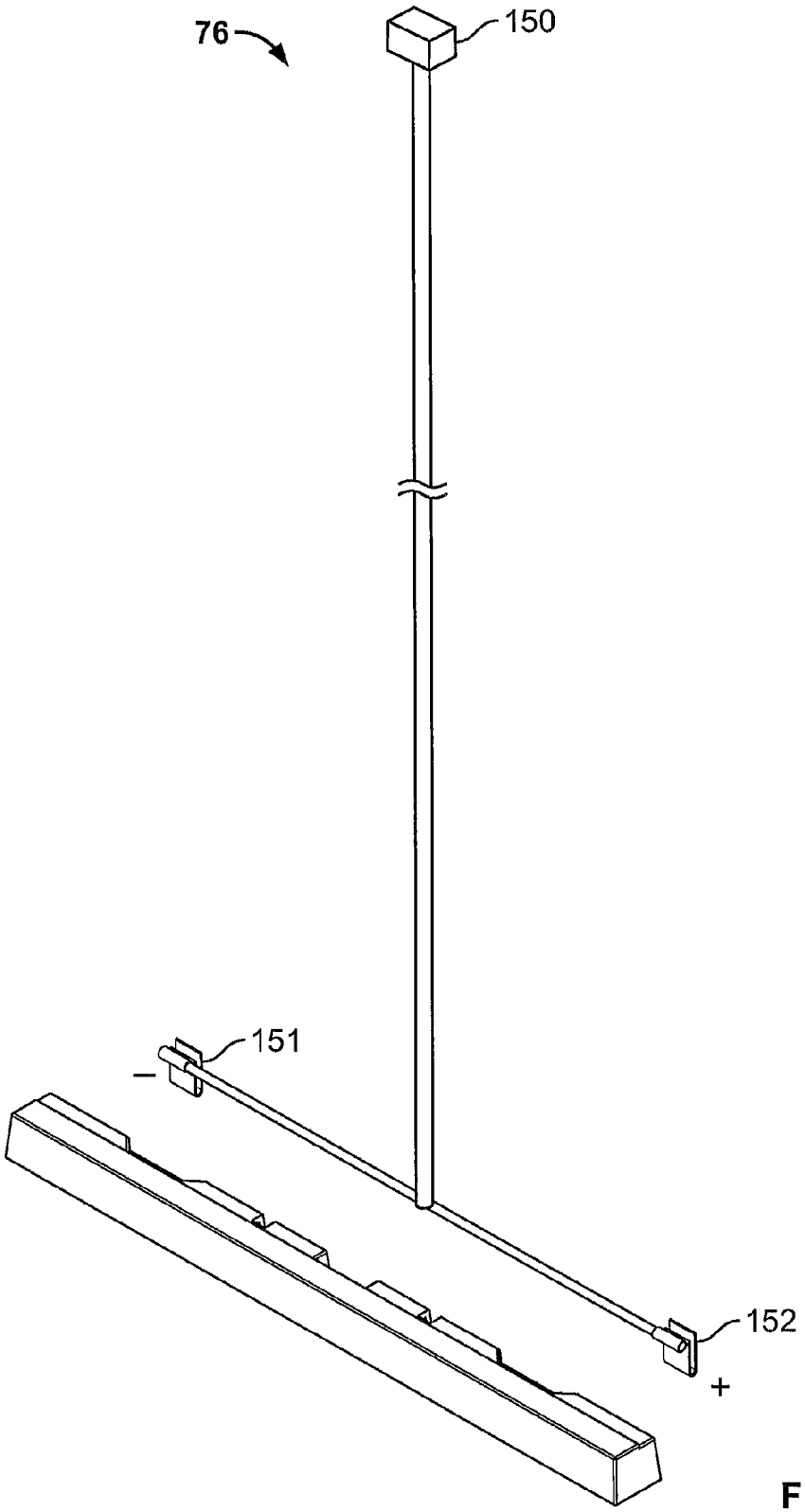
FIG. 31 is an exploded oblique view of a wiring harness of the present invention.

FIG. 31 is a perspective view of wiring harness 76. Harness 76 comprises feed connector 76.1 and harness assembly 76.2, and 12 VDC plug 150, for plugging into the sockets 148 of FIGS. 27-30. FIG. 31 shows 12 VDC connectors 151-152, which connect to and energize the vertical standards 41 & 45 shown in FIG. 6. We note that in this configuration, connectors 151 and 152 are shown at the floor.

Figure 32:
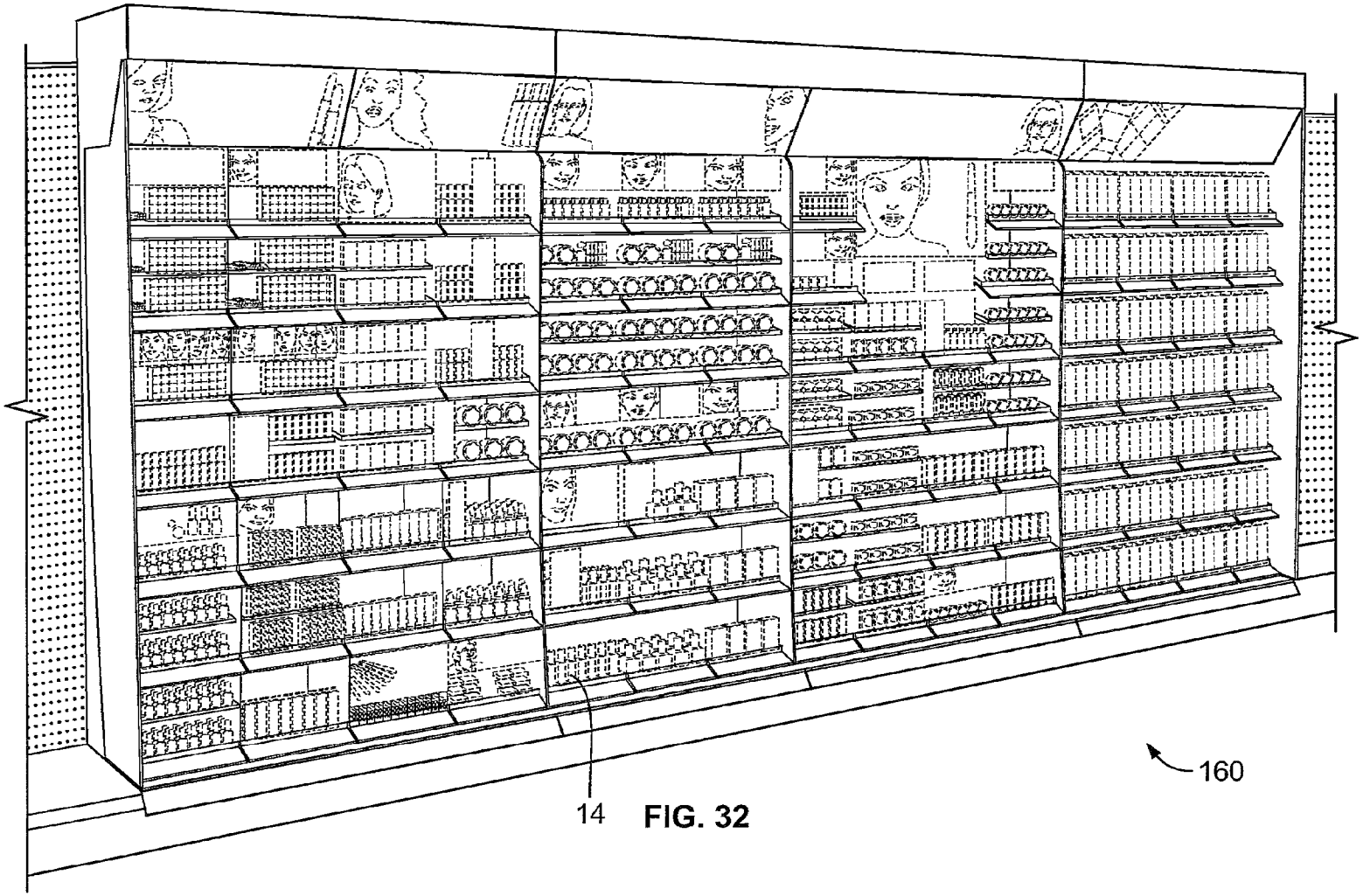
FIG. 32 is an oblique perspective view of a plurality of wall sections assembled together.

FIG. 32 is a perspective view showing a plurality of vertical sections 14 assembled into a 15' cosmetic display wall. Shade strips 3257 are associated with shades of the various products 3291-3296, who's colors the shade strips 3257 depict.

The previous drawings, except FIG. 1A, appeared in the provisional application. Subsequent drawings are new to this utility application.

Figure 33:
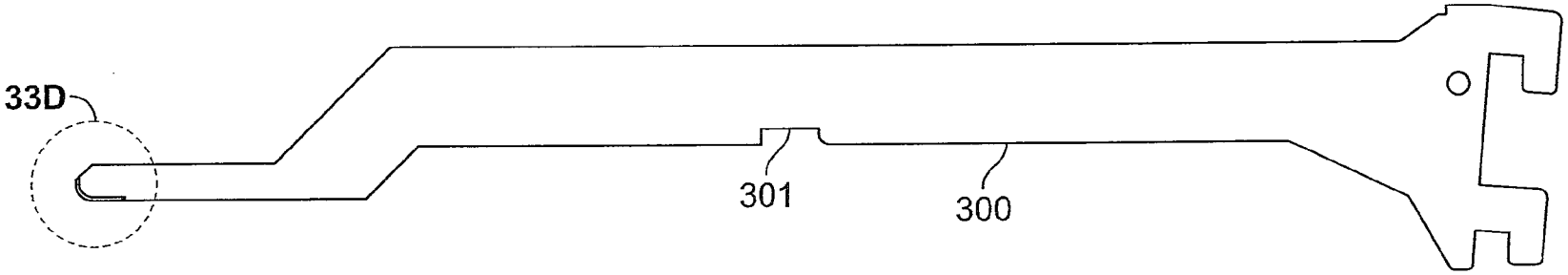
FIG. 33 is a side elevation of a shelf bracket.
Figure 33D:
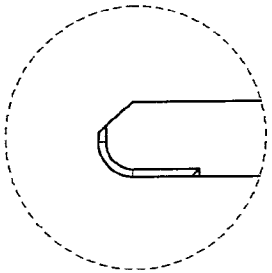
FIG. 33D is a large view of the area circled in FIG. 33.
Figure 34:
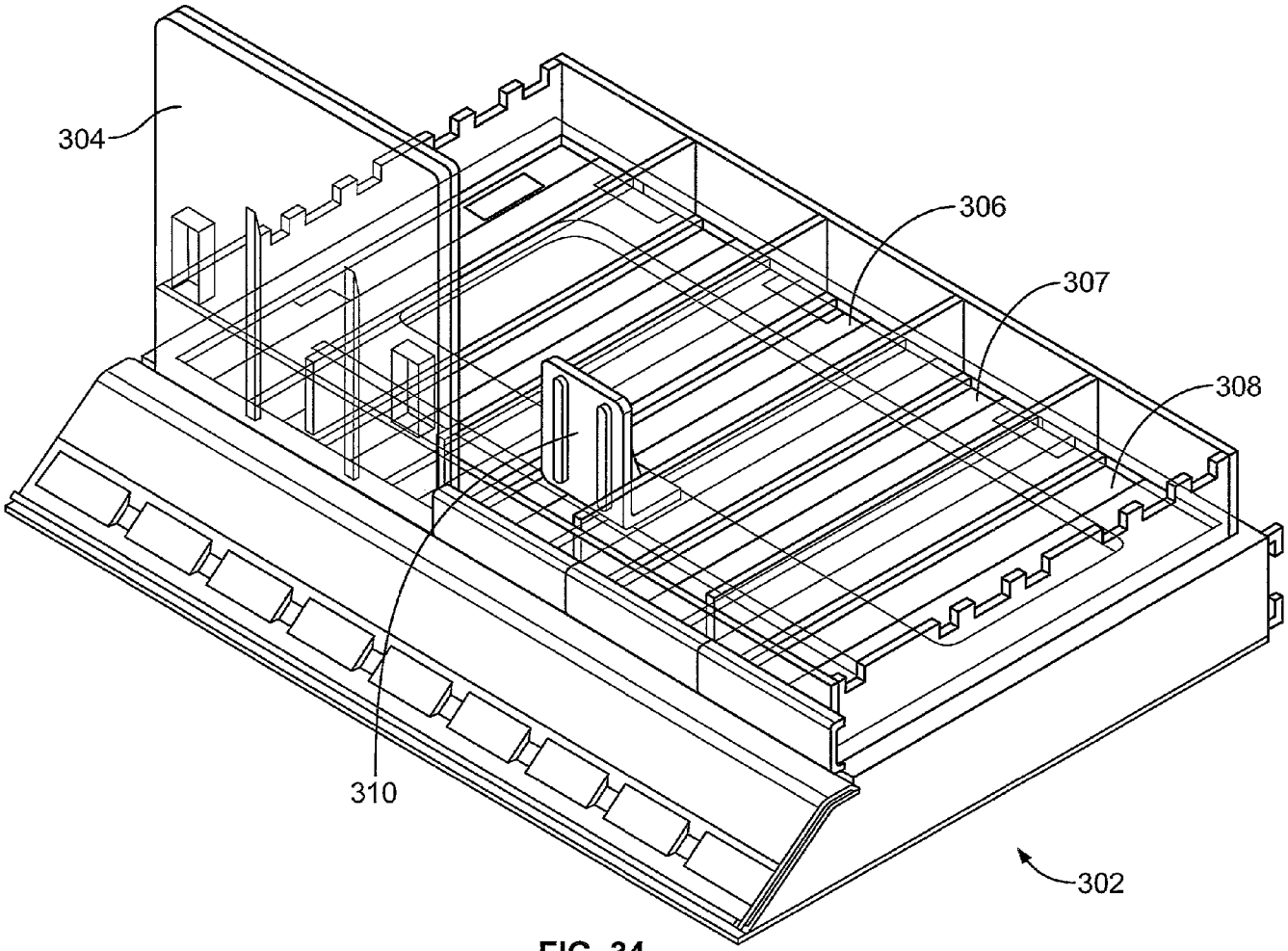
FIG. 34 is an oblique view of an alternate embodiment of a carrier tray.
Figure 35:
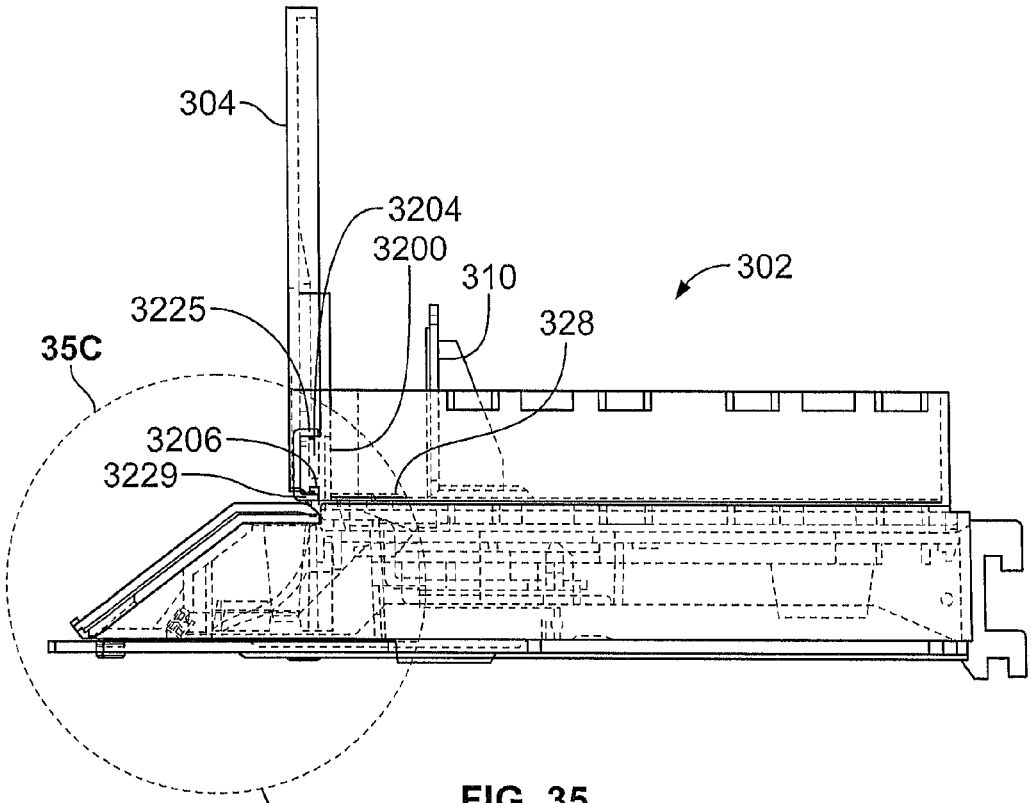
FIG. 35 is a side elevation thereof with hidden details shown in dashed lines.
Figure 36:
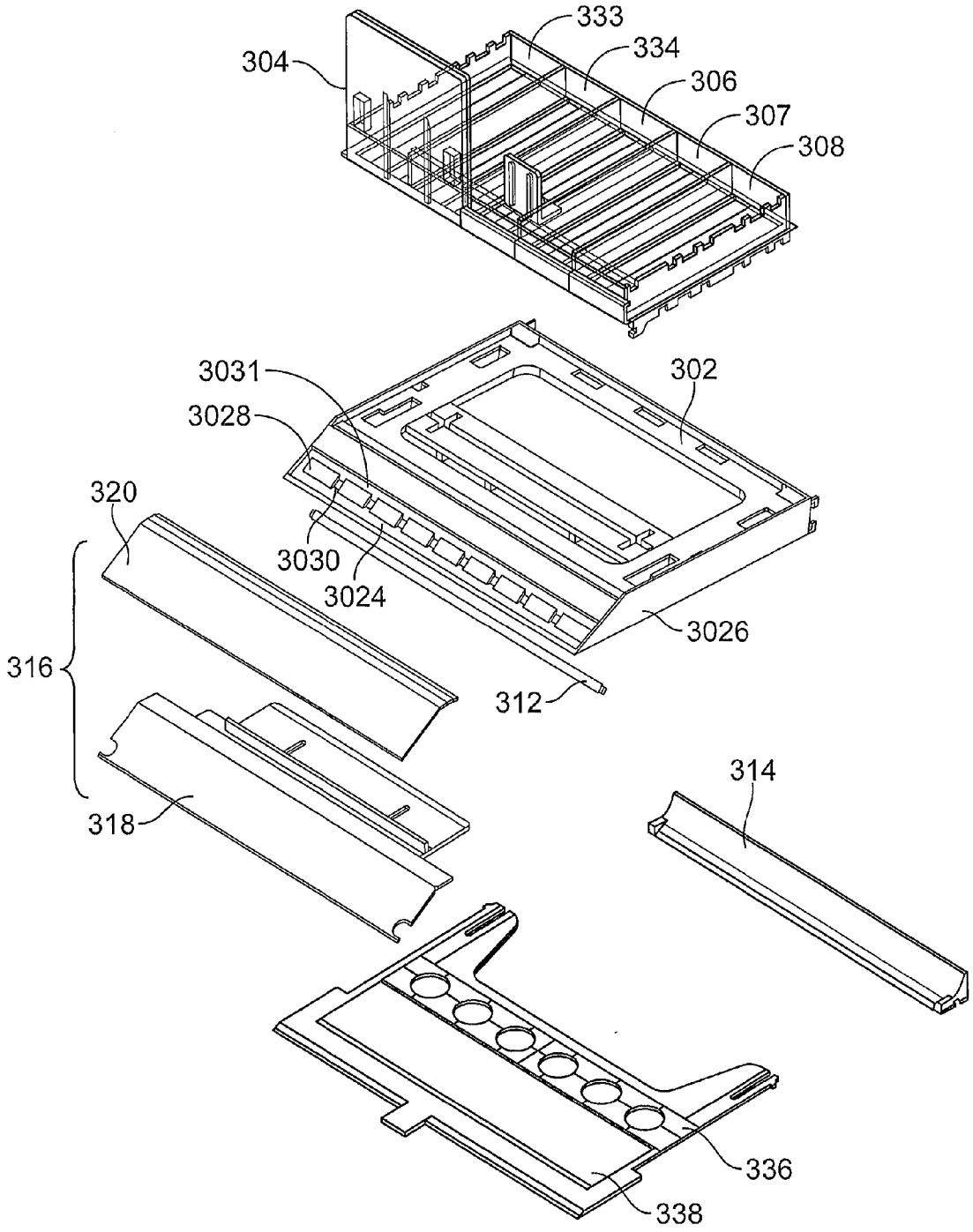
FIG. 36 is an exploded oblique view of the carrier tray assembly of FIG. 35.

FIG. 33 is an angled embodiment of a knife bracket 300. Knife bracket 300 comprises a notch or detent 301. Two of these knife brackets 300 support each angled carrier tray 3022 (FIGS. 34-36). FIG. 33's knife brackets 300 are of 18 ga. 5052 aluminum.

FIG. 34 is an oblique view of a carrier tray assembly 302 having:

a carrier tray 3022, and a carrier tray side 3026;

a back lit sign screen 304, and three pusher tracks 306, 307, 308 for product samples.

One spring-loaded product pusher 310 is shown of the three that would occupy these trays 306-308.

FIG. 35 is a side elevation thereof, of the carrier tray assembly 302 from outside sidewall 3026 of carrier tray 3022. Hidden internal details of the carrier tray assembly 302 are shown in dashed lines.

The carrier tray assembly 302 has a product display area 328 on said carrier tray 3022.

Front wall 3200 on said carrier tray bounds the product display area 328.

Figure 35C:
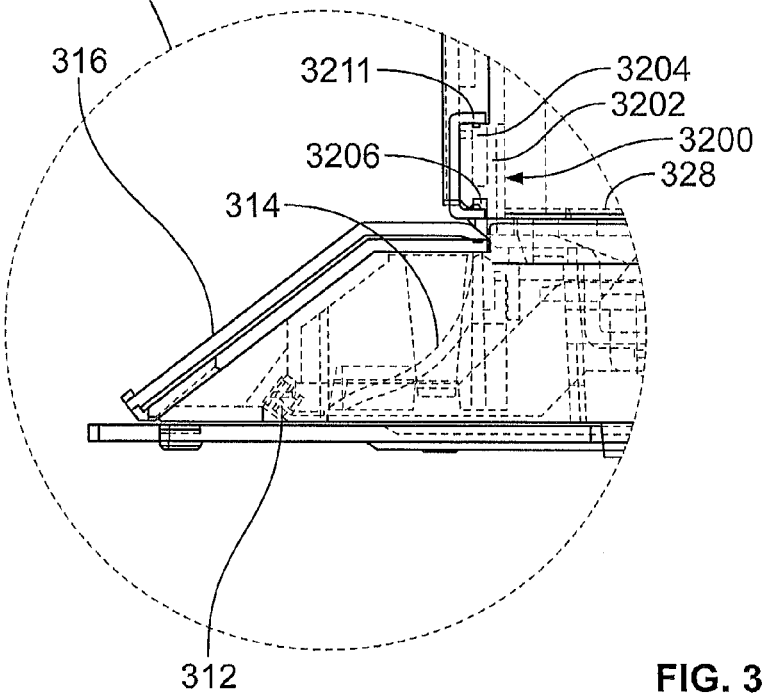
FIG. 35C is a detail of the area circled in FIG. 35.
Figure 35D:
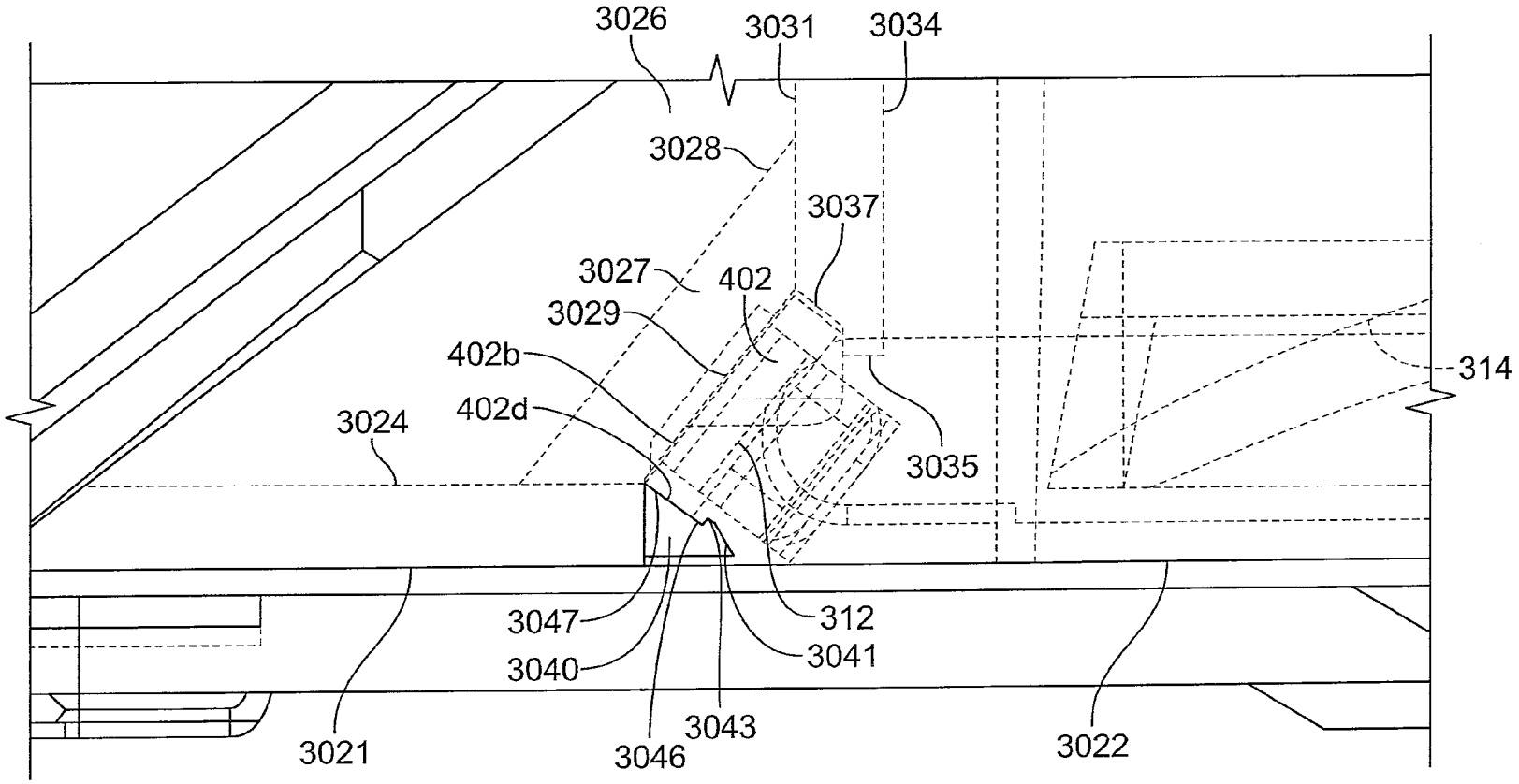
FIG. 35D is a detail thereof, enlarged to six times actual size, of part of detail 35C.
Figure 35E:
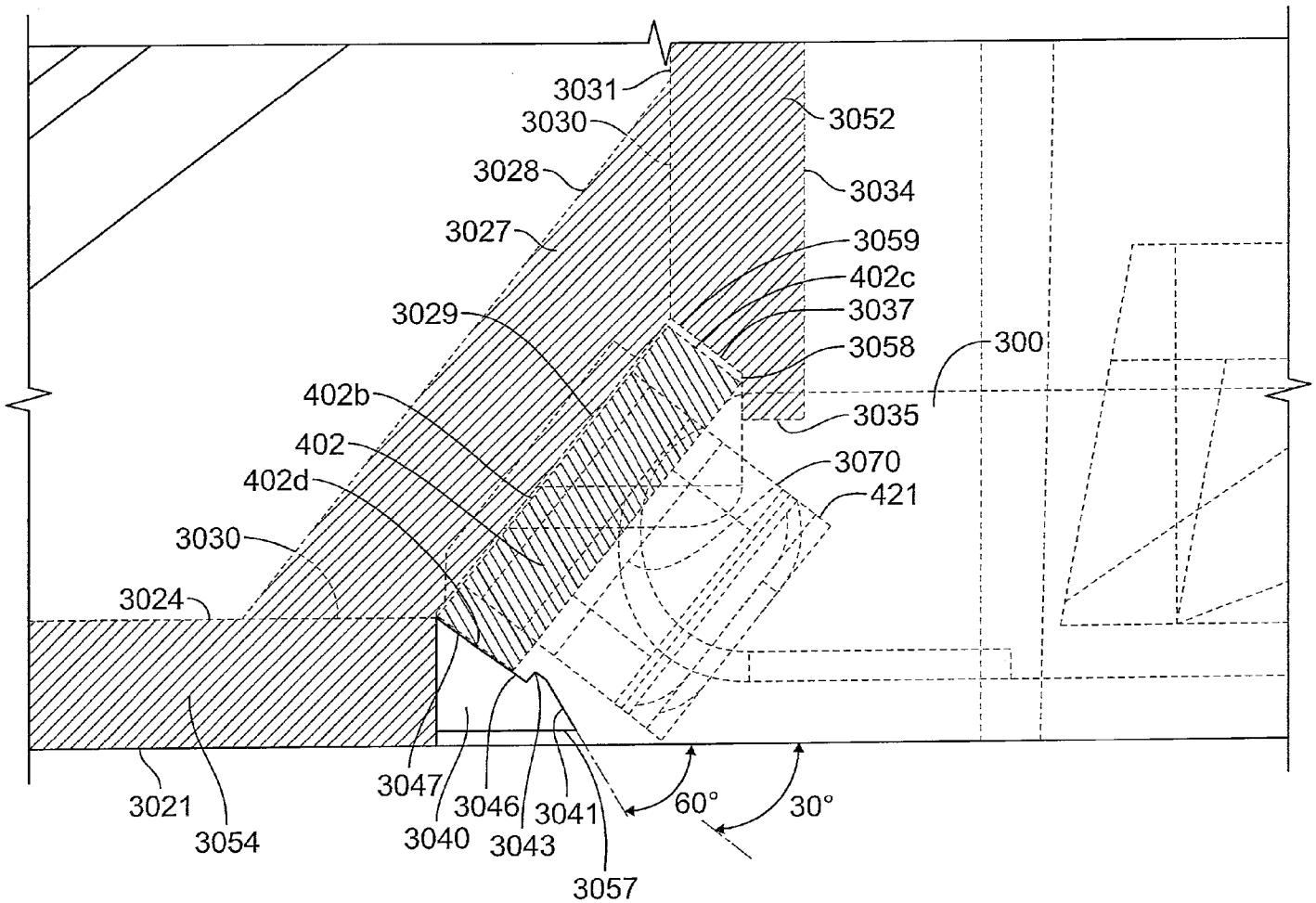
FIG. 35E is a detail thereof, enlarged to about 12 times actual size, of part of detail 35E.
Figure 35F:
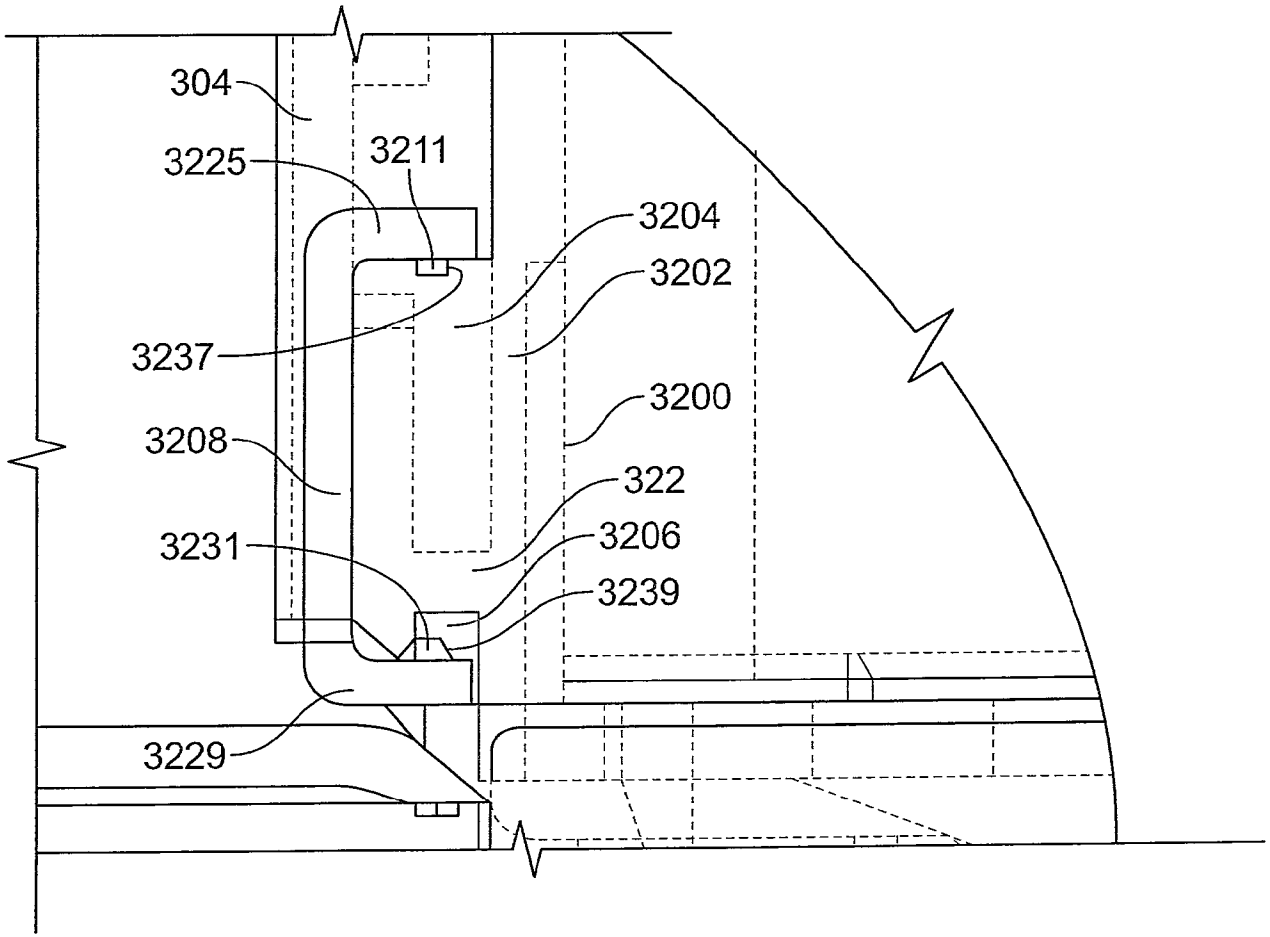
FIG. 35F is a detail of another part of detail 35C, enlarged to about four times actual size.

As shown in detail in new FIG. 35F, an enlargement of part of FIG. 35, said front wall 3200 comprises:

an H-shaped holder 3202;

said H-shaped holder 3202 forming:

- an upper slot 3204, for receiving a display such as a shade strip; and
- a lower slot 3206.

Graphic 304, can be snapped on to holder 3202. Graphic 304 has a C-shaped elastically deformable base 3208. The base 3208 has:

an upper arm 3225, and a lower arm 3229.

Upper arm 3225 has a downward facing tab 3211, which has a ramped surface 3237.

Said lower arm 3229 has an upward facing tab 3231, which has a ramped surface 3239, for hooking into the lower slot 3206.

Ramp 3237 is for wedging open the C-shaped elastically deformable base 3208.

Once tab 3211 drops into slot 3204 then tab 3211 will hold the graphic 304 in place.

As shown in FIGS. 1, 1A, and 32, the retained tabs retain said graphic upright in a framing orientation to the product area, as shown in FIG. 1A where:

graphics 901, frame product area 902;

graphics 903, frame product area 904;

graphics 905, 906 frame product areas 907
graphics 908 frame product areas 933;
graphics 912 frame product area 913;
graphics 914 frame product area 915;
graphics 918 frame product area 919;

The shades shown in the shade strip preferably correspond to those of the products carried on display surface 328 shown in FIGS. 35C and 35. Graphic panels lacking an H-shaped base may also be mounted by inserting a graphic panel's flat bottom edge into slot 3204 of FIG. 35F.

FIG. 35C is a detail of FIG. 35, showing how LED assembly 312 illuminates reflector 314 to evenly cast backlight on display panel 316, and to illuminate areas above such as graphic 304.

FIG. 35D is a detail six times enlarged of part of detail 35C of carrier tray 3022, which is a molded plastic tray, to which other parts are attached. A front bottom surface 3021 of carrier tray 3022 forms the bottom of front floor 3024, shown in dashed lines hidden behind sidewall 3026. Inclined wall 3027 has a front surface 3028 and a back surface 3029, both in dotted lines hidden behind sidewall 3026.

As also shown in FIG. 36, front floor 3024 ends at sidewall 3026 and abuts the inclined wall front surface 3028. Inclined wall front surface 3028 has a plurality of windows 3030 which open to inner wall 3029 shown in FIG. 35D. From Inclined wall front surface 3028, extends a vertical wall front surface 3031, shown in both FIGS. 35D and 36.

FIG. 35D shows, in dashed lines, vertical wall front surface 3031, vertical wall back surface 3034, vertical wall bottom surface 3035, and vertical wall notch 3037.

To install LED strip 312, an edge such as 402*c* (FIG. 41) is placed against vertical wall notch 3037 (FIG. 35D-E), and the opposite edge, such as 402*d*, is rotated clockwise down towards retaining tabs 3034. A plurality of these tabs are provided, one tab 3034 at each window 3030 (FIG. 36). The windows 3030 facilitate molding of the tabs 3040 to the carrier tray 3022.

In FIG. 35D, as edge 402*d* contacts inclined surface 3041, edge 402*d* wedges tab 3034 down, allowing edge 402*d* to pass small bump 3043, past detent 3046, and settle against notch surface 3047, whereupon tab 3040 returns up and captures board 402 with edge 402*d* held by notch surface 3047 and by bump 3043. Board 402's flat surface 402*b* then abuts inclined wall 3027's inner surface 3029.

FIG. 35D is further enlarged to FIG. 35E.

FIG. 35E is centered on circuit board 402, and taken in section through a plane not intersecting a window 3030 (FIG. 36).

This is very similar to:

the original view of the original embodiment, in original FIG. 12, originally filed with the provisional application 61/172,100, and is similar to the present enlargement thereof, FIG. 12A.

In those sectioned drawings (FIGS. 12 & 12A), the shown tab 1740 is not crosshatched, indicating it is one of a plurality of discontinuous tabs, and not the continuous lip 1738 shown crosshatched in FIGS. 12 & 12A.

The embodiment of FIGS. 35, 35C, 35D & 35E, differs from the provisional FIG. 12 embodiment: in the shapes of tab's 1740 surface 1741, from FIG. 35's tab 3034's detented surfaces 3047, 3046, 3043, 3041.

Another difference is that FIG. 12's circuit board holder 1702 is a separate piece, not molded to carrier tray 17, while FIG. 35*s*'s circuit board's 402 holder is an integrally molded part of the molded plastic carrier tray 3022 comprising surfaces:

tab surfaces 3046, 3047,
inclined wall surface 3029,
notch 3037 surfaces: 3058, 3059.

In FIG. 35E, window 3030's hidden boundaries are in dashed lines within the crosshatched section. FIG. 35E is about five times actual size, and shows vertical wall 3052 in hatched lines of the same molded piece as inclined wall 3027 and floor 3054.

Circuit board 402 is cross hatched at a different angle to show it is a distinct piece. In this embodiment it measures about 6 mm across side 402*b*.

FIG. 35E shows, in solid lines, vertical wall front surface 3031, vertical wall back surface 3034, vertical wall bottom surface 3035, and vertical wall notch 3037, which is bounded by surface 3059 and a lip 3058.

To install LED strip 312 and its circuit board 402, an edge such as 402*c* (detailed in FIG. 41) is placed against vertical wall notch 3037 (FIG. 35E), and the opposite edge, such as 402*d*, is rotated clockwise down towards retaining tabs 3034. A plurality of these tabs 3034 are provided, one tab 3034 at each window 3030 (FIG. 36). The windows 3030 facilitate molding of the tabs 3040 to the carrier tray 3022.

In FIG. 35E, each tab 3034 is about 2.5 mm on its bottom edge 3057.

Inclined surface 3041 is oriented about 60 degrees from horizontal surface 3057.

As edge 402*d* contacts inclined surface 3041, edge 402*d* wedges tab 3034 down, allowing edge 402*d* to pass corner 3043, pass detent 3046, and settle against notch surface 3047, whereupon tab 3040 returns up and captures board 402 with edge 402*d* held by notch surface 3047 and by detent 3043. Detent 3043 is about 0.2 mm and is barely perceptible to one's fingernail, but the plurality of detents 3043 retain the board 402 effectively until someone wants to snap board 402 out of its holder, which can be done without much difficulty. Board 402's flat surface 402*b* then abuts inclined wall 3027's inner surface 3029.

Board 402's top surface 402*c* is then retained in notch 3037 by lip 3058 and surface 3059 of vertical wall 3052.

At the far end of board 402 is shown spring clip 421, partially hidden by board 402.

When knife bracket 300 is inserted into carrier tray 3022, an end 3070 of knife bracket 300 goes into the U shaped spring clip 421 and provides electrical contact with, and securement of, board 402, to power board 402's array of LEDs 125.

FIG. 36 is an exploded oblique view of the carrier tray assembly 302, showing panel 316 exploded into support 318 and bullnose 320, which is hot stamped, silk-screened, and sonic welded. Light Emitting Diode (LED) strip 312 snaps into the underside of carrier tray 3022, and is shown in more detail in FIG. 41.

As shown in amended FIG. 4, header 30 also comprises inner bullnose panel 30A, spaced from outer bullnose panel 30 by a sufficient gap 30B to slide in a removable bullnose graphic therebetween. The bullnose graphic may be translucent, for backlighting, but may alternatively be opaque. Sufficient light is projected from above, and reflects from reflector 29, to wall 30C, to illuminate an opaque graphic, in gap 30B, from the front.

As shown in FIG. 1, many of these bullnoses 30 are coplanar, or abut sidewalls, on the bullnoses's edges. This would make it hard to change the graphic, but for the features shown in FIG. 36, where the bullnose assembly 316, comprising bullnose panel 320 and a sufficient gap 30B (FIG. 4) to slide in a removable bullnose graphic between it and FIG. 36's inner bullnose panel 30A. FIG. 36 shows that bullnose 316 may be pulled forward, to clear its neighboring bullnoses or sidewalls, so that the graphic may be inserted from bullnose 316's sides.

Bullnose 316 may then be pushed back to its coplanar working position, as depicted in FIG. 1 by the bullnoses shown at the front edges of shelf assemblies 7.

As in amended FIG. 36, tab 318A is a slidable mount for bullnose assembly 316. Tab 318A slides under the underside of cross-piece 303. This sandwiched structure comprises a slidable mount for bullnose assembly 316:

- to be pulled forward of the aforementioned obstructions to the insertion of a graphic;
- to have a removable bullnose graphic slid in from the side into a gap 30B (FIG. 4) between the bullnose panel 320 in FIG. 36 (30 in FIG. 4) and FIG. 36's inner bullnose panel 30A; and
- then to be returned to bullnose assembly 316's coplanar location.

Insert trays such as 306, 307, & 308 assemble onto carrier tray 302. Insert trays 333 and 334 may also be assembled together to a display panel such as 304 onto carrier tray 3022 to form carrier tray assembly 302.

A pull-out tray 336 is provided for Universal product code (UPC) labels 338, which assist in assembling stock to the display and possibly includes product samples in sample spaces 337.

Figure 37:
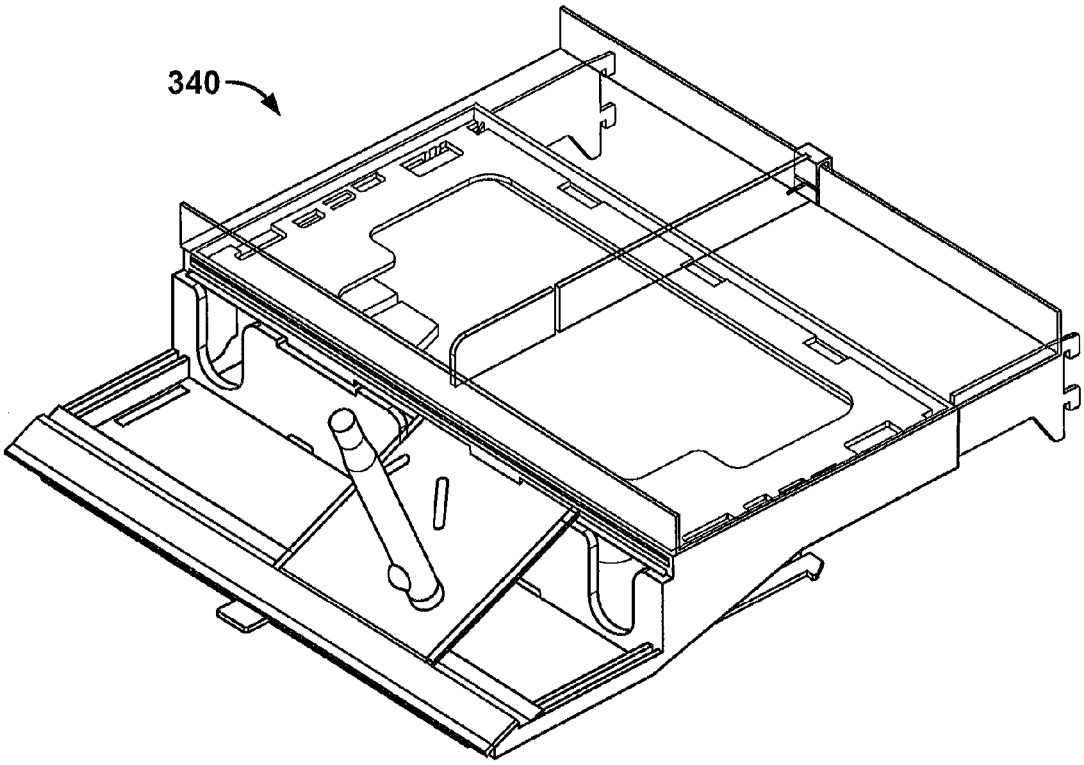
FIG. 37 is an oblique view of an alternative embodiment thereof.
Figure 38:
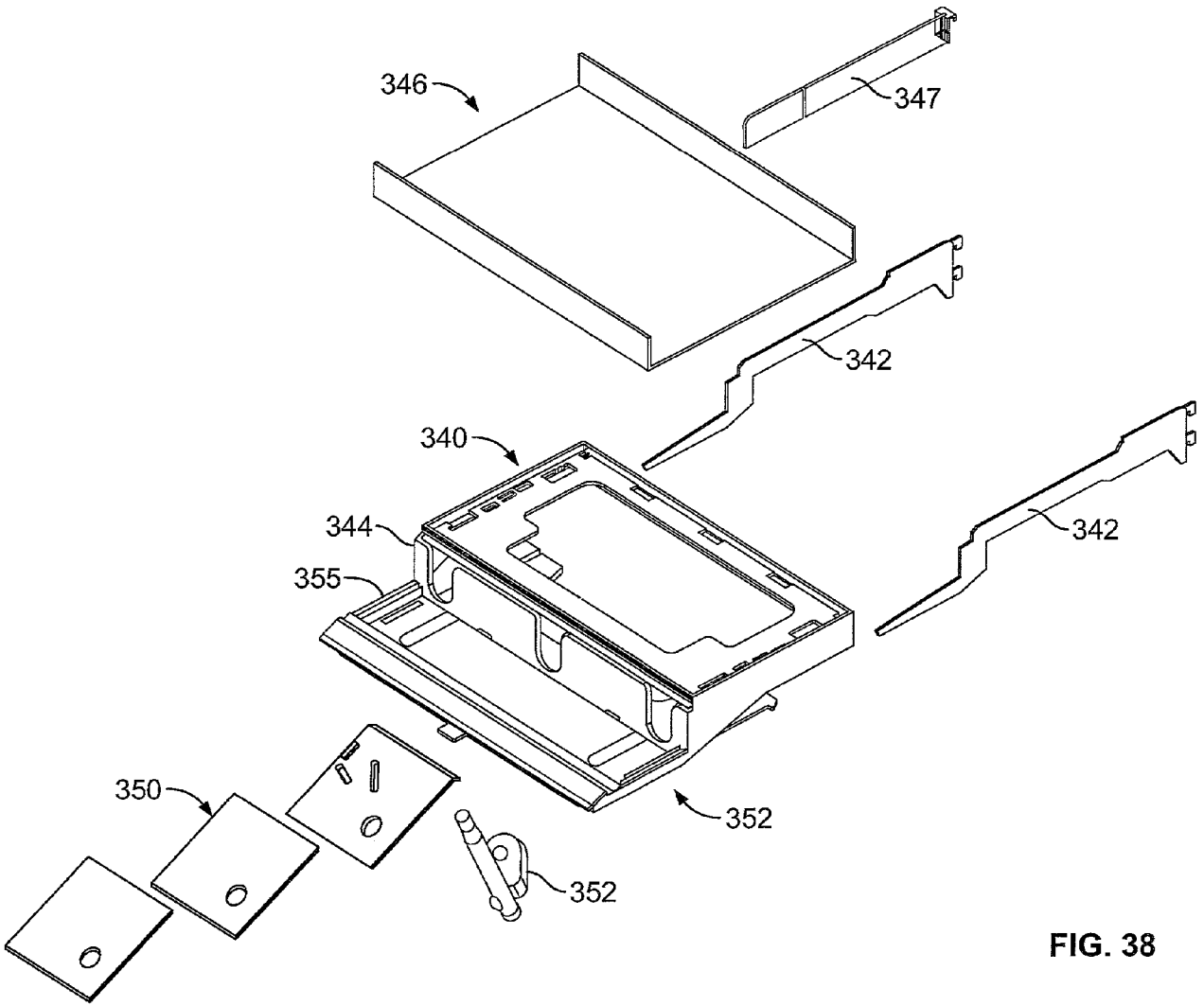
FIG. 38 exploded view thereof.

FIGS. 37 and 38 show a carrier tray assembly 340 designed for hair care products.

FIG. 37 is an oblique view of said carrier tray 340.

FIG. 38 is an exploded view of carrier tray 340.

Carrier tray assembly 340 comprises a housing 344, a tray 346 sits atop carrier tray housing 344.

Product on tray 346 is separated by molded divider 347.

Upper plate 350 is provided for graphics. A large version not shown may fill up more of the display space atop the forward section of housing 344. Or it may be cut down to two smaller sizes such as the small size shown 350. Post 352 serves as a swatch holder and as a pull to open UPC tray 355.

Figure 39:
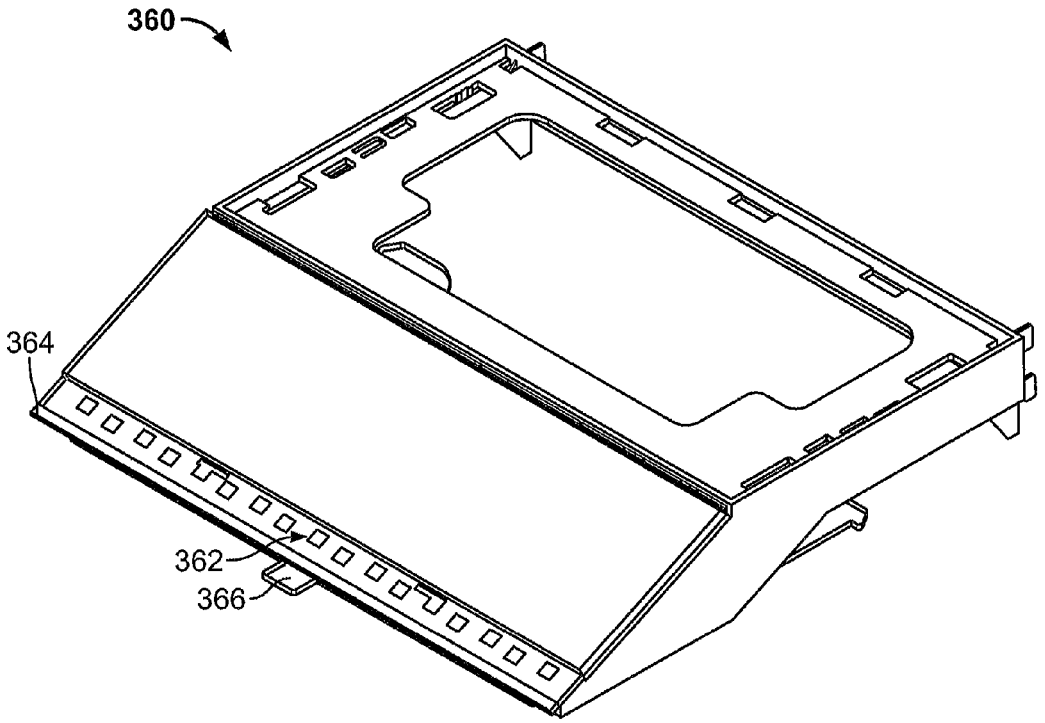
FIG. 39 is an oblique view of yet another embodiment of a shelf assembly.
Figure 40:
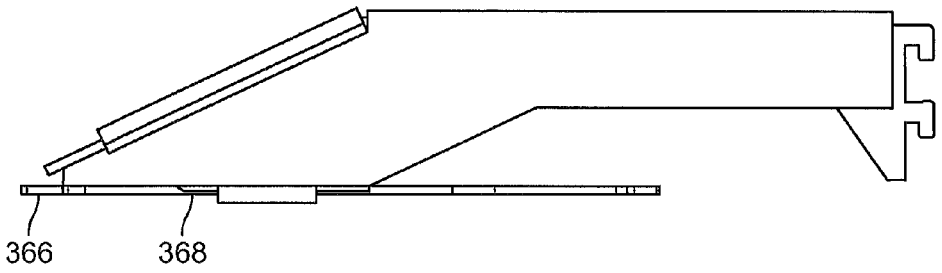
FIG. 40 shows the is a side elevation thereof.

FIGS. 39-40 show another version of a carrier tray assembly 360. FIG. 39 is an oblique view. At it's front is a logo panel 362, and a trim strip 364 which in this version is champagne gold in color. A tab 366 protrudes from there under, to pull out the UPC tray shown in FIG. 40.

FIG. 41 shows tray assembly 360 in section.

FIGS. 41-45 show the light emitting diode assembly 400.

FIG. 41 is a view of light emitting diode assembly 400, shown in FIGS. 36 and 35 as 312, which can be installed at various angles depending on where light is wanted.

FIG. 42 is a view across FIG. 41.

LED assembly 400, 312 comprises a printed circuit board 402 and a plurality of LEDs 410. Board 402 has an LED carrying surface 402*a*, a flat surface 402*b*, and edges 402*c* & 402*d*.

At one end of printed circuit board 402 is a positive connection clip 421.

At the other end is a negative connection clip 422.

FIG. 43 is an expanded detail in front elevation of positive connection clip 421 which is soldered to circuit board 402. This gives it an electrical connection FIG. 43 to the light emitting diodes 410. 12 Volt direct current is carried through the knife brackets such as 300 in FIG. 33. Positive connection clip 421 snaps onto a positively polarized knife bracket, and negative connection clip 422 snaps onto the negatively polarized knife bracket.

FIG. 44 shows spring negative clip 422 as a flat piece of metal before it is bent into its spring clip shape.

FIG. 45 shows spring positive clip 421 as a flat piece of metal before it is bent into its spring clip shape. FIGS. 42 to 45, as originally filed specify the dimensions, the radii and the angles of the bends of said flat metal to form them into these spring clips 421-422.

As indicated in the originally filed FIG. 42 negative connection clip assembly 422 as an orientation by the through hole in the printed circuit board so that the polarity cannot be reversed during the assembly in an enclosure. The clips are designed to make electrical contact with 18 gauge galvanized steel. The clips are to have mechanical attachment to the printed circuit. Spacing 435 (FIG. 43 as filed) between the light emitting diodes 410 is 0.435 inches on center and, in this embodiment, the spacing 435 is critical to the function of evenly lighting the intended targets of illumination.

In the originally filed FIGS. 41 and 42, the circuit board measurement 1100 is 11.00 inches long. The measurement 1112 between the centers of the seating spaces 485 of the spring clips 421 & 422 is 11.125 inches.

In originally filed FIG. 43 the measurement 456 across the opening of the U-shaped seating space 485 is 0.036 inches, in order to cooperate with the 18 gauge knife brackets that each of the spring clips 421 & 422 will clip to. The measurement 457 from the LED plane of the mounting surface 402A of circuit board 402, to the plane of the mouth 4211 of spring clip 421 is 0.113 inches maximum. The measurement from the inside surface 4212 of the vertical segment of the spring clip to be most outside the invention 4214 of the spring clip 421 is a minimum 458 of 0.117 inches and a maximum 459 of 0.123 inches. The width 460 of each spring clip 421-422 is 0.250 inches or less. Circuit board 402 measures 0.063 inches thick 463. A tail 464 of spring clip 421 protrudes through the circuit board 402 and extends no more than 0.020 inches beyond the flat surface 402*b* of circuit board 402.

Originally filed FIG. 44 shows the flat sheet of spring metal that is to be formed into negative spring clip 422, and shows negative sign perforation 444 located at a distance 469 of 0.10 inches from the distal end 491 of negative spring clip 422. The width 470 of this perforation 444 is 0.040 inches. Thru hole 471 measures 0.080 inches in diameter. The measurement 472 from a center of through hole 471 to distal end 491 is 0.295 inches. The measurement 473 of the straight sides of minus sign hole 444 is 0.130 inches and the ends of the minus sign hole 444 are radiused from those sides.

Originally filed FIG. 45 shows how both spring clips are bent from the flat piece of metal 421 to take the shape shown in FIG. 43. The first bend is at a transverse line 476: bent down 44° and radiused 0.001 inches. The second bend is at 477 bent up 197° and radiused 0.031 inches. The third bend is at 478, is down 189° and is radiused 0.001 inches. The fourth bend is at 479, up 90° and radiused 0.001 inches. The fifth bend 480 is down 90° and these are radiused 0.001 inches. These bends 476 to 480, radii, and angles are shown in FIG. 43.

Figure 46:
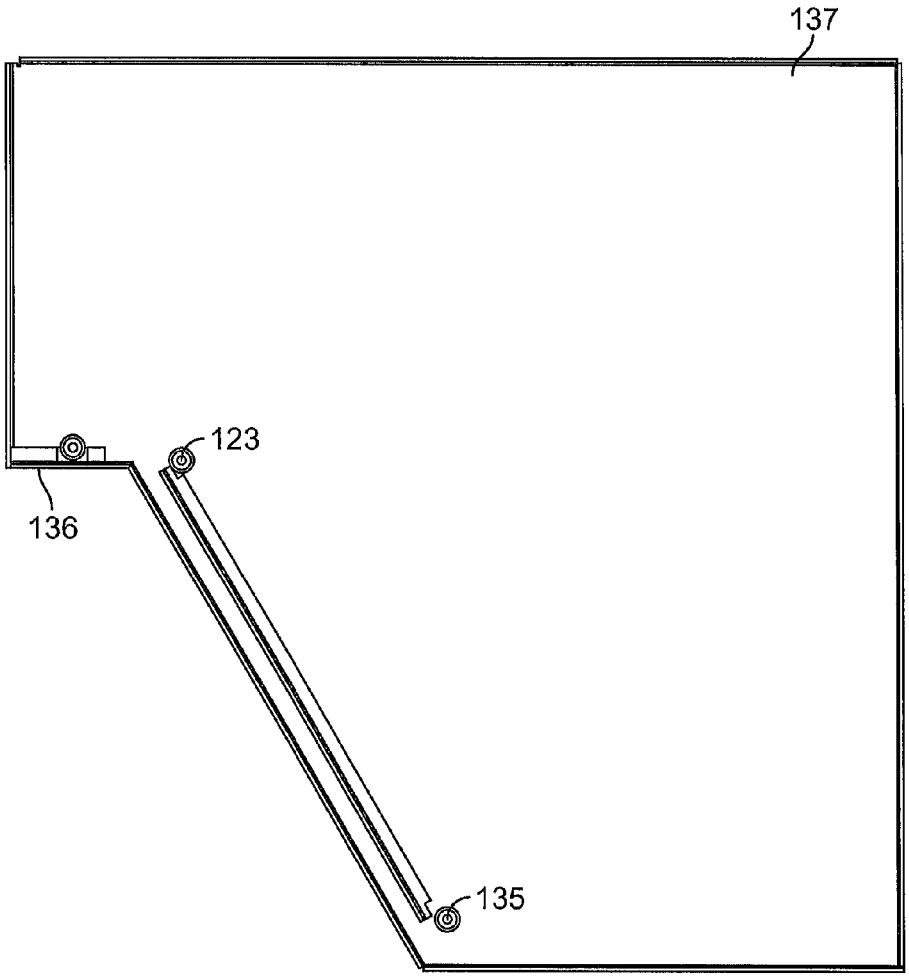
FIG. 46 is the current embodiment a side panel shown in FIG. 26.

FIG. 46 is the current embodiment of the side panel 137 shown in FIG. 26. The edges are designed to fit tight and flush against the transverse panels to reduce light leaks.

Figure 47:
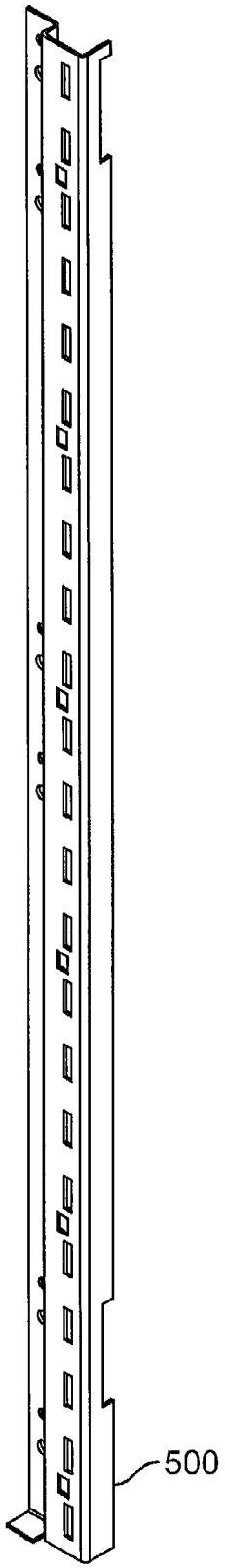
FIG. 47 is an oblique view of a right shelf standard.
Figure 48:
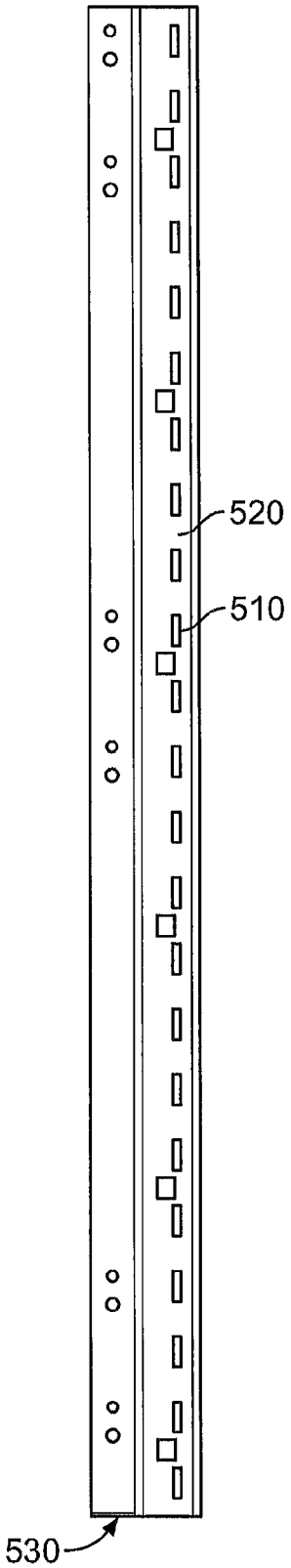
FIG. 48 is a front elevation thereof.

FIG. 47 is an oblique view of a right shelf standard 500. The left shelf standard is a mirror image of right shelf standard 500. A plurality of vertically elongated and aligned slots 510 are provided so that the shelf brackets or knife brackets such as 300 can hook into slots 510. Cooperative spacing to brackets' hooks is critical to proper functioning of the slots and hooks. The standards 510 serve as electrical conductors and current from the 12 V power supply is conducted through the hooks and the brackets across the spring clips of the LED assembly to power in the LEDs. Spacing is shown in FIG. 48.

Tab 530 provided at the bottom of shelf standard 510.

Figure 49:
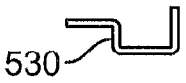
FIG. 49 is a top plan view thereof.

FIG. 49 is a top plan view of shelf standard 510.

Figure 50:
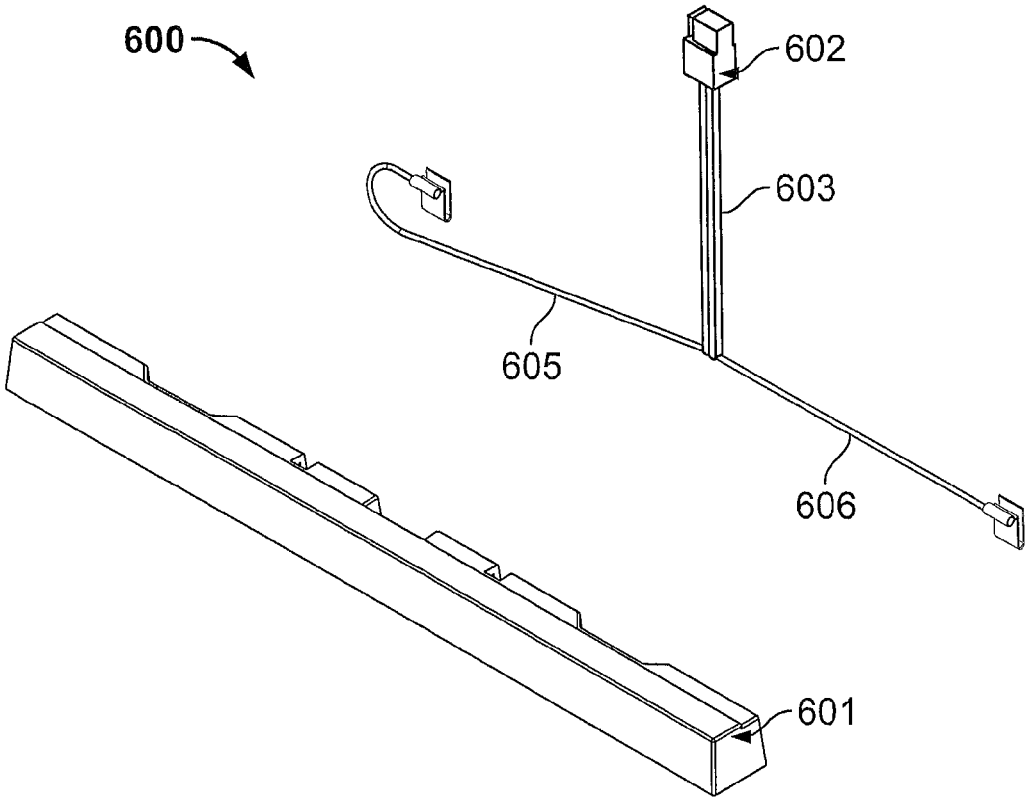
FIG. 50 is an exploded oblique view of a presently preferred embodiment of the feed connector assembly.

FIG. 50 is the presently preferred embodiment of the feed connector assembly 600 in an exploded view, showing the feed connector 601 and the harness assembly 602. In this embodiment a short center wire 603 adapts the harness 600 for mounting near the power supply, which is located at the header or footer of the device, most conveniently based on where the store's AC power sockets are located. But the long center cable 76.2 of FIG. 31 may still be used where it may be more convenient.

Feed connector 601 is white ABS with a UV inhibitor. Wire 605 sends DC negative to negative harness spring clip 607 at the negative side 611 of the feed connector 601. Wire 606 sends DC positive to the positive harness spring clip 608 on the positive side 612 of the feed connector 601. Feed connector 601 serves to house the wires 605 & 606 and their spring clips 607 & 608. Connector 615 plugs into a low voltage power socket on the power supply to supply power to the standards.

FIGS. 51-54 show an LCD monitor 704 and the bracket hardware that holds a place when it is used in this system.

Figure 51:
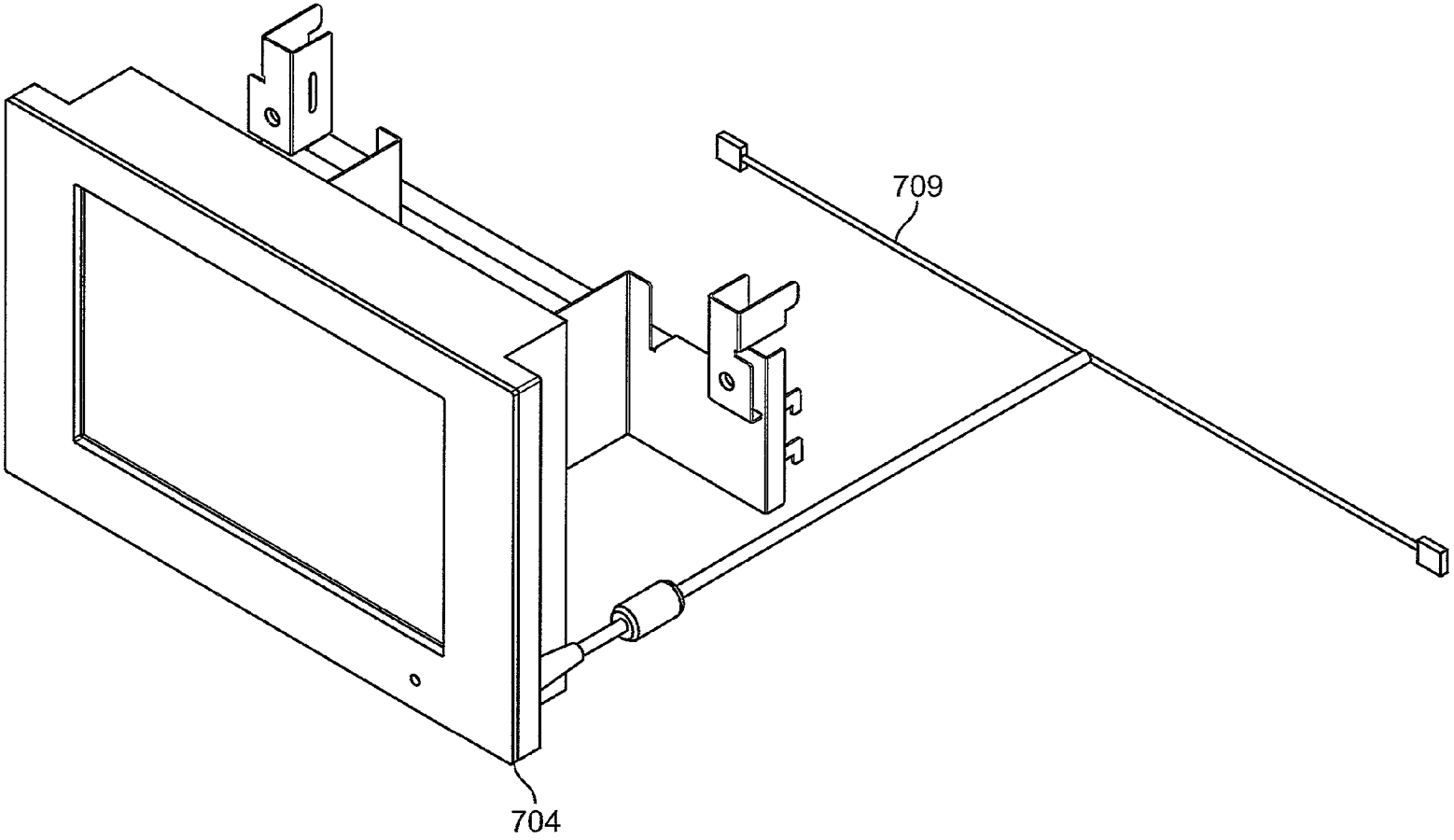
FIG. 51 is an oblique view of a monitor for use in this system.
Figure 52:
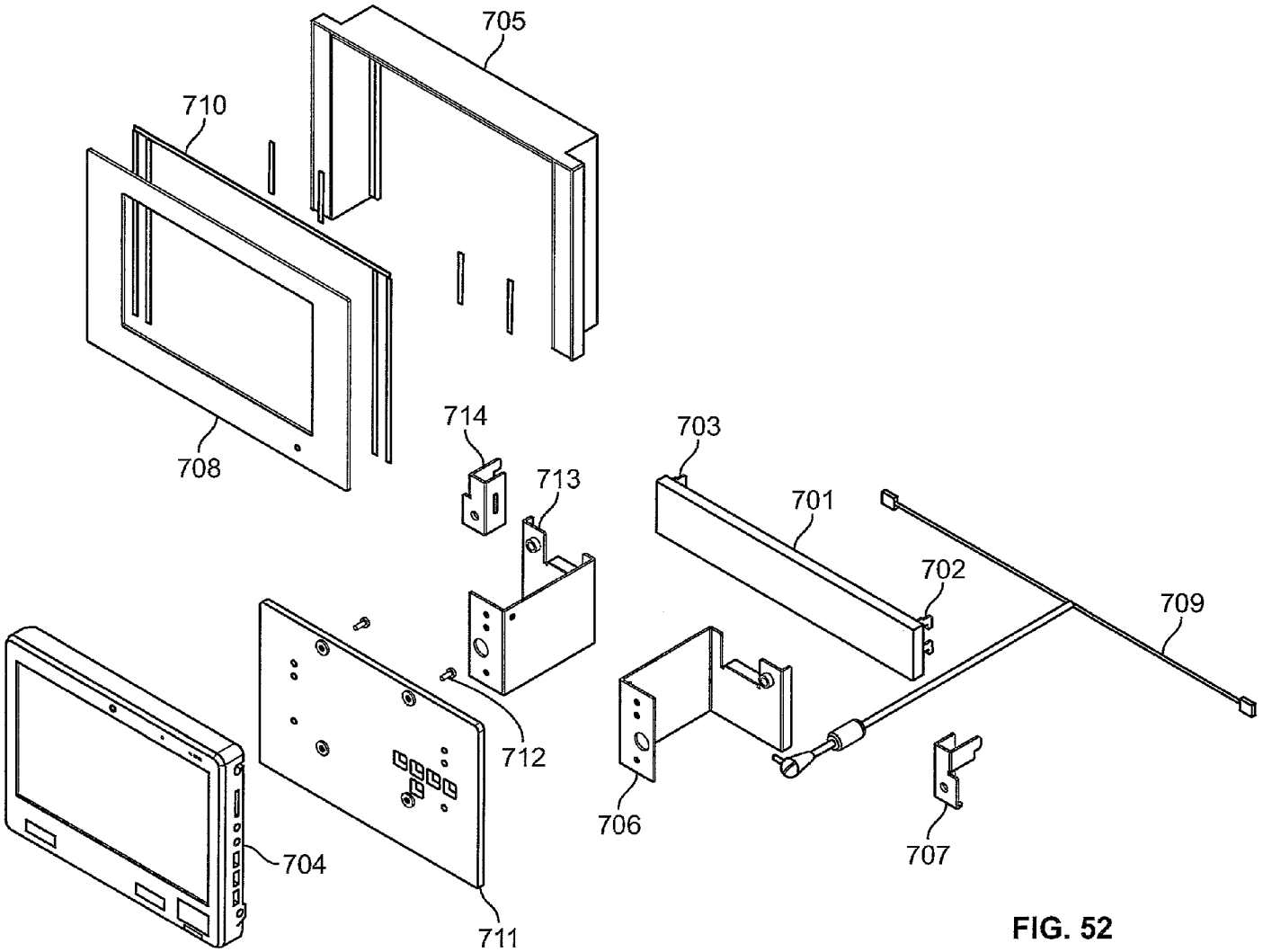
FIG. 52 is an exploded view thereof.
Figure 53:
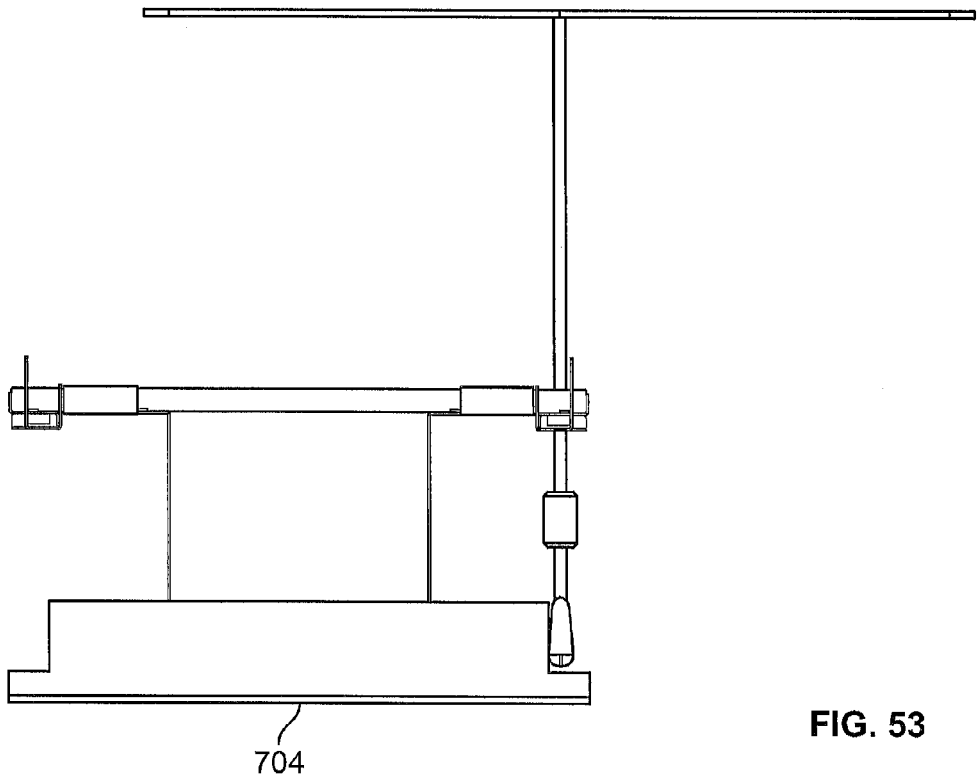
FIG. 53 is a plan view thereof.
Figure 54:
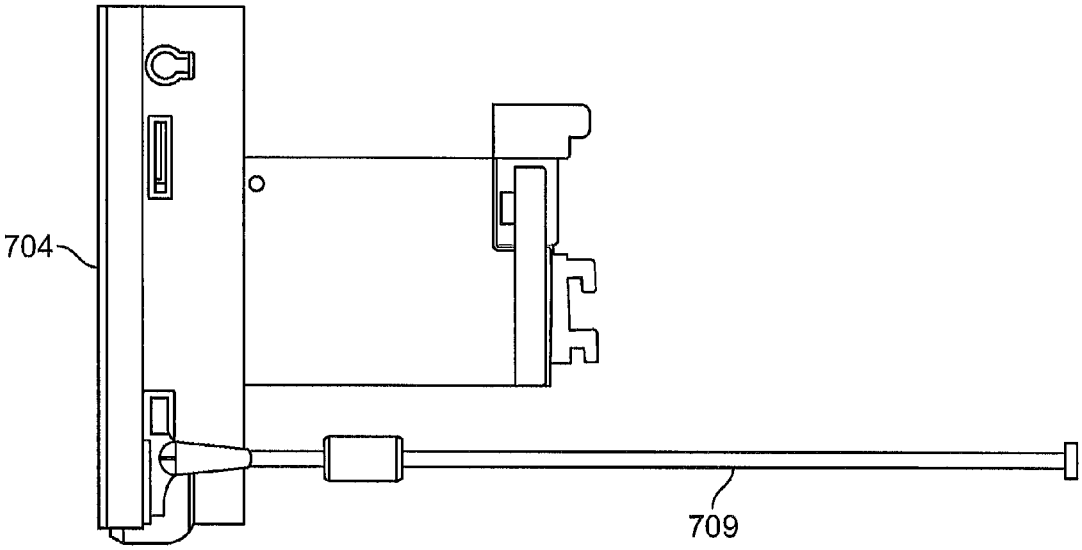
FIG. 54 is a side elevation thereof.

FIG. 51 is an oblique view. FIG. 52 is an exploded view showing all parts. Molded support bracket 701 attaches by knife bracket right 702 and by bracket left 703. These mount LCD monitor 704. Fabricated LCD housing 70 frames the LCD monitor. LCD mounting bracket 706 at 713 mounts the LCD back panel 711. LCD monitor 704 attaches to back panel 714 mm screws 712. LCD mounting bracket left 713 is a mirror image of mounting bracket 706 and LCD security bracket 714 is a mirror image of security bracket 707.

Figure 55:
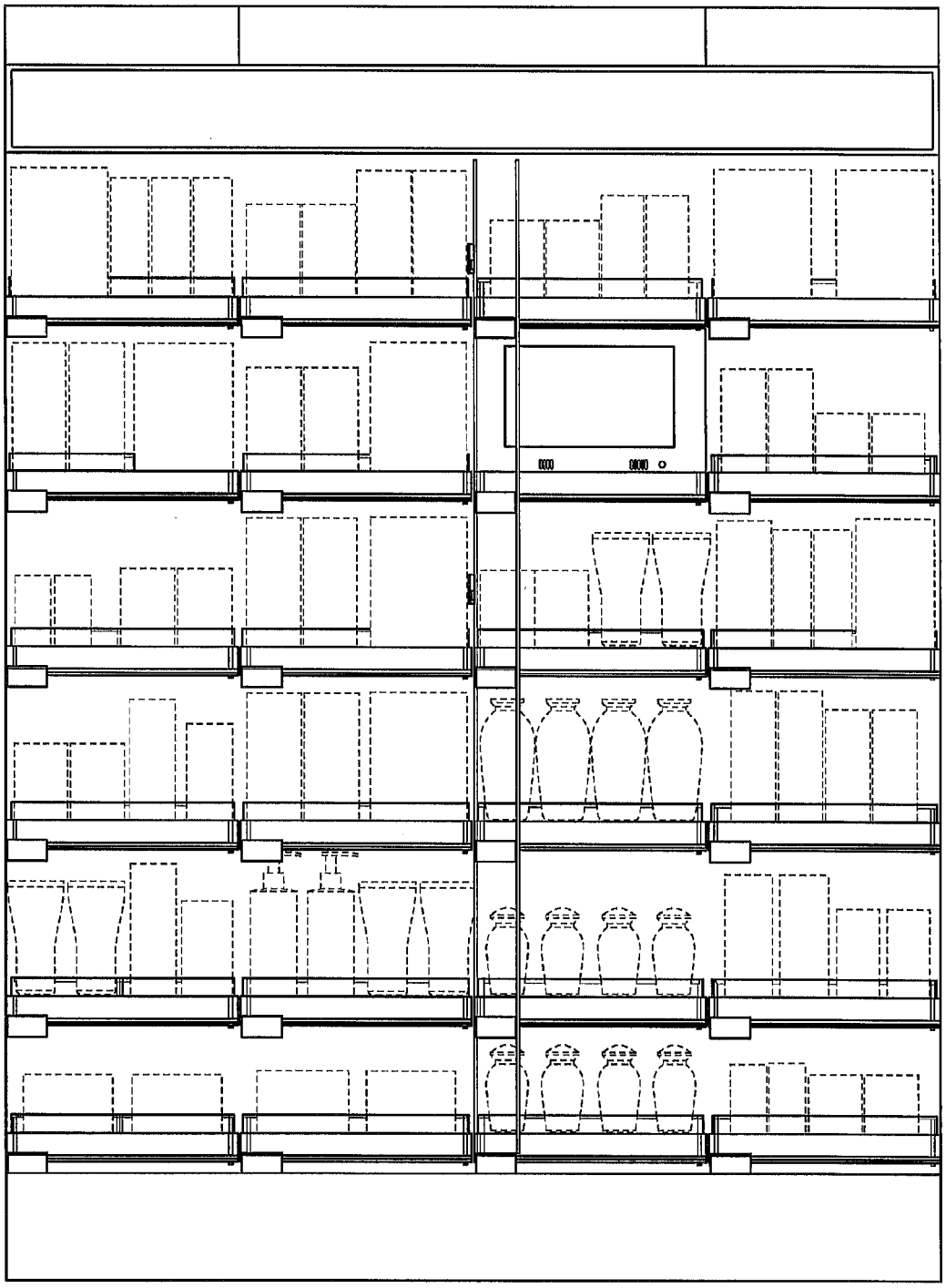
FIG. 55 is a front elevation of the wall section showing the monitor mounted among shelves of product in dashed lines.
Figure 56:
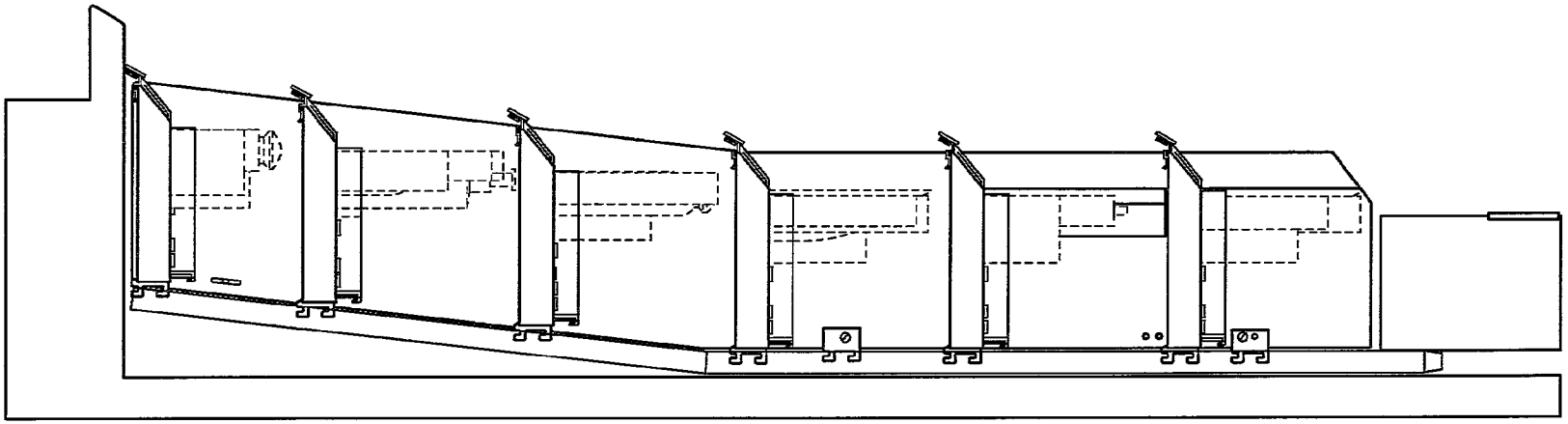
FIG. 56 is a side elevation of a plurality of shelves.
Figure 58:
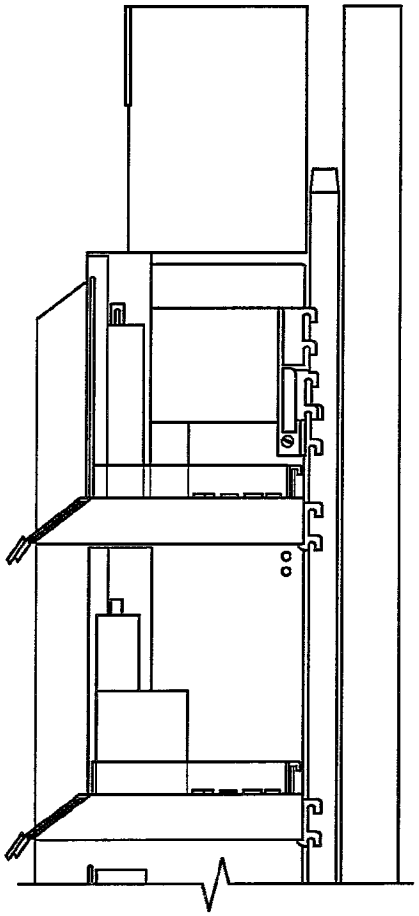
FIG. 58 is a similar side elevation thereof.
Figure 57:
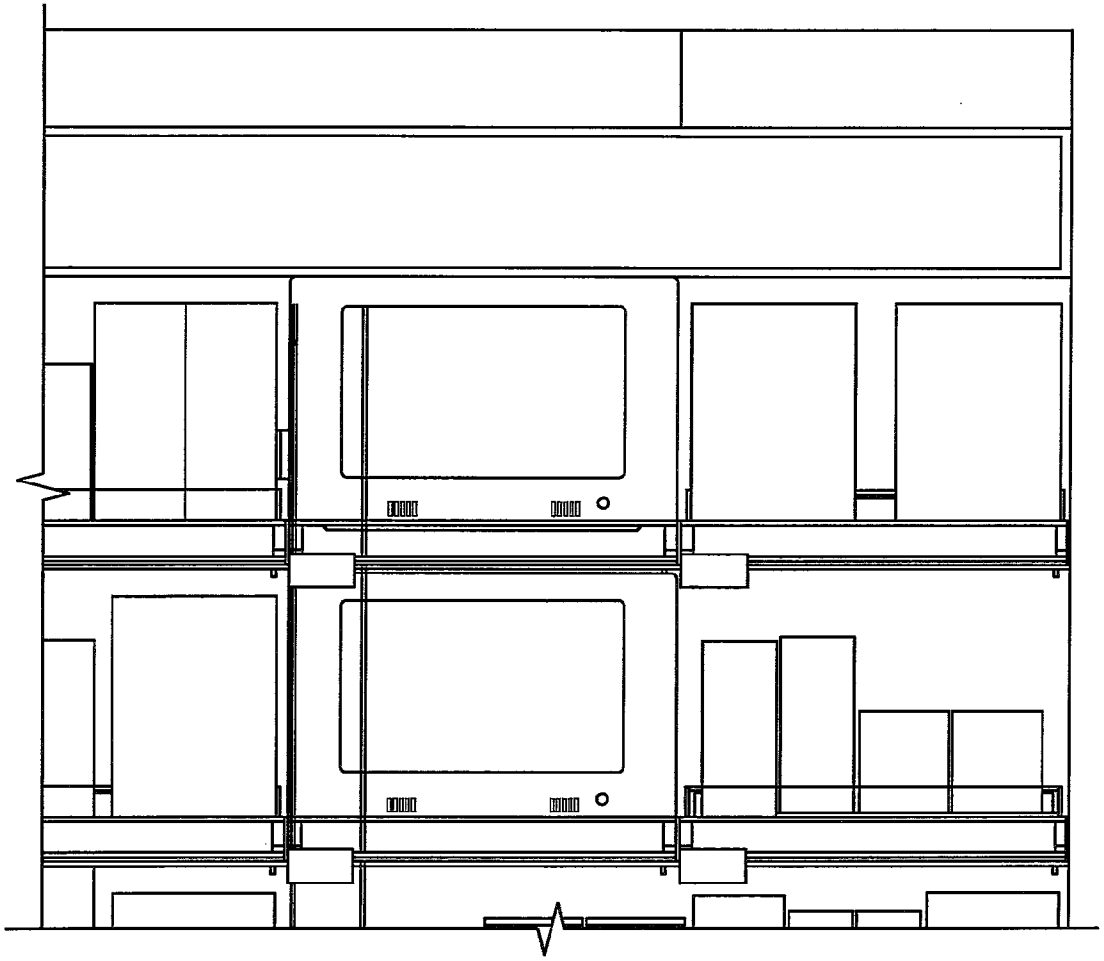
FIG. 57 is a front elevation showing monitors, and showing product in dashed lines.

FIGS. 55-56 shows one possible configuration of display and product on a display section.

Figure 59:
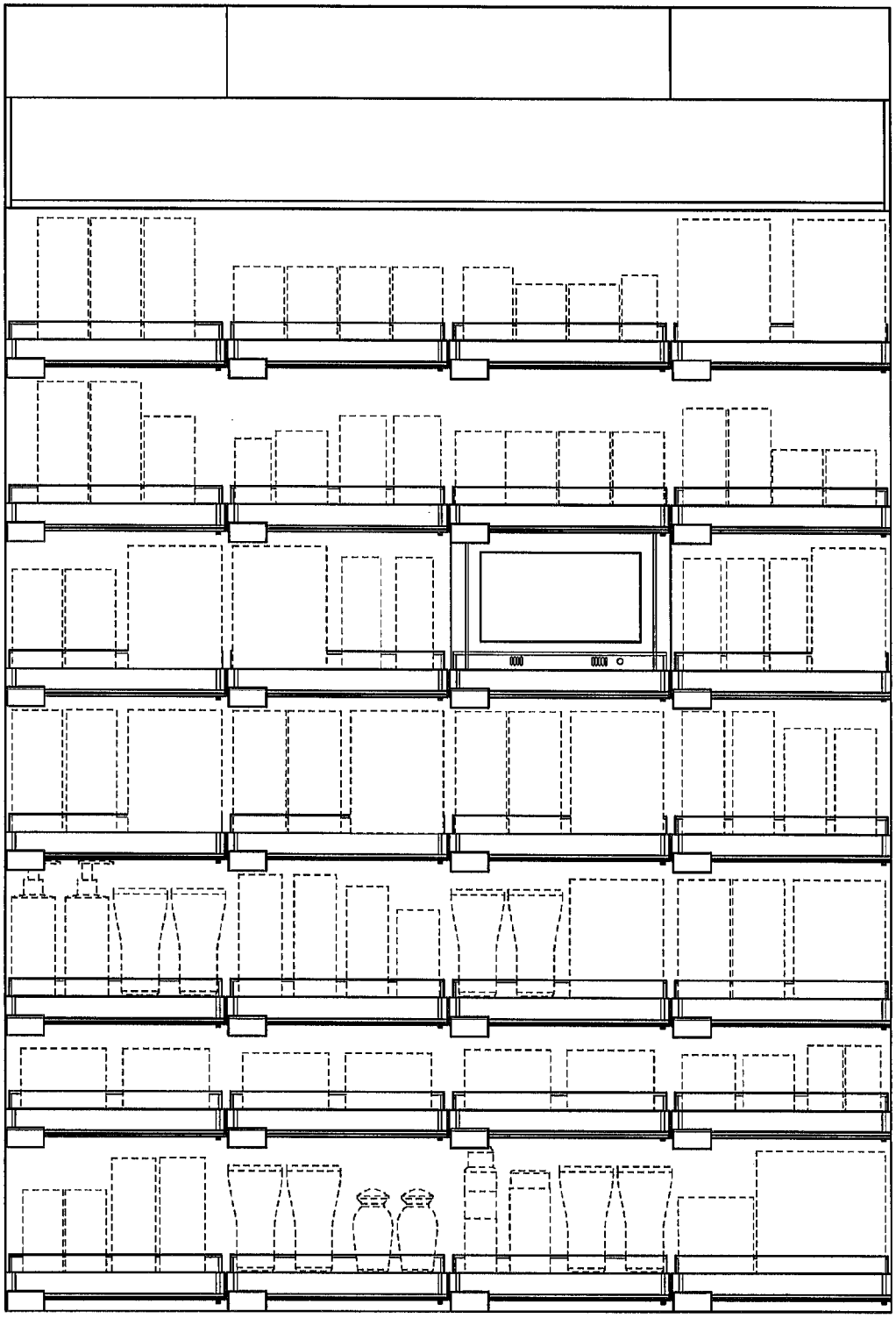
FIG. 59 is a front elevation of the wall section showing a monitor, and showing product in dashed lines.
Figure 60:
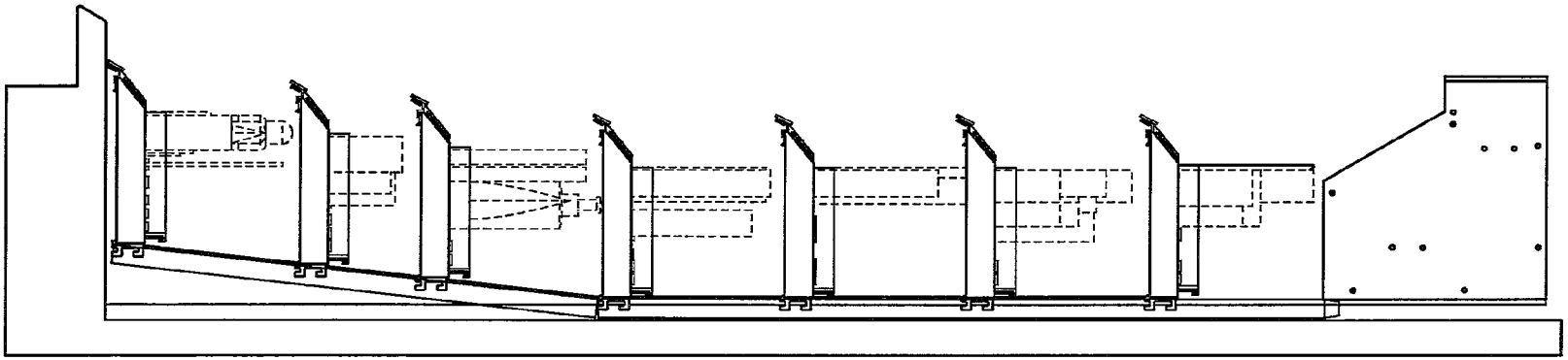
FIG. 60 is a side elevation showing product in dashed lines on shelf assemblies.

FIGS. 59-60 shows another possible configuration of element's.

Figure 61:
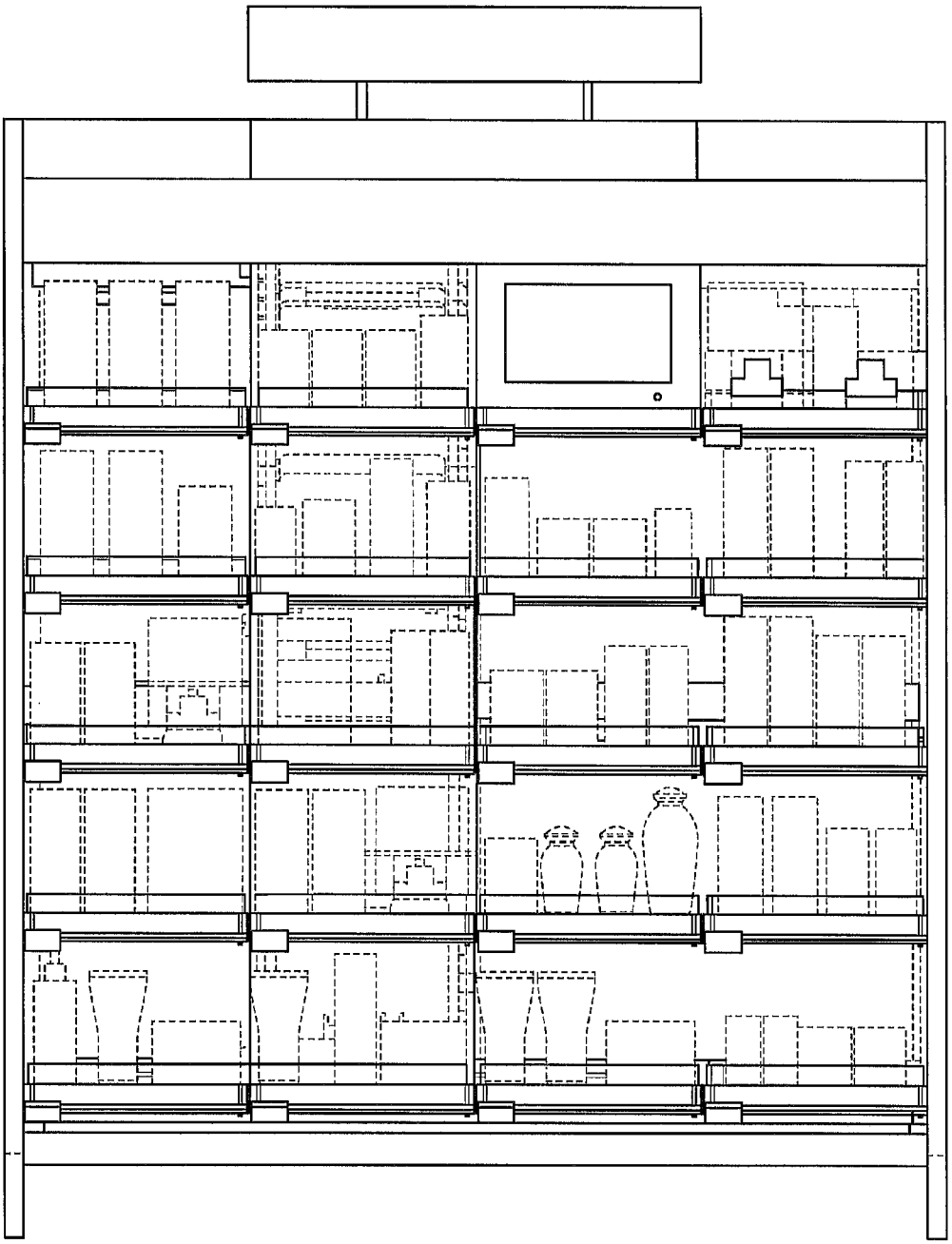
FIG. 61 is a front elevation of an embodiment of the present invention.
Figure 62:
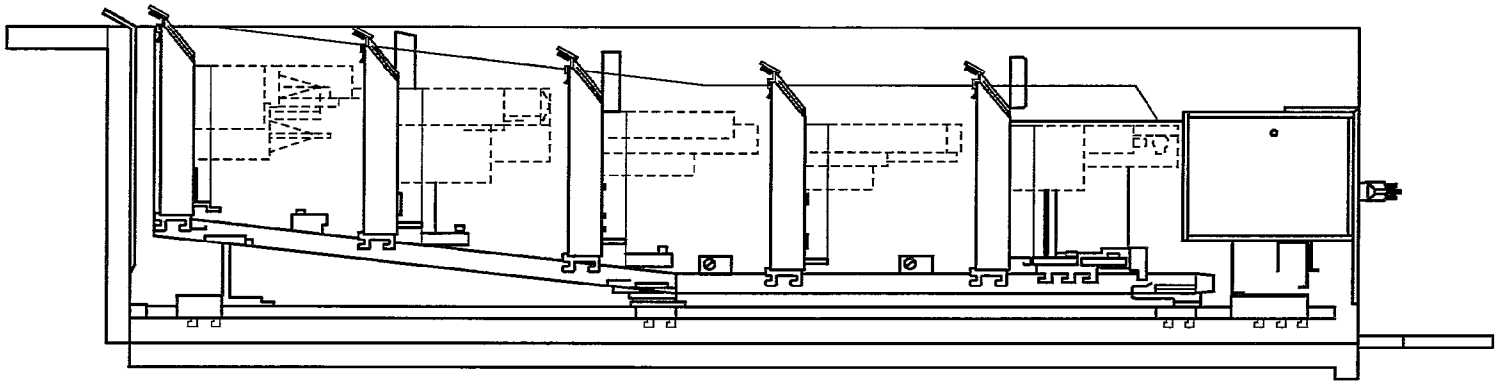
FIG. 62 is a side elevation thereof.
Figure 63:
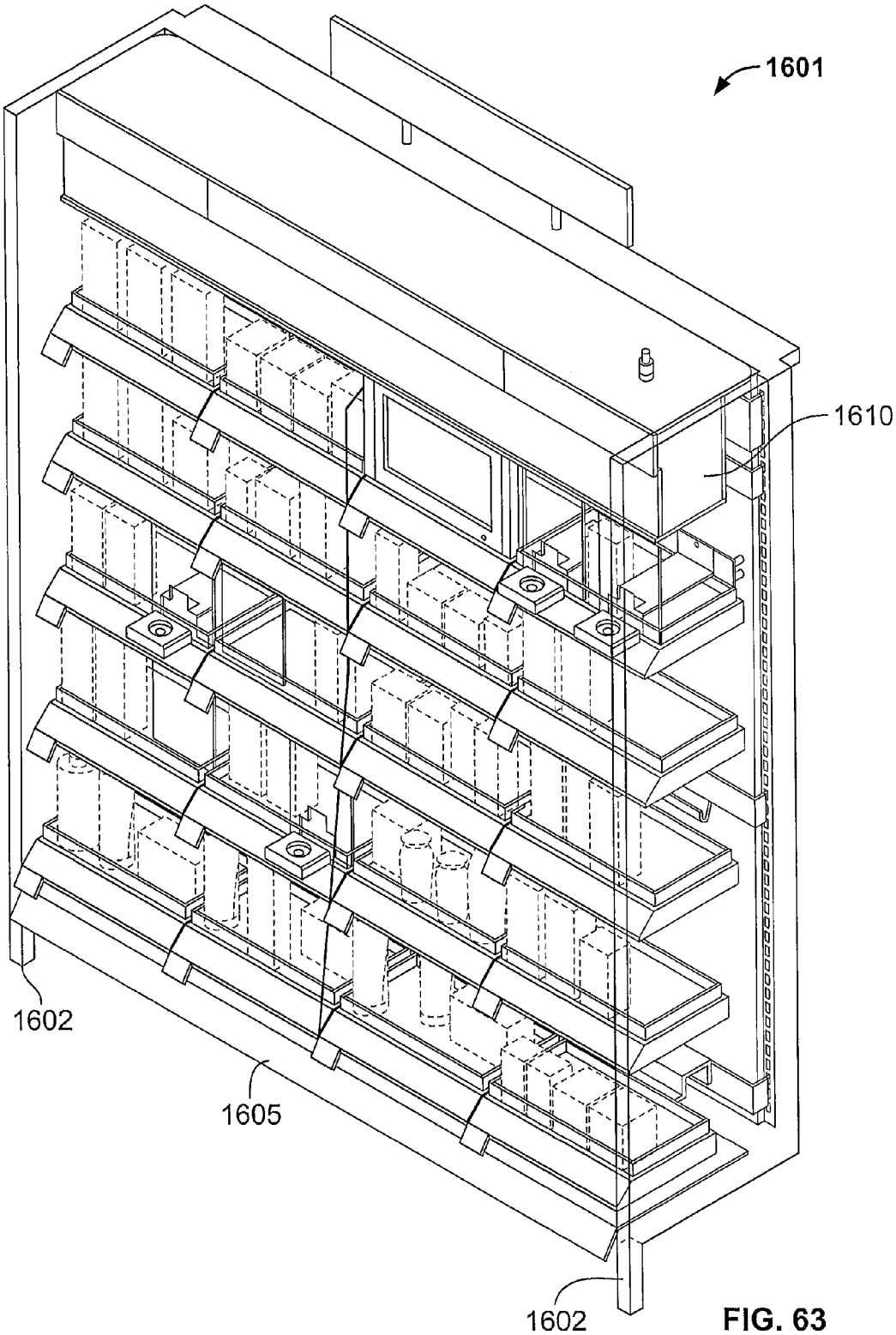
FIG. 63 is an oblique view thereof.
Figure 64:
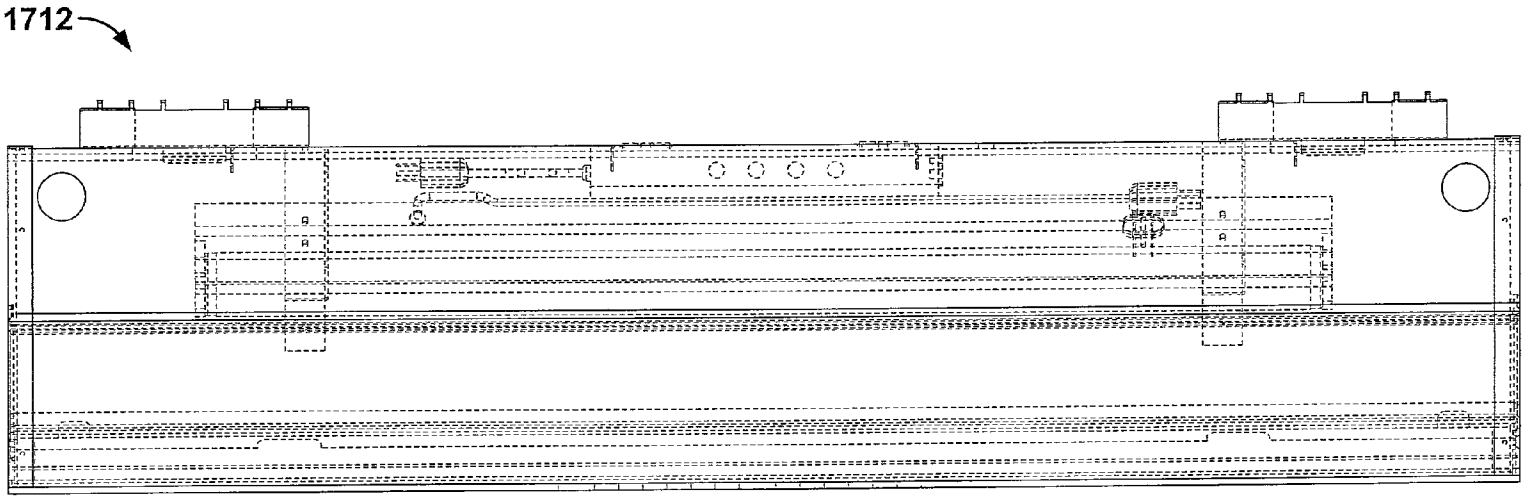
FIG. 64 is a plan view of the presently preferred header assembly showing detail in dashed lines.
Figure 65:
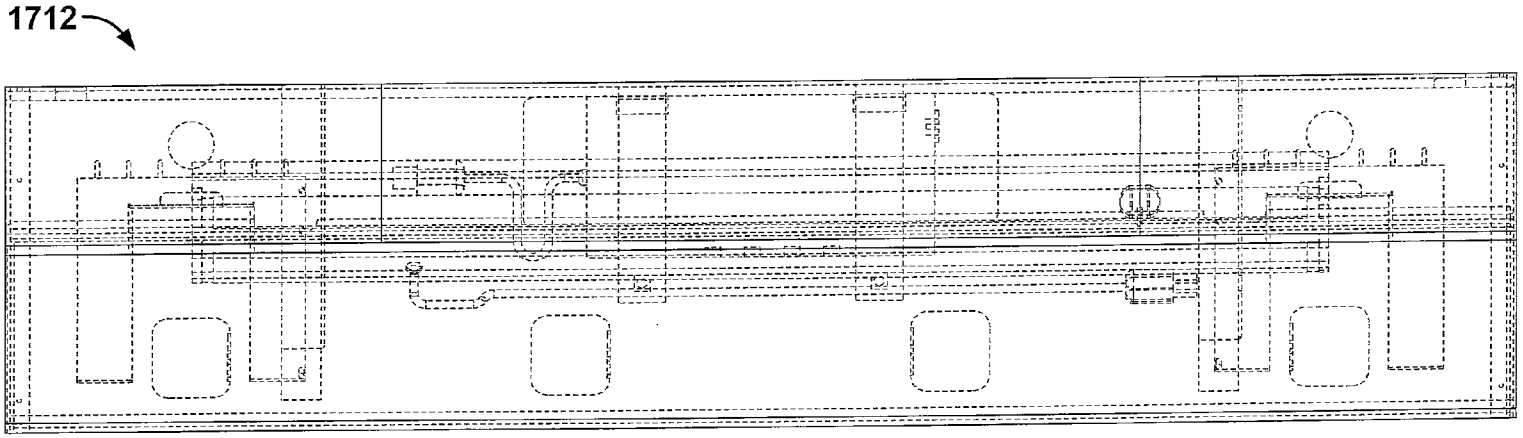
FIG. 65 is the front elevation thereof.
Figure 66:
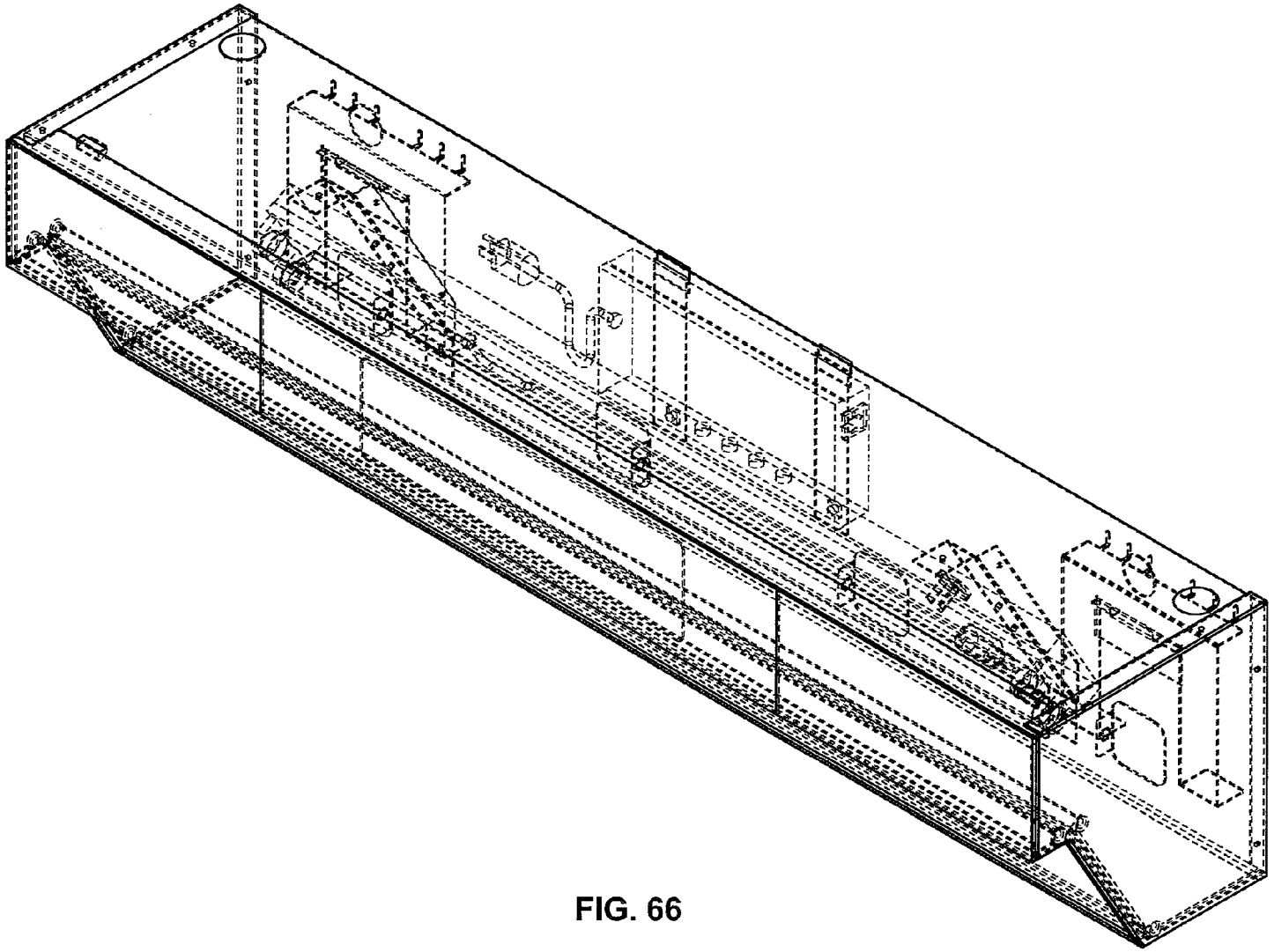
FIG. 66 is an oblique view thereof.
Figure 67:
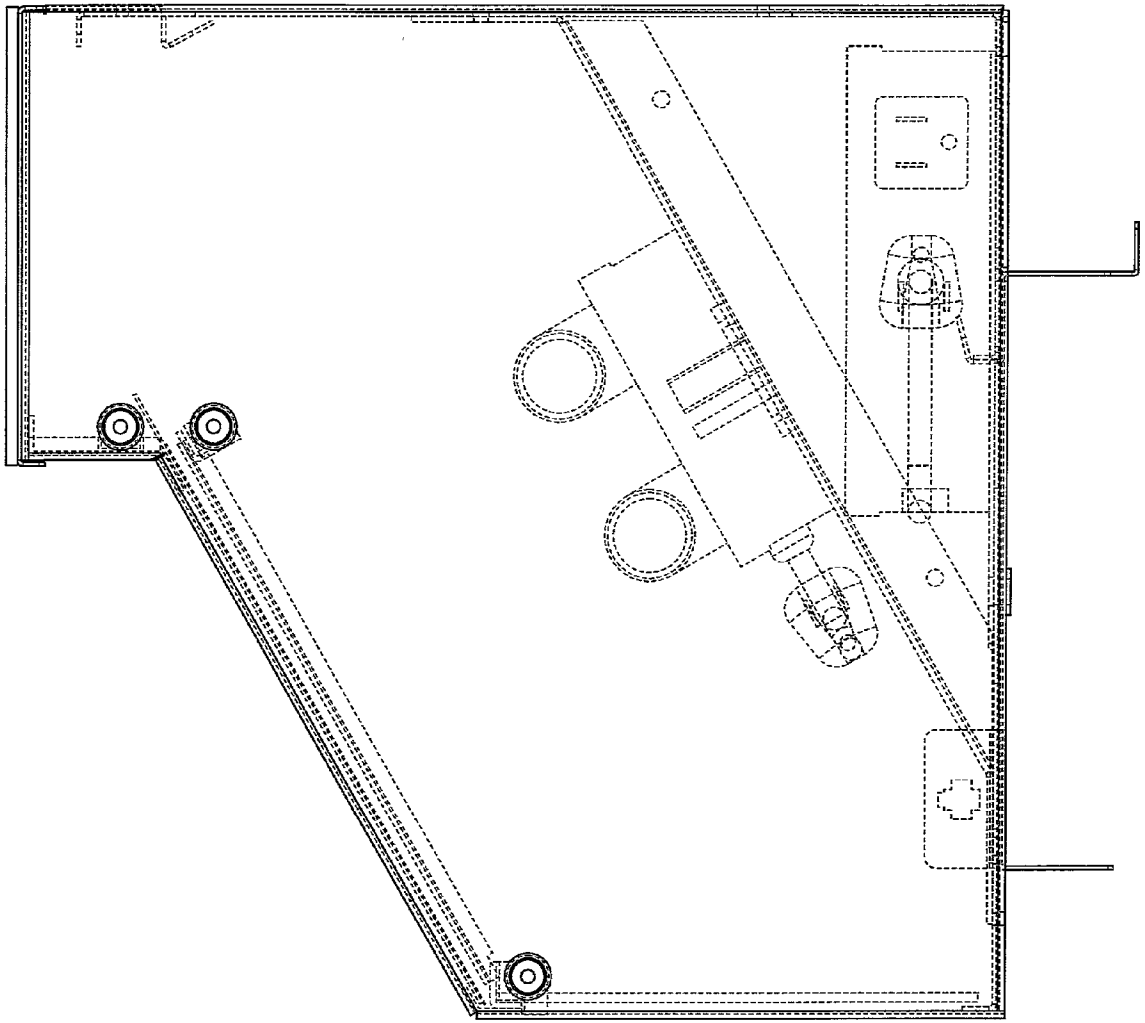
FIG. 67 is a side elevation thereof.

FIGS. 61-63 show another preferred embodiment configuration.

FIG. 63 shows a display unit 1601, which is raised off the floor by legs 1602. This provides space for a footer panel 1605 for further display.

The legs 1602 also provide room to mount power supply housing 1610 at the floor level, if the store's power sockets are located at the floor.

FIGS. 64-67 show the presently preferred header lighting box 1712.

I claim:

1. A low voltage power bus system including:

load bearing conductive standards, which load bearing conductive standards are at least partially covered;

a display module; and said display module comprising at least one pair of conductive support brackets configured to be conductively born by said covered load bearing conductive standards;

a carrier tray assembly for mounting in the low voltage power bus system said carrier tray assembly (16, 17A, 302) including:

a carrier tray (3022);

a display panel (316);

a reflector (314);

an LED assembly (312);

a circuit board (402);

a front bottom surface (3021);

a front floor (3024);

a sidewall (3026);

an inclined wall (3027);

a front inclined surface (3028);

a inner wall (3029);

a plurality of windows (3030);

a vertical wall front surface (3031);

a vertical wall back surface (3034);

a vertical wall bottom surface (3035);

a vertical wall notch (3037);

an edge (402*c*);

a lip (3058); an opposite edge (402*d*);

retaining tabs (3034);

windows (3030);

a tab (3040);

an inclined surface (3041);

a small bump (3043);

a detent (3046); and a notch surface (3047);

in which:

the carrier tray (302) is a molded plastic tray;

the front bottom surface (3021) of the carrier tray (302) forms the bottom of the front floor (3024), which abuts the sidewall (3026);

the inclined wall (3027) has a front surface (3028) and a back surface (3029);

the inclined wall (3027) abuts the sidewall (3026);

the front floor (3024) abuts the sidewall (3026);

the front floor (3024) abuts an inclined wall front surface (3028);

the front inclined surface (3028) has a plurality of the windows (3030);

the windows (3030) open to the inner wall to facilitate molding of the tab (3034) thereat;

from the inclined wall front surface (3028), extends the vertical wall front surface (3031); and the vertical wall has the vertical wall notch (3037) which is bounded by the lip (3058), for retaining an LED strip (312), with the edge (402*c*) placed against the vertical wall notch (3037), and the opposite edge (402*d*), having been rotated down towards the tab (3034); the opposite edge (402*d*) having been rotated past the inclined surface (3041), having wedged the tab (3034) down, having allowed the edge (402*d*) to pass the detent (3046), and having allowed the edge (402*d*) to settle against notch surface (3047), whereupon the tab (3034) returned up and captured the board 402, with the edge (402) held by the notch surface (3047) and by the detent (3046), with the board's (402) flat surface (402*b*) abutting the inclined wall's (3027) inner surface (3029).

2. The low voltage power bus system of claim 1 including:

a plurality of conductive support brackets;

a pair of conductive standards having a plurality of supporting slots, supporting at least one of the plurality of conductive support brackets;

a joining member comprising insulating material, and secured to each of the standards to join said standards together in parallel arrangement;

wherein one of the conductive standards is energizable with a first low voltage polarity, and another of the conductive standards is energizable with an opposite low voltage polarity.

3. The low voltage power bus system according to claim 2, in which:

the conductive standards have supporting slots;

the supporting slots support the brackets;

a preconfigured rail cover having its own independent structure and made of an insulating material insulates at least one of the standards;

the rail cover defines a plurality of rail cover slots; and each of the rail cover slots aligns with one of the supporting slots, thereby admitting the brackets through the rail cover slot to be supported by and in electrical contact with the conductive standards.

* * * * *